US011002095B2

(12) United States Patent
Gromes, Sr. et al.

(10) Patent No.: US 11,002,095 B2
(45) Date of Patent: May 11, 2021

(54) DOWN WELL PIPE CUTTER HAVING A PLURALITY OF CUTTING HEADS

(71) Applicant: Terydon, Inc., Navarre, OH (US)

(72) Inventors: Terry D. Gromes, Sr., Navarre, OH (US); Gary L. Manack, Jr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 193 days.

(21) Appl. No.: 16/356,042

(22) Filed: Mar. 18, 2019

(65) Prior Publication Data

US 2019/0211641 A1 Jul. 11, 2019

Related U.S. Application Data

(63) Continuation-in-part of application No. 15/813,551, filed on Nov. 15, 2017, now Pat. No. 10,774,606, and a continuation-in-part of application No. 15/813,679, filed on Nov. 15, 2017, now Pat. No. 10,781,652.

(51) Int. Cl.

| | |
|---|---|
| ***E21B 29/00*** | (2006.01) |
| ***E21B 43/114*** | (2006.01) |
| ***B24C 7/00*** | (2006.01) |
| ***B24C 3/32*** | (2006.01) |
| ***E21B 41/00*** | (2006.01) |

(52) U.S. Cl.

CPC ..... *E21B 29/002* (2013.01); *E21B 41/0078* (2013.01); *E21B 43/114* (2013.01); *B24C 3/325* (2013.01); *B24C 7/0007* (2013.01)

(58) Field of Classification Search

CPC ..... E21B 29/005; B24C 3/325

See application file for complete search history.

(56) References Cited

U.S. PATENT DOCUMENTS

| | | | |
|---|---|---|---|
| 2,265,082 | A | 12/1941 | O'Neill |
| 2,315,496 | A | 4/1943 | Boynton |
| 3,066,735 | A | 12/1962 | Zingg |
| 3,081,828 | A | 3/1963 | Quick |
| 3,145,776 | A | 8/1964 | Pittman |
| 3,338,305 | A | 8/1967 | Pittman et al. |
| 3,393,736 | A | 7/1968 | Goodwin |
| 3,585,699 | A | 6/1971 | Shuttle |

(Continued)

FOREIGN PATENT DOCUMENTS

| | | |
|---|---|---|
| CA | 2587483 | 5/2006 |
| CA | 2757675 | 3/2012 |

OTHER PUBLICATIONS

Peter S. Menell et al., "Patent Claim Construction: A Modern Synthesis and Structured Framework," 25 Berkeley Tech. L.J. 711, Jan. 1, 2010, 121 pages.

*Primary Examiner* — Blake E Michener

(74) *Attorney, Agent, or Firm* — Sand, Sebolt & Wernow Co., LPA

(57) ABSTRACT

A cutting head assembly uses multiple cutting heads directing ultra-high pressure fluid in different directions towards an inner surface of a pipe to be cut in order to complete a full cut of the pipe while rotating or revolving the multiple cutting heads less than 360 degrees relative to central axis. The ultra-high pressure fluid mixes with abrasive inside fittings on or near each of the nozzles to further assist with cutting through the pipe. Some cutting head assemblies have two nozzles, while other cutting head assemblies have three or four nozzles.

8 Claims, 40 Drawing Sheets

(56) References Cited

U.S. PATENT DOCUMENTS

| | | | | |
|---|---|---|---|---|
| 4,047,569 | A | 9/1977 | Tagirov et al. | |
| 4,346,761 | A | 8/1982 | Skinner et al. | |
| 4,598,769 | A | 7/1986 | Robertson | |
| 4,619,556 | A | 10/1986 | Parra | |
| 4,648,215 | A | 3/1987 | Hashish et al. | |
| 4,768,899 | A | 9/1988 | Dysarz | |
| 5,001,870 | A | 3/1991 | Yokota et al. | |
| 5,010,694 | A | 4/1991 | Agbede | |
| 5,065,551 | A | 11/1991 | Fraser | |
| 5,144,766 | A | 9/1992 | Hashish et al. | |
| 5,381,631 | A | 1/1995 | Raghavan et al. | |
| 5,435,394 | A | 7/1995 | Robertson | |
| 5,685,078 | A | 11/1997 | Obst et al. | |
| 5,695,010 | A | 12/1997 | Hongo | |
| 6,138,777 | A | 10/2000 | Fraim et al. | |
| 6,155,343 | A | 12/2000 | Nazzal et al. | |
| 6,189,629 | B1 | 2/2001 | McLeod et al. | |
| 6,283,230 | B1 | 9/2001 | Peters | |
| 6,439,313 | B1 | 8/2002 | Thomeer et al. | |
| 6,564,868 | B1 | 5/2003 | Ferguson et al. | |
| 7,178,598 | B2 | 2/2007 | Lund et al. | |
| 7,306,031 | B2 | 12/2007 | Wright et al. | |
| 7,527,092 | B2 | 5/2009 | McAfee | |
| 7,540,327 | B2 | 6/2009 | Billingham | |
| 7,546,876 | B2 | 6/2009 | McAfee | |
| 7,922,566 | B2 | 4/2011 | Chacko et al. | |
| 7,926,196 | B2 | 4/2011 | Mueller et al. | |
| 8,011,426 | B1 | 9/2011 | Orgeron | |
| 8,312,930 | B1 * | 11/2012 | Glass | E03B 3/15 166/312 |
| 8,448,880 | B2 | 5/2013 | Hashish et al. | |
| 8,496,238 | B1 | 7/2013 | Orgeron | |
| 8,540,429 | B1 | 9/2013 | Olsson et al. | |
| 8,820,396 | B2 | 9/2014 | Cumby et al. | |
| 8,833,444 | B2 | 9/2014 | McAfee et al. | |
| 9,453,384 | B2 | 9/2016 | Von Wirth et al. | |
| 9,464,399 | B2 | 10/2016 | Melancon | |
| 9,976,351 | B2 | 5/2018 | Randall | |
| 2001/0030231 | A1 | 10/2001 | Grossman | |
| 2003/0121155 | A1 | 7/2003 | Walsh et al. | |
| 2003/0121156 | A1 | 7/2003 | Walsh et al. | |
| 2004/0083829 | A1 | 5/2004 | Chapman et al. | |
| 2004/0089450 | A1 | 5/2004 | Slade et al. | |
| 2005/0173123 | A1 | 8/2005 | Lund et al. | |
| 2007/0114066 | A1 | 5/2007 | Hall et al. | |
| 2007/0175636 | A1 | 8/2007 | McAfee | |
| 2008/0066913 | A1 | 3/2008 | Lynde et al. | |
| 2008/0271892 | A1 | 11/2008 | Lynde et al. | |
| 2008/0273934 | A1 | 11/2008 | Morgan | |
| 2008/0277118 | A1 | 11/2008 | McAfee | |
| 2013/0112393 | A1 | 5/2013 | Cumby et al. | |
| 2014/0157963 | A1 | 6/2014 | Von Wirth et al. | |
| 2015/0211202 | A1 | 7/2015 | Melancon | |
| 2015/0285021 | A1 | 10/2015 | Sides, III et al. | |
| 2015/0337612 | A1 * | 11/2015 | Heil | E21B 17/20 166/285 |
| 2019/0145208 | A1 | 5/2019 | Gromes, Sr. | |
| 2019/0145209 | A1 | 5/2019 | Gromes, Sr. | |
| 2019/0145210 | A1 | 5/2019 | Gromes, Sr. | |
| 2019/0211641 | A1 | 7/2019 | Gromes, Sr. | |
| 2019/0224796 | A1 | 7/2019 | Stokley | |

* cited by examiner

DOWN WELL PIPE CUTTER HAVING A PLURALITY OF CUTTING HEADS

CROSS REFERENCE TO RELATED APPLICATIONS

This is a Continuation-In-Part Application of U.S. patent application Ser. No. 15/813,551, filed Nov. 15, 2017, and a Continuation-In-Part Application of U.S. patent application Ser. No. 15/813,679, filed Nov. 15, 2017; the disclosure of which is incorporated herein by reference.

TECHNICAL FIELD

The present invention relates to ultra-high pressure (UHP) cutting devices, and specifically to UHP cutting devices for sublevel use for cutting pipe casings and liners for example in the dismantling of existing oil, gas and/or utility well bores or lines.

BACKGROUND

Background Information

The abandonment of non-producing or uneconomic oil or gas wells presents a number of safety and environment issues. Typically, in the abandonment process, all production and surface wellbore casings along with conductor barrels and cement liners have to be removed to a depth of two meters below the surface.

A previous method for such removal required a large scale excavation of soil from around the existing wellbore. In order to do this, line location companies needed to be brought in to determine locations of any existing oil, gas and/or utility lines. Proper safety practices typically require that a very large area be excavated to allow a welder and an assistant to descend into the area to the required depth to cut the existing steel casings and cement liners. This cutting of the casing is done using a cutting torch.

Typically, the casing is cut horizontally and then vertically to remove the outer layer. Any cement present then has to be removed using either a jackhammer or sledge hammer. This allows access to secondary steel casings that are cut using the cutting torch again.

Throughout this process, a source of ignition, the cutting torch, is being used in an area wherein there is a possibility for the presence of explosive or flammable gases or liquids. This type of work environment may be referred to as a hot work area. A significant safety threat is inherent for the personnel in a hot work area and is further exasperated through the use of a cutting torch or any other heat based cutting tool.

One previous attempt at overcoming this issue was to provide a different type of tool consisting of a rotatable tube or hose that would be lowered inside the casing and then rotated about the central longitudinal axis.

More particularly, U.S. Pat. No. 8,820,396 provides an ultra-high pressure (UHP) cutting device for insertion into a wellbore for cutting the casing of the wellbore from within the wellbore. The cutting device of the '396 patent comprises a UHP hose connector for connection with a UHP hose in communication with a fluid source; a rotatable UHP tube with a top end in fluid communication with the UHP hose connector and a bottom end opposite the top end; a rotating means in operational communication with the UHP tube for rotating the UHP tube during operation of the cutting device; and a cutter head in fluid communication with the bottom end of the UHP tube.

SUMMARY

Issues continue to exist with cutting devices for insertion into a wellbore. Particularly, previous cutting devices using UHP hoses, such as provided in the '396 patent, require a complex system of connectors to effectuate the rotatable movement of the UHP hose. Thus, a need continues to exist for cutting devices using UHP hoses that are simpler in construction therefore less likely to fail. The present disclosure address these and other issues by providing a cutting device for insertion into a wellbore for cutting the casing of the wellbore from within the wellbore with a revolvable UHP hose (i.e., able to be revolved); not a rotating UHP hose.

In accordance with one aspect, an exemplary embodiment of the present disclosure may provide a cutting head for a down hole pipe to be cut, the cutting head comprising: a first nozzle to direct ultra-high pressure (UHP) fluid towards an inner surface of the down hole pipe; a second nozzle to direct UHP fluid towards a different portion of the inner surface of the down hole pipe; wherein the UHP fluid has a pressure when exiting the first nozzle and second nozzle sufficient to cut the down hole pipe; and a first axis of the cutting head disposed within an interior bore of the down-hole pipe, wherein the first nozzle and the second nozzle each rotate or revolve around first axis less than 360° operative to impart a fully 360° cut to the down hole pipe. This exemplary embodiment, or another exemplary embodiment may further provide a first nozzle axis associated with the first nozzle; a second nozzle axis associated with the second nozzle; and wherein the first nozzle axis is offset and orthogonal to the first axis and the second nozzle axis is offset and orthogonal to the first axis opposite the first nozzle axis. This exemplary embodiment, or another exemplary embodiment may further provide a first outlet on the first nozzle; a second outlet on the second nozzle; and wherein the first outlet faces the inner surface of the down hole pipe and the second outlet faces a different portion the inner surface of the down hole pipe at an angle in a range from 90 degrees to 270 degrees relative to the first axis. This exemplary embodiment, or another exemplary embodiment may further provide a first distance defined between the first nozzle and the second nozzle; an annular frame having an outer surface and an inner surface defining a central bore centered along the first axis and an inner diameter measured through the first axis and an outer diameter measured through the first axis; and wherein the inner diameter of the annular frame is greater than the first distance. This exemplary embodiment, or another exemplary embodiment may further provide a top edge and a bottom edge on the annular frame defining a length of annular frame aligned parallel to the first axis; and wherein when the cutting head is disposed within the down hole pipe, the first nozzle and the second nozzle are below the bottom edge of the annular frame. This exemplary embodiment, or another exemplary embodiment may further provide at least one bearing rotatable about a second axis offset parallel to the first axis and in contact with an inner surface of the annular frame. This exemplary embodiment, or another exemplary embodiment may further provide a first UHP inlet on the first nozzle positioned radially inward of the inner surface of the annular frame relative to the first axis; and a second UHP inlet on the second nozzle positioned radially inward of the inner surface of the annular frame relative to the first axis. This exemplary embodiment, or another exemplary embodiment may further provide a first abrasive inlet on the first nozzle adjacent the first UHP inlet, wherein the first abrasive inlet is positioned radially inward of the inner surface of the annular frame relative to the first axis; and a second abrasive inlet on the second nozzle adjacent the second UHP inlet, wherein the second abrasive inlet is positioned radially inward of the inner surface of the annular frame relative to the first axis. This exemplary embodiment, or another exemplary embodiment may further provide wherein the first abrasive inlet and the second abrasive inlet are oriented parallel to the first axis. This exemplary embodiment, or another exemplary embodiment may further provide wherein the first UHP inlet and the second UHP inlet are orthogonal to the first abrasive inlet and the second abrasive inlet, respectively, and wherein the first and second UHP inlets couple with at least one UHP hose that revolves around the first axis. This exemplary embodiment, or another exemplary embodiment may further provide a UHP outlet on the first nozzle positioned approximately 180° from a UHP outlet on the second nozzle. This exemplary embodiment, or another exemplary embodiment may further provide a third nozzle to direct UHP fluid towards a different portion of the inner surface of the down hole pipe than the first nozzle and the second nozzle; UHP outlets on the first nozzle, the second nozzle, and the third nozzle, respectively, wherein the UHP outlets are positioned 120° from each other. This exemplary embodiment, or another exemplary embodiment may further provide a third nozzle to direct UHP fluid towards a different portion of the inner surface of the down hole pipe than the first nozzle and the second nozzle; a fourth nozzle to direct UHP fluid towards a different portion of the inner surface of the down hole pipe than the first nozzle, the second nozzle, and the third nozzle; UHP outlets on the first nozzle, the second nozzle, the third nozzle, and the fourth nozzle, respectively, wherein the UHP outlets are positioned 90° from each other.

In accordance with one aspect, an exemplary embodiment of the present disclosure may provide a method comprising: disposing a cutting head within a pipe; moving an ultra-high pressure (UHP) fluid through the cutting head; moving the UHP fluid through a first nozzle and a second nozzle, wherein the first nozzle is adapted to direct the UHP fluid towards a different portion of the pipe than the second nozzle; rotating or revolving the cutter head about a first axis less than 360 degrees; and completing a full 360 cut through the pipe without completing a full rotation or revolution of the cutting head relative to the first axis. This exemplary embodiment, or another exemplary embodiment may further provide moving a first stream of UHP fluid through a first direction; moving a second stream of UHP fluid through the second nozzle in a second direction different than the first direction, wherein the first direction is offset from the second direction in a range from about 90 degrees to about 270 degrees. This exemplary embodiment, or another exemplary embodiment may further provide moving a third stream of UHP fluid through a third nozzle on the cutting head; rotating or revolving the cutter head approximately 120 degrees about the first axis to complete the 360 degree cut in the pipe. This exemplary embodiment, or another exemplary embodiment may further provide rotating a bearing about a bearing axis offset parallel to the first axis and extending through an annular frame that is at least partially above the cutting head. This exemplary embodiment, or another exemplary embodiment may further provide contacting an outer surface of the bearing with an inner surface of the annular frame as the bearing rotates about the bearing axis and revolves around the first axis. This exemplary embodiment, or another exemplary embodiment may further provide moving a third stream of UHP fluid through a third nozzle on the cutting head; moving a fourth stream of UHP fluid through a fourth nozzle on the cutting head; rotating or revolving the cutter head approximately 90 degrees about the first axis to complete the full 360 degree cut in the pipe. This exemplary embodiment, or another exemplary embodiment may further provide revolving a UHP tube carrying UHP fluid approximately 180 degrees or less around a longitudinal support extending through the pipe to effectuate the full 360 degree cut through the pipe. This exemplary embodiment, or another exemplary embodiment may further provide feeding abrasive through a first abrasive feed line connected to the first nozzle; feeding abrasive to the second nozzle; rotating or revolving the first abrasive feed line approximately 180 degrees about the first axis while completing the full 360 degree cut through the pipe.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
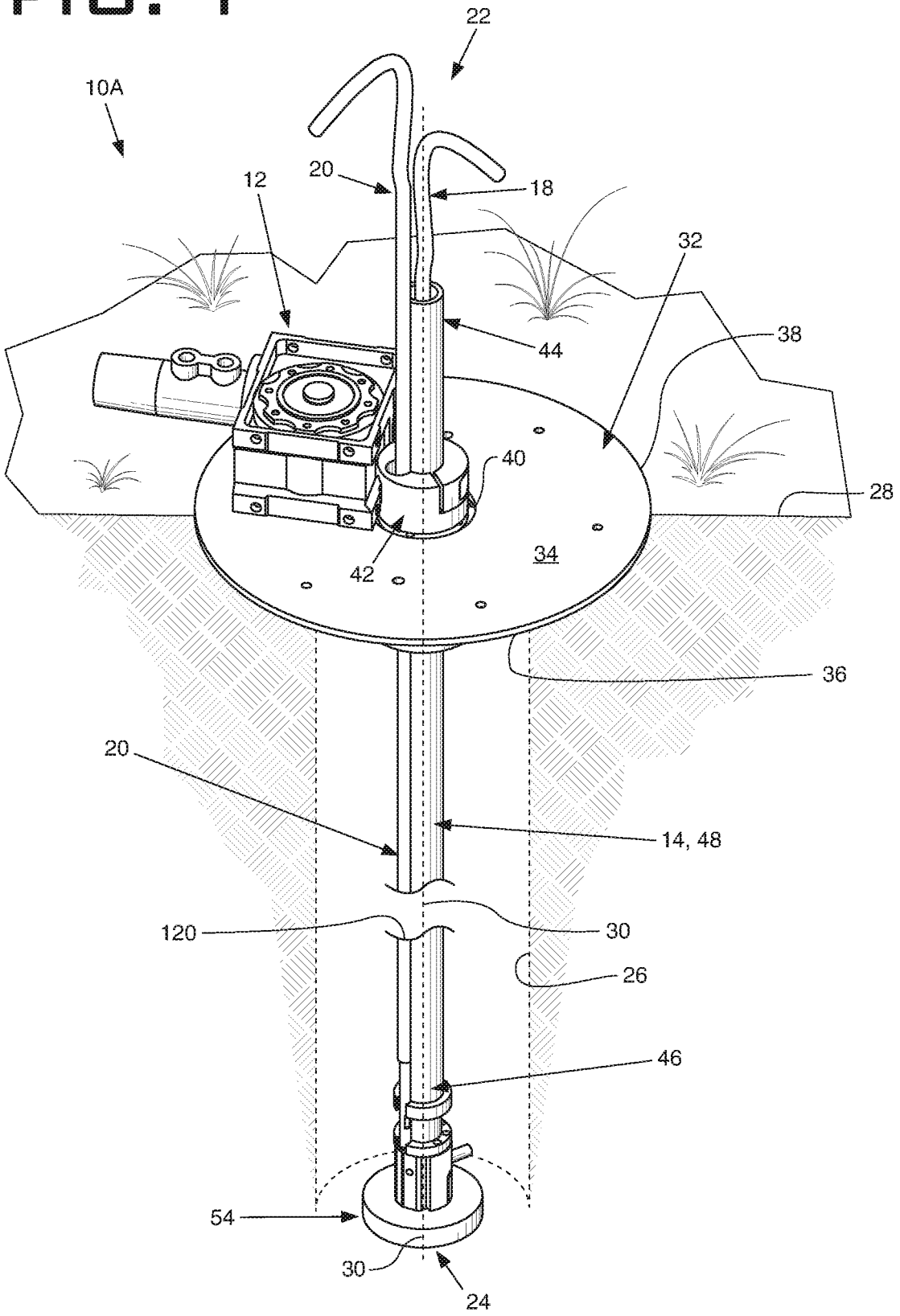
FIG. 1 is a diagrammatic perspective view of a pipe cutting device in accordance with the first embodiment of the present disclosure.

Initially, the Inventor(s)/Applicant note that the present disclosure a Continuation-In-Part Application of U.S. patent application Ser. No. 15/813,551 (the '551 Application), filed Nov. 15, 2017, and a Continuation-In-Part Application of U.S. patent application Ser. No. 15/813,679 (the '679 Application), filed Nov. 15, 2017, the entirety of each is fully incorporated herein as if fully re-written. The present disclosure touches upon additional subject matter to the aforementioned '551 Application and '679 Application, namely, downhole pipe cutting devices and assembly that use ultra-high pressure fluid exiting one or more nozzles towards an inner surface of a pipe to be cut in order to cut through the same. Since this is a continuation-in-part application of the '551 Application and the '679 Application, some similar structural nomenclature is used herein when referencing some portions of the cutting assemblies and their respective operation. However, there may be some instances where structural nomenclature differs between similar elements and there may be other instances where nomenclature is similar between distinct elements relative to this application and the '551 Application and the '679 Application. The terms used in this disclosure apply to this disclosure and may not necessarily apply to other applications or issued patents in this family. Further in this regard, terms used in the specification(s) of the '551 Application and the '679 Application may or may not necessarily apply to this disclosure. Accordingly, to the extent any amendments, characterizations, or other assertions made herein or in the '551 Application and the '679 Application (or any other related patent applications or patents, including any parent, sibling, or child) with respect to any art, prior or otherwise, could be construed as a disclaimer of any subject matter supported by the present disclosure of this application, Inventor(s)/Applicant hereby rescinds and retracts such disclaimer. Inventor(s)/Applicant also respectfully submits that any prior art previously considered in any related patent applications or patents, including any parent, sibling, or child, may need to be re-visited.

A subsurface and downhole pipe cutting device is depicted throughout the present disclosure. A first embodiment of the subsurface downhole pipe cutting device is depicted generally at 10A in FIG. 1-FIG. 10. A second embodiment of a subsurface downhole pipe cutting device is depicted generally at 10B in FIG. 11-FIG. 23. Each embodiment of the pipe cutting device 10A, 10B, includes a motor that revolves an ultrahigh pressure (UHP) hose around a longitudinal axis of the cutting device that is centrally aligned with the pipe intended to be cut below the surface of the ground. Device 10A, 10B additionally provide a UHP cutting device for insertion into a wellbore for cutting the casing (i.e., the tube or the pipe) of the wellbore from within the wellbore.

Each cutting device 10A, 10B includes a motor 12, an elongated hollow support member 14 defining the internal bore 16, an abrasive feed line 18, a UHP hose 20, and a cutting head. The cutting head may vary between the first embodiment cutting device 10A and the second embodiment cutting device 10B and as such will be described in greater detail below with respect to each embodiment 10A, 10B.

As depicted in FIG. 1, cutting device 10A includes an upper end 22 and a lower end 24. Lower end 24 is configured to be inserted into a pipe 26 that is intended to be cut below the surface of ground 28. A longitudinal axis 30 extends from the upper end 22 to the lower end 24 centrally within pipe 26. Additionally, tubular support member 14 extends centrally along longitudinal axis 30 such that the inner bore 16 has an equal radius to all points within the inner surface of support member 14.

Motor 12 is configured to drive a plurality of gears so as to effectuate the revolution of UHP hose 20 around the longitudinal axis 30. In one version, the UHP hose 20 stays in substantially one position and revolves in unison with support member 14 which rotates about the axis 30 (See FIG. 6A and FIG. 7A). In another version, the UHP hose 20 revolves about the axis 30 while wrapping itself around the outside surface of tubular support member 14 (See FIG. 6B and FIG. 76). Hose 20 includes its own axis 31 which is offset from central axis 30. In one embodiment, a portion of the hose axis 31 is parallel to the longitudinal axis 30. In another particular embodiment, the entirety of the hose 20 is offset parallel the longitudinal axis 30.

In one embodiment, motor 12 is positioned above a circular disk or support plate 32 which has a diameter larger than the diameter of pipe 26 that is to be cut. Disk plate 32 includes an upwardly facing top surface 34 spaced apart from a downwardly facing bottom surface 36. A circular edge 38 bounds the top surface 34 and the lower surface 36. The perimeter of circular edge 38 depends on the diameter of disk plate 32; however, in one embodiment, the perimeter is substantially continuous and uninterrupted around the entire disk plate 32. Disk plate 32 may further include an inner circular edge 40 defining a vertical through aperture extending from the first surface 34 to the second surface 36. The central aperture is formed so as to define the disk plate 32 as a substantially annular planar plate. The upper surface 34 of disk plate 32 in between outer edge 38 and inner edge 40 creates a space upon which motor 12 is supported. In one particular embodiment, motor 12 is offset from longitudinal axis 30 so as to be positioned above the top surface 34, disk plate 32 and not intersect the longitudinal axis 30. In one embodiment, motor 12 is a hydraulic motor.

The aperture in disk plate 32 defined by inner edge 40 receives therethrough the tubular support member 14, the abrasive feed line 18, and the UHP hose 20. A collar 42 is operatively connected to motor 12 adjacent the inner edge 40 of disk plate 32. Collar 42 receives UHP hose 20 and tubular support member 14 therethrough. Collar 42 positions UHP hose 20 in an offset manner from longitudinal axis 30 so that no portion of UHP hose 20 intersects or is coaxial with longitudinal axis 30 of cutting device 10A. In one particularly embodiment, collar 42 is fabricated from a substantially rigid material so as to be strong enough to support and carry the load of the tubular support member 14 extending therethrough.

Collar 42 is configured to rigidly secure the supportive member 14 therein. Additionally, the UHP hose 20 is secured in place in an eccentric manner relative to longitudinal axis 30. The eccentric position of the hose 20 refers to the hose 20 not having its axis 31 (i.e., UHP hose axis 31) or other part placed centrally along longitudinal axis 30 Collar 42 is substantially concentric with longitudinal axis 30. Thus, when motor 12 is turned on and in a drive mode, the collar 42 is driven by the motor and rotates about the longitudinal axis 30. Additionally, the tubular support member 14 is also rotated around axis 30. The UHP hose is carried by the collar 42 and positioned outside (and effectively carried by) the supportive member 14 so as to revolve around the longitudinal axis. Note: other embodiments are envisioned in other version in which the UHP hose may wrap around the tubular support member 14 and those alternatives are addressed in FIG. 6B and FIG. 7B (as well as FIG. 9B and FIG. 10B for device 10B).

Tubular support member 14 includes an upper first end 44 and a lower second end 46. Tubular support member 14 includes a rigid cylindrical sidewall 48 extending from the first end 44 to the second end 46. In one embodiment, the cylindrical sidewall 48 is fabricated from metal and is substantially rigid material so as to provide structural integrity to the cutting device 10A when the cutting head is located down within pipe 26 to be cut below the ground surface 28. Cylindrical sidewall 48 includes an outer surface 50 (FIG. 4) and an inner surface 52 (FIG. 4) defining the central bore 16. Along the length of the tubular support member 14, the UHP hose 20 is positioned externally of the outer surface 52 along all points of the tubular support member 14. In another embodiment, there may only be a portion of the UHP hose positioned externally of the outer surface 52 of tubular support member 14. The abrasive feed line 18 is positioned internally within the bore 16 offset from the inner surface 50 of cylindrical sidewall 14 along the longitudinal length of the tubular support member 14. Stated otherwise, a slight gap is formed between abrasive feed line 18 and the inner surface 52 of cylindrical sidewall 48 tubular support member 14. A cutting head 54 is connected with the lower second end 46 of tubular support member 14.

Figure 2:
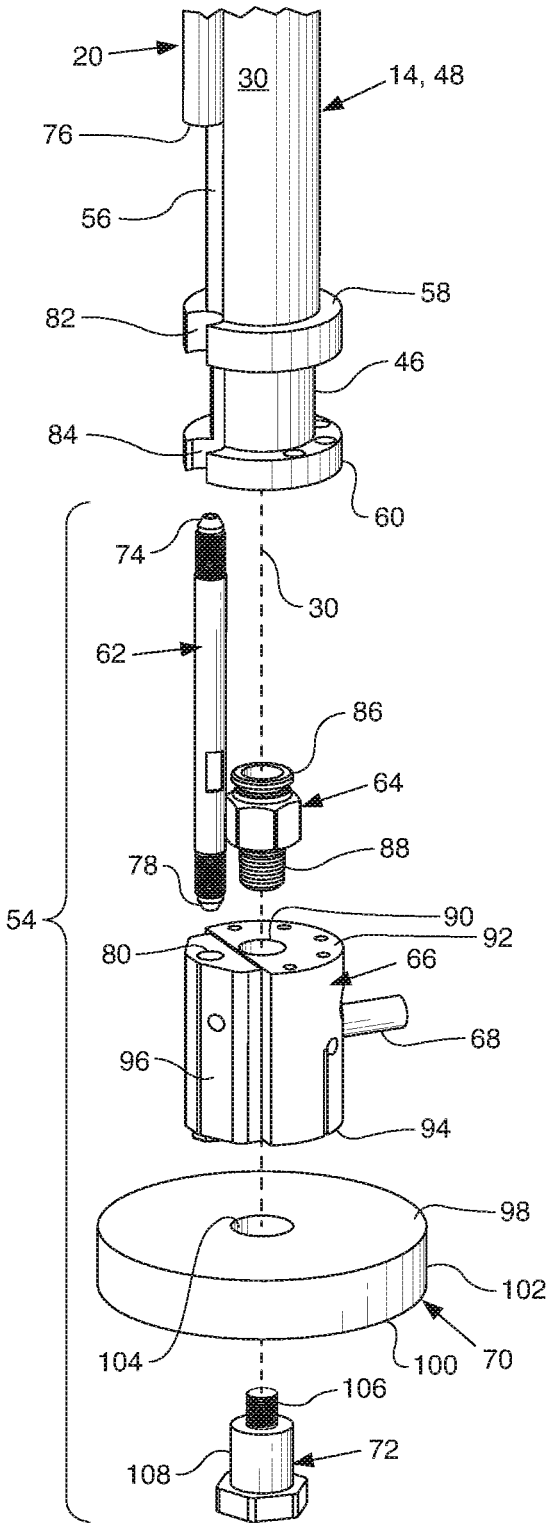
FIG. 2 is an exploded perspective view of a cutting head on the first embodiment cutting device.

FIG. 2 depicts that tubular support member 14 defines a longitudinally extending channel 56 along its outer surface 50. UHP hose 20 may reside within channel 56 along the longitudinal length of tubular support member 14. In one embodiment, channel 56 has an arcuate cross-section complementary to that of the radius of curvature of the exterior surface of UHP hose 20. However, it is understood that channel 56 may have differing cross-sections so as to not be complementary to that of UHP hose 20. Furthermore, tubular support member 14 may not include a channel formed on the outer surface 50 thereof such that UHP hose 20 may be positioned externally to outer surface 50 and freely hang in slight contact or at a slight offset from tubular support member 14. In each instance, commonality is in the fact that the UHP hose 20 revolves around the longitudinal axis 30 and is exterior to the outer surface 50 of tubular support member 14 and not located within the central bore such that no portion of UHP hose 20 is able to rotate about longitudinal axis 30.

A collar 58 and a flange 60 rigidly connected with cylindrical sidewall 48 near lower second end 46. Collar 58 is a substantially annular member extending around the outer surface 50 of cylindrical sidewall 48 and defines an arcuate cutout 82 to define a portion of channel 56. Flange 60 is an annular member extending around the outer surface of cylindrical sidewall 48 and includes an arcuate cutout 84 complementary to that of channel 56. Flange 60 may further include a plurality of through holes extending from the top surface of flange 60 therethrough to the bottom surface of flange 60 eccentric and spaced apart offset from longitudinal axis 30 adapted to receive screws or other fasteners therethrough to connect flange 60 with portions of cutting head 54. While collar 58 and flange 60 are spaced apart from each other in a longitudinal manner, it is contemplated that other embodiments may only include flange 60.

FIG. 2 depicts further components of cutting head 54 that effectuate the cutting of pipe 26 below the ground surface 28 while revolving UHP hose 20 about the longitudinal axis 30 while remaining, at least partially, exterior to outer surface of tubular support member 14. With continued reference to FIG. 2, cutting device 54 located at the lower end 24 of cutting device 10A includes a nipple 62, a threaded couple 64, a rigid body 66, a focus tube 68, an annular plate 70, and a connector 72.

Figure 3:
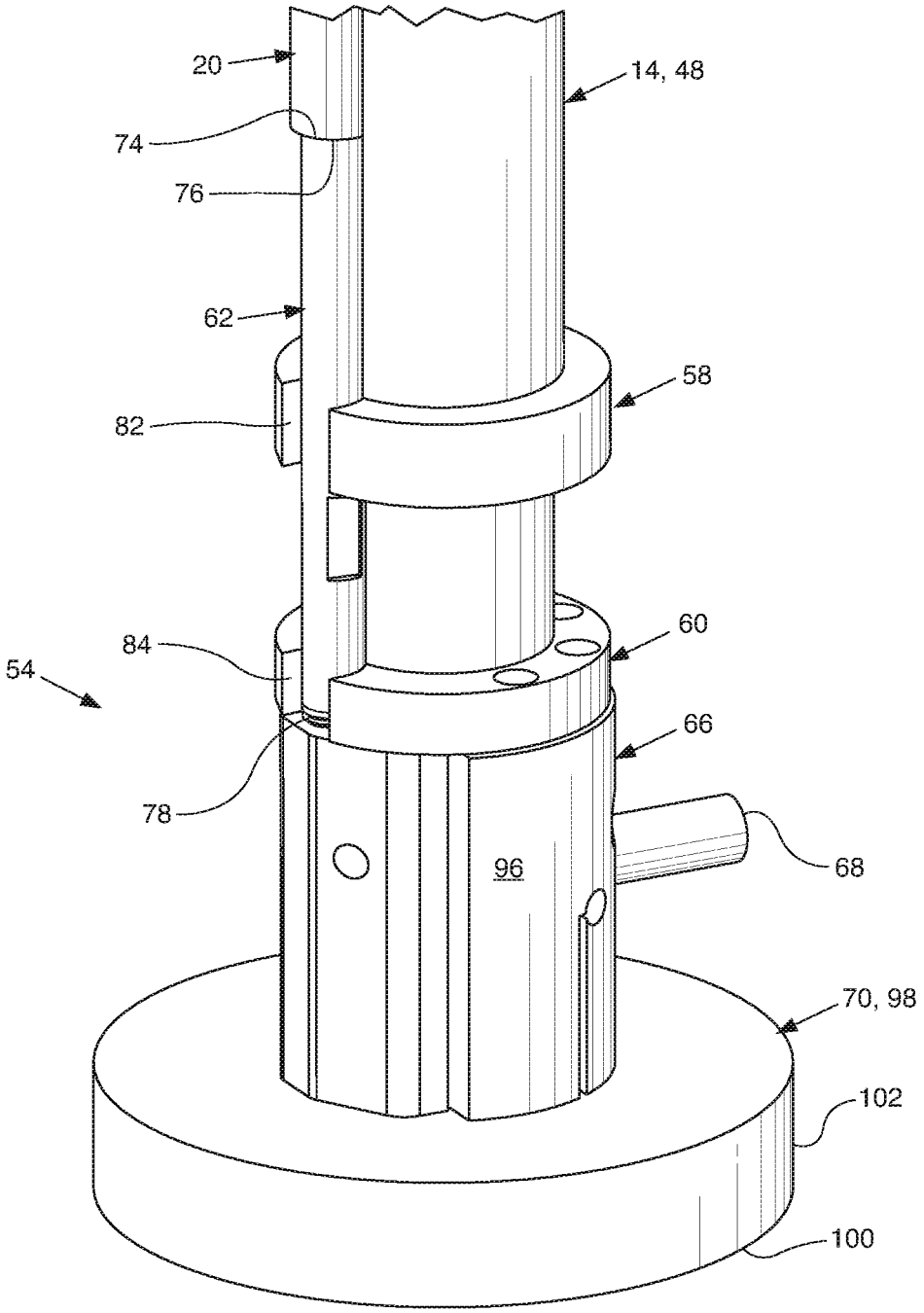
FIG. 3 is an assembled perspective view of the cutting head on the first embodiment cutting device.

As depicted in FIG. 2 and FIG. 3, a first end 74 of nipple 62 threadably connects with a lower terminal end 76 of UHP hose 20. The tubular body of nipple 62 is positioned within the lower end of channel 56 below UHP hose 20. The body of nipple 66 is positioned in the channel so as to extend through the arcuate cutout of collar 58 and the arcuate cutout of flange 60. The lower second end 78 of nipple 62 threadably connects with rigid body 66 at a bore 80 and is vertically aligned but offset from longitudinal axis 30. In one embodiment, the radius of curvature associated with the outer surface of nipple 62 is complementary to that of the arcuate cutout 82 formed and defined by collar 58 which is aligned with channel 56. In this instance, the arcuate cutout 84 formed by flange 60 is complementary to the outer surface of nipple 62. Collar 58 and flange 60 engage and support nipple 62 so as to brace the same against forces of the UHP tube as it revolves about longitudinal axis 30 during the cutting of pipe 26 below ground 28.

Threaded couple 64 is rigid a hollow body member including threads at both ends that define a bore therethrough and is substantially centered about longitudinal axis 30. Threaded couple 64 extends into the bore 16 adjacent the lower end 46 of cylindrical sidewall 48 on tubular support member 14. Threaded couple 64 is coaxial and aligned with longitudinal axis 30 and fluidly couples with the abrasive feed line 18 within the bore 16. In one embodiment, portions of the threaded couple 64 may engage inner surface 52 of tubular support member 14. A threaded upper end 86 of threaded couple 64 may threadably connect with the lower end of feed line 18. However, other connections are entirely possible. The lower threaded end 88 of threaded couple 64 threadably couples with a central hole 90 on rigid body 66. Central hole 90 is aligned coaxial with longitudinal axis 30. This effectively enables abrasive feed line 18 to be coaxial along the length of longitudinal axis 30. Stated otherwise, abrasive feed line 18 is not offset from longitudinal axis 30.

Rigid body 66 includes an annular top surface 92 and a bottom surface 94. A generally cylindrical sidewall 96 extends between the top surface 92 and the bottom surface 94. Focus tube 66 is oriented perpendicular to longitudinal axis 30 so as to extend through an aperture formed in and extending through the cylindrical sidewall 96 of rigid body 66. Annular plate 70 includes an annular top surface 98 spaced apart from an annular bottom surface 100 and a cylindrical sidewall 102 extending therebetween. The annular top surface 98 contacts the bottom surface 94 of rigid body 96. In one embodiment, a central aperture 102 extending from the bottom surface 100 to the top surface 98 of annular plate 70 is aligned coaxial and centered with longitudinal axis 30. The diameter of annular plate 70 is larger than that of rigid body 66. However, the vertically aligned thickness or height of annular plate 70 is less than that of rigid body 66. Annular plate 70 may be utilized in some embodiment to center the cutting head within the pipe 26 to be cut. Aperture 104 receives fastener 72 therethrough which includes a threaded top end 106 to threadably connect with rigid body 66. Fastener 72 includes a stepped out portion 108 which has a similar diameter to that of aperture 104 formed in annular plate 70. Fastener 72 extends along the longitudinal axis 30 and intersects the same and includes an enlarged head having a diameter greater than the diameter of aperture 104 preventing the fastener 72 from passing therethrough. The enlarged head of fastener 72 is positioned outwardly and below the lower second surface 100 of annular plate 70. While not shown, it is entirely possible for a second annular or circular plate to be attached to the rigid body 66 above the focus tube 68. In one instance, the second plate connects with a bracket located near the bottom end of the tubular support member 14. Both annular plates cooperate to center the device within the pipe to be cut, which is helpful in the event the tubular support member 14 ever is bent.

Focus tube 68 is positioned intermediate the top surface 92 and the bottom surface 94 of rigid body 66. In one embodiment, focus tube 68 is located approximately midway between the top surface 92 and the bottom surface 94. However, other vertical positions of the focus tube 68 relative to the rigid body 66 are envisioned. Focus tube 68 includes a portion thereof that is embedded within rigid body 66 and retained at a shoulder. Additionally, focus tube 68 includes a portion that extends outwardly in a cantilevered manner from a rigid connection with the cylindrical sidewall 96 of rigid body 66. In another embodiment, the focus tube 68 extends outwardly in a cantilevered manner from the rigid body 66. However, in this alternative example, there is no rigid connection established therebetween so as to enable the focus tube to slideably fit and move in a transverse direction relative to rigid body 66. This may effectuate the adjustment of focus tube 68 so as to enable the offset from the pipe 26 to be cut to be optimized. Optimizing the offset depends on the pressure within UHP hose 20 and feed line 18. Fluid pressure exiting the focus tube 68 is what cuts pipe 26. In one embodiment, the length of focus tube 68, particularly the exposed portion of focus tube 68 that is not embedded within rigid body 66, has a transversely aligned length that is less than the radius of plate 70 relative to axis 30. In other embodiments, the focus tube 68 may have a transversely aligned length that is greater than the diameter of plate 70 such that the outermost end of focus tube 68 is the widest portion of the cutting head 54. Alternatively, the diameter of plate 70 may have the largest outer diameter of cutting head 54 as shown on FIG. 2. and FIG. 3.

Figure 4:
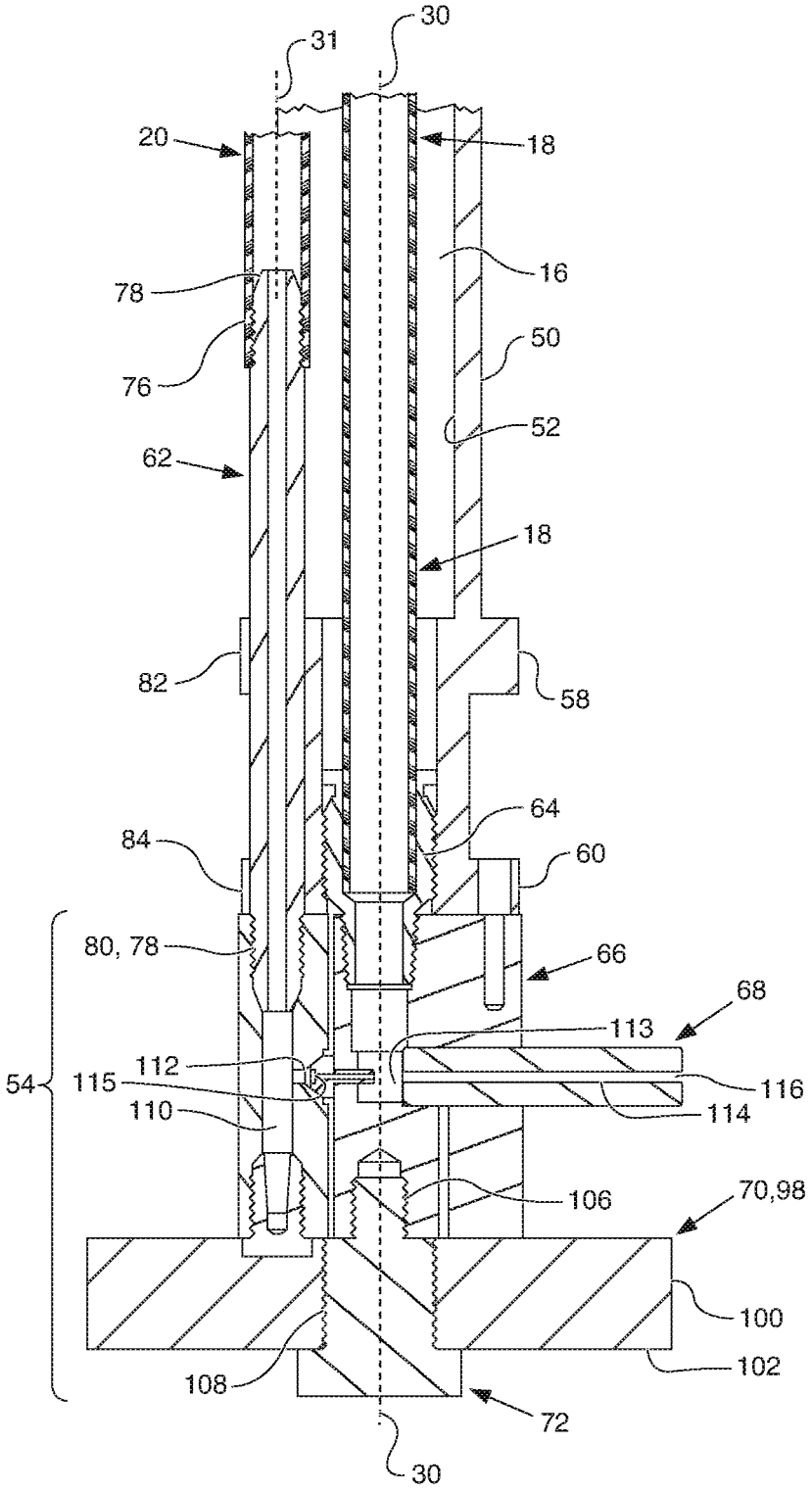
FIG. 4 is an elevational cross-section view of the cutting head on the first embodiment cutting device.

FIG. 4 depicts an assembled cross-section of the cutting device and the lower end 46 of tubular support member 14. When assembled, the UHP hose 20, the nipple 62, and the rigid body 66 define a conduit for which UHP fluid can flow through the UHP hose 20, then through the nipple 62 then into a vertically aligned bore 110 in operative communication with nipple 62. Bore 110 is vertically aligned and offset from longitudinal axis 30. A lower region of bore 110 may act as a well to trap some portions of fluid moving through hose 20. An outlet 112 to bore 110 is aligned perpendicularly (i.e., transverse) thereto and in fluid communication with the bore 114 defined by focus tube 68. The outlet 112 is positioned above the bottom of bore 110 acting as a well. The outlet 112 is defined by a jewel or gem 115, sometime diamond or sapphire, which is able to withstand the immense pressure of the fluid moving through the outlet 112. When UHP fluid flowing through UHP hose 20, nipple 62, and bore 110 exits outlet 112 into bore 114 of focus tube 68. UHP fluid intersects the longitudinal axis 30 in a perpendicular manner. Stated otherwise, UHP fluid never flows coaxial the longitudinal axis 30. The UHP fluid movement is offset parallel to longitudinal axis 30, and the only time UHP fluid intersects longitudinal axis 30, it is in a perpendicular manner when in the focus tube 68.

With continued reference to FIG. 4, the abrasive feed line 18 extends coaxial with longitudinal axis 30 such that a significant portion of the flow of abrasive fluid moving along feed line 18 is coaxial with longitudinal axis until the abrasive fluid flows through threaded couple 64 and into the bore 114 so as to mix with the UHP fluid in the focus tube 68 in a mixing region which acts a venturi region 113. The venturi mixing region 113 enables the high pressure fluid to pull the abrasive down along line 18 and outwardly through bore 114. Thereafter the mixed UHP fluid and abrasive fluid exit the bore 114 of the focus tube 68 at outlet 116.

Mixture of the UHP fluid and the abrasive fluid exiting the bore have a sufficiently high pressure and abrasion combination so as to effectuate a cut to the pipe 26. In one embodiment, the pressure may exceed 40,000 psi so as to be suitable for cutting both cement and stainless steel pipes 26. The pressure may be controlled by computer module that can be supplied with the device 10A, 10B. The computer module may further include at least one non-transitory computer readable storage medium having instructions encoded thereon that when executed by one or more processors inside the computer module, implement operations to effectuate the cutting of the pipe 26 by revolving UHP hose 20 around the outside of tubular support member 14. The operations may include driving the motor 12 as determined by the set of instructions at a desired speed or revolution. The operations may further include revolving the UHP hose around the outside of the tubular support member 14 in a manner determined by the instructions contained on the at least one non-transitory computer readable storage medium. Operations may further include effectuating cutting the pipe 26 through the combination of UHP fluid and abrasive fluid exiting the focus tube 68 at a pressure and speed determined by the instructions encoded on the at least one non-transitory computer readable storage medium.

FIG. 5-FIG. 10 depict varying operational views of device 10A having cutting head 54 attached to the lower end 24 thereof. The cutting device 10A effectuates the cutting of pipe 26 along a cut line 118. When the pipe 26 is cut along cut line 118, it is severed into two sections. An upper section of pipe 26A may be removed from the ground 28 and the lower section of pipe 26B may remain subsurface or below the ground surface 28 and can be capped in order to seal the pipe 26 safely within the ground. The cutter head 54 uses a combination of abrasive fluid and ultrahigh pressure liquid to effectuate the cut of pipe 26 along cut line 118.

Figure 5:
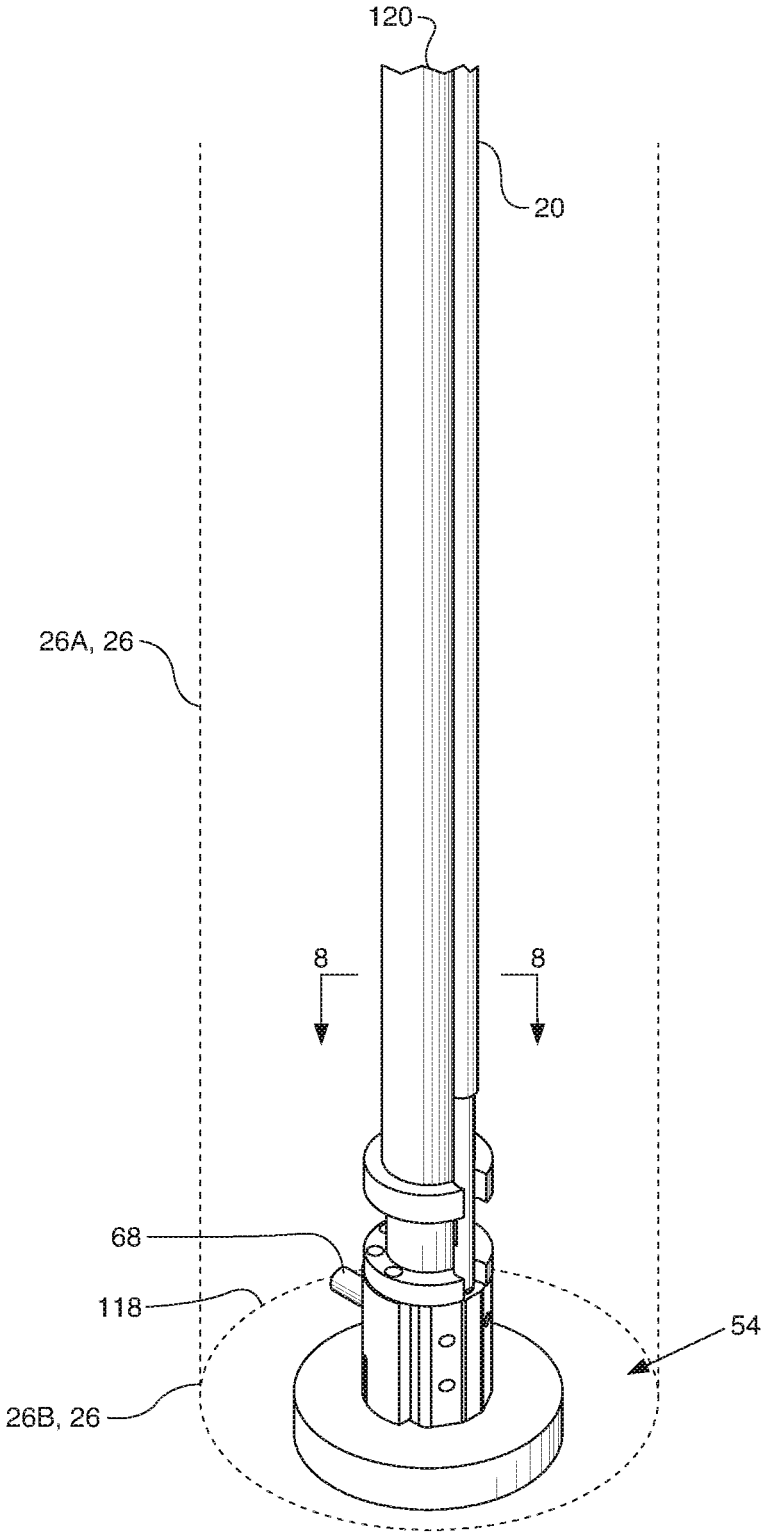
FIG. 5 is an operational perspective view of the first embodiment cutting device located in a pipe positioned at a first position.
Figure 8:
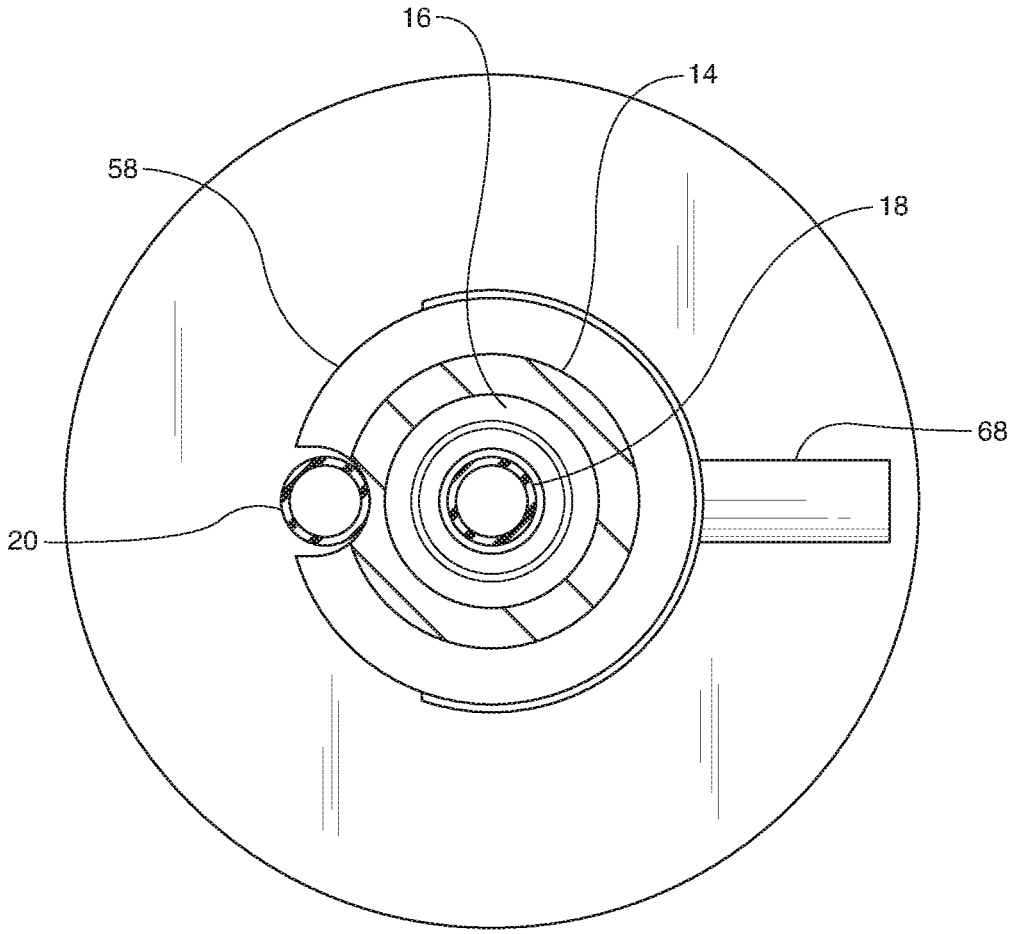
FIG. 8 is a cross-section taken along line 8-8 in FIG. 5.

FIG. 5 and FIG. 8 depict the cutting head 54 in a first position, which may also be referred to as a home position or a neutral position or a first position or a starting position (or something to a similar effect). The focus tube 68 is near the inner surface of pipe 26 and is offset a close distance from the inner surface of pipe surface 26 where the cut line 118 is to be established. Typically the cut line 118 is located in a range from about 4 feet to about 8 feet below ground surface 28. However, other distances are entirely possible. In order to establish the distance that the cut line 118 is below the ground surface depends on the length of the tubular support member 14. Thus, if the cut line 118 needs to be deeper below the ground surface 28, a longer tubular support member 14 can be utilized. Thus, as seen in FIG. 1, symbolic break lines 120 are depicted so as to not limit the length of tubular support member 14 insofar as it may vary depending upon the required depth of the pipe to be cut at cut line 118.

With continued reference to FIG. 5 and FIG. 8, when the cutting head 54 is in the home position, abrasive fluid may be fed through feed line 18 and ultrahigh pressure liquid may be fed through UHP hose 20. The mixture of abrasive fluid and UHP liquid or fluid occurs inside rigid body as depicted in FIG. 4. The combination of the mixed UHP fluid and abrasive material exists the outlet 116 on focus tube 68 and directed towards the inner surface of pipe 26 at cut line 118. As the fluid begins to contact and cut pipe 26 at cut line 118, the motor 12 effectuates the revolution of UHP hose 20 around the longitudinal axis 30. This in turn causes the focus tube 68 to move around the inner surface pipe 26 along cut line 118.

Figure 6A:
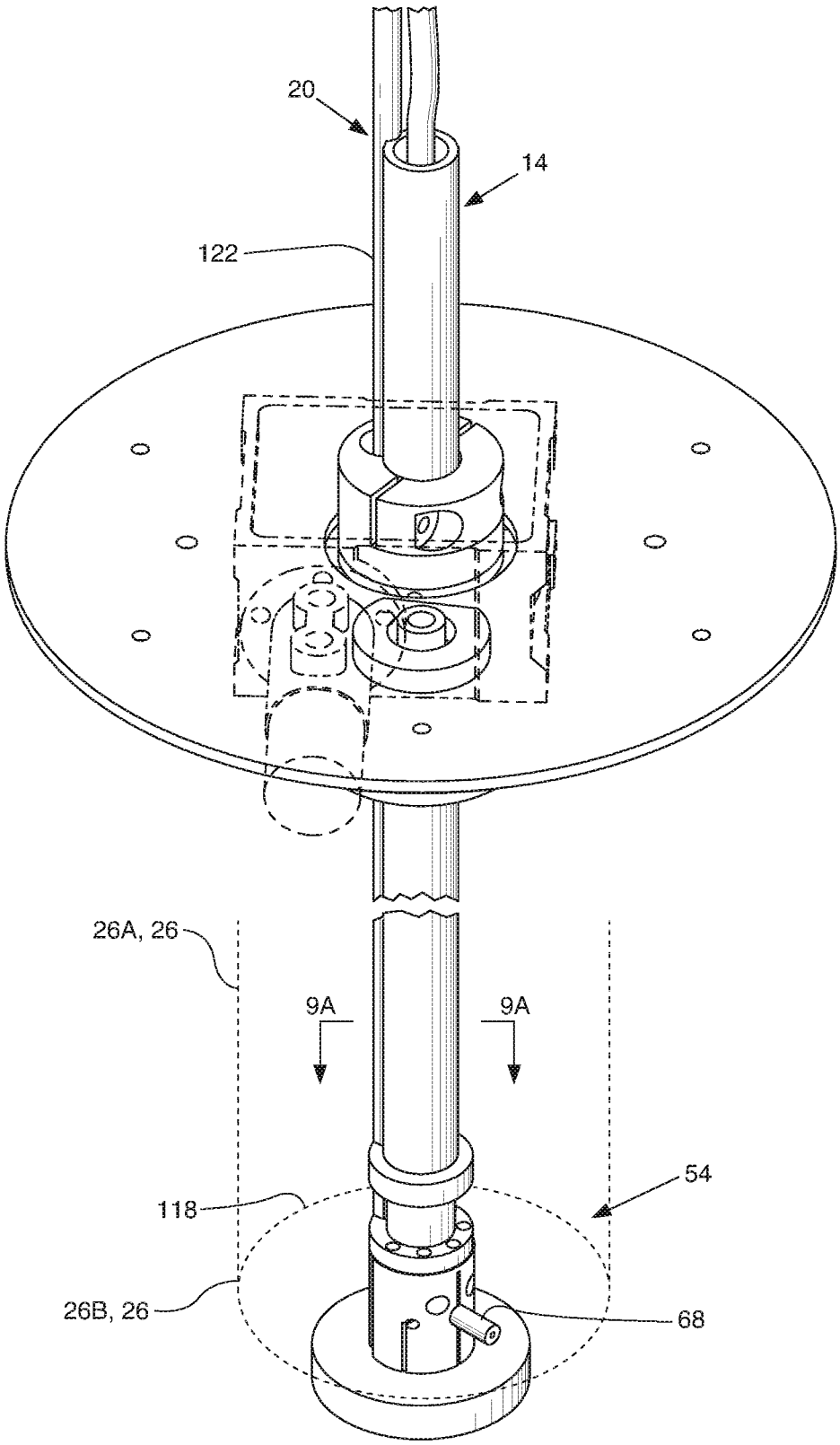
FIG. 6A is an operational perspective view of the first embodiment cutting device in a second position rotated 180° from the first position with a high pressure tube extending along the side of a support tube.
Figure 9A:
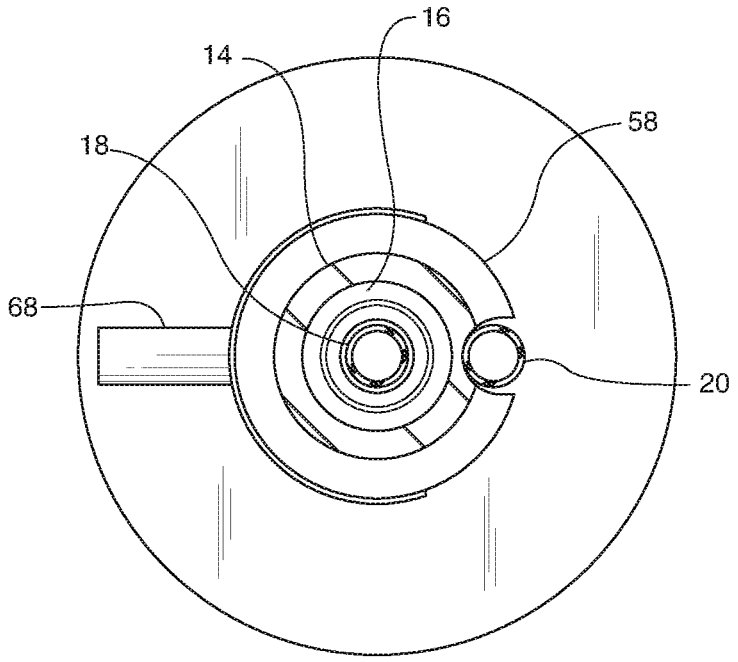
FIG. 9A is a cross-section taken along line 9A-9A in FIG. 6A.

FIG. 6A and FIG. 9A depict a one-half revolution of UHP hose 20. Stated otherwise, the UHP hose 20 has revolved about 180° or half way wrapped around the longitudinal axis 30. In this half-revolution position, cut line 118 extending through pipe 26 would have an approximate radius of curvature of about 180°. Near the half way position, revolution of UHP hose 20 remains substantially straight and elongated relative to tubular support member 14. The fixed collar 42 effectuates the substantial stationary relative position of the hose 20 to the support member 14. During the rotation of tubular support member 14, the UHP hose 20 remains within the channel 56 defined by the outer surface 50 of cylindrical sidewall 48 on tubular support member 14. Thus, in one instance, the arcuate curvature of channel 56 may include large enough sidewalls to stabilize the UHP hose 20 to remain the channel during the revolution of the hose 20 around axis 30 when the device 10A is cutting the tube 26 along cut line 28.

Figure 6B:
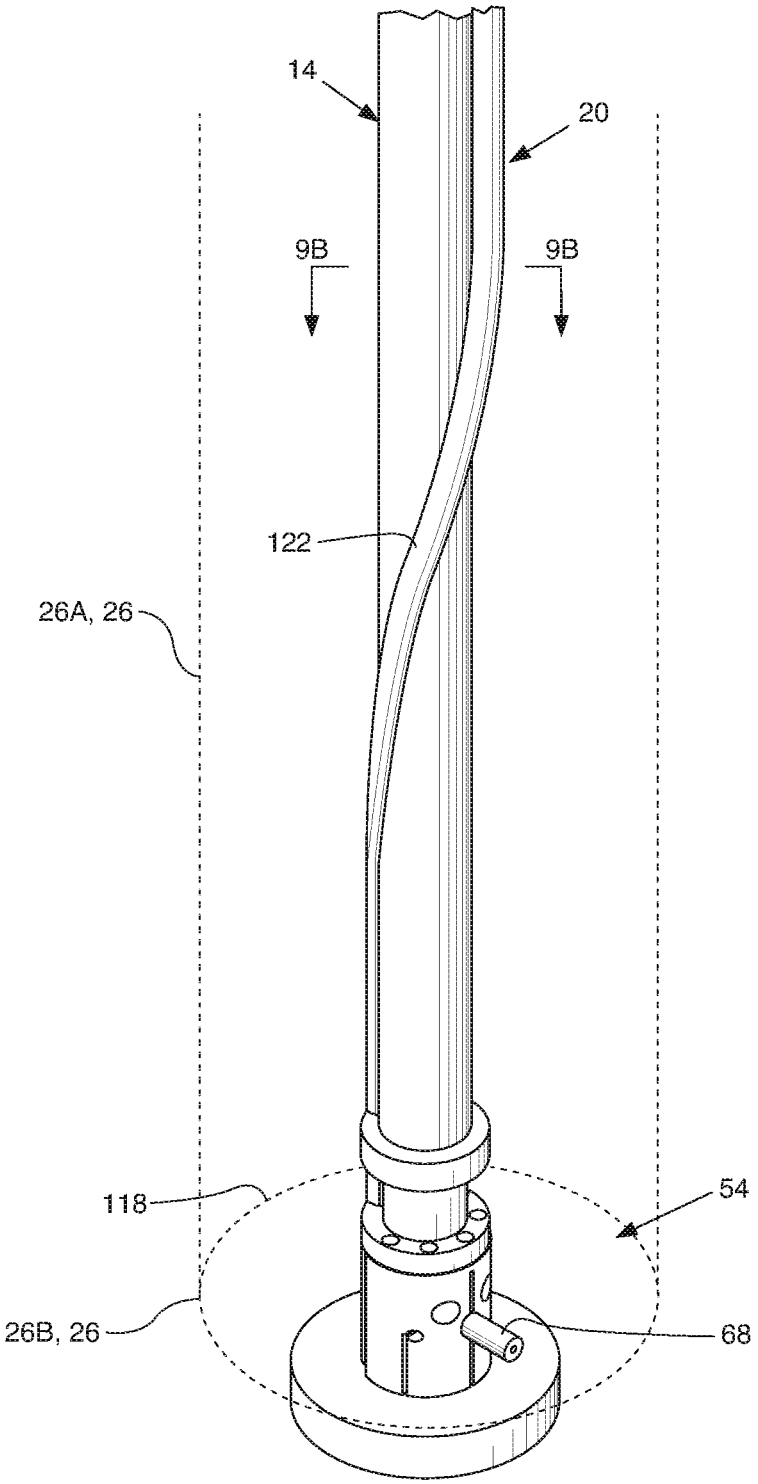
FIG. 6B is an operational perspective view of the first embodiment cutting device in a second position rotated 180° from the first position having a high pressure tube wrapped around a portion of device (i.e., the support member).
Figure 9B:
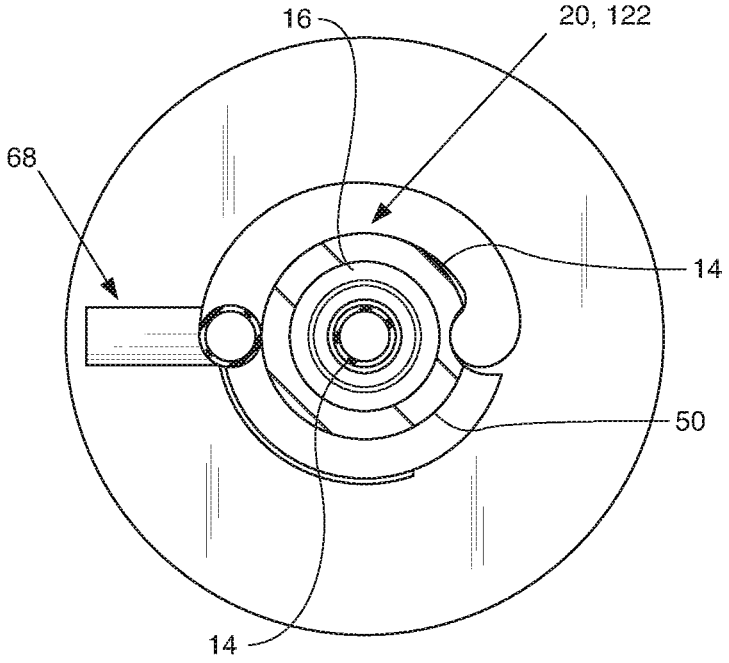
FIG. 9B is a cross-section taken along line 9B-9B in FIG. 6B.

FIG. 6B and FIG. 9B depict an alternative version that may include different components but would also operate within the scope of the present disclosure utilizing a one-half revolution of UHP hose 20. Stated otherwise, in this alternative version the UHP hose 20 has revolved about 180° to be partially or half way wrapped around the tubular support member 14. In this half-wrapped position, cut line 118 extending through pipe 26 would have an approximate radius of curvature of about 180°. Near the half way position, revolution of UHP hose 20 approximates 180° about the outer surface of tubular support member 14. During the revolution of UHP hose 20, the UHP hose 20 may exit the channel 56 defined by the outer surface 50 of cylindrical sidewall 48 on tubular support member 14. Thus, in this instance, the arcuate curvature of channel 56 may include shallow sidewalls to encourage and enable the UHP hose 20 to leave the channel during the revolution of the same when the device 10A is cutting the tube 26 along cut line 28. More particularly shown at FIG. 9, the one-half revolution or the one-half wrap of UHP hose 20 around the outer surface 50 of cylindrical sidewall 48 is depicted generally at 122.

Figure 7A:
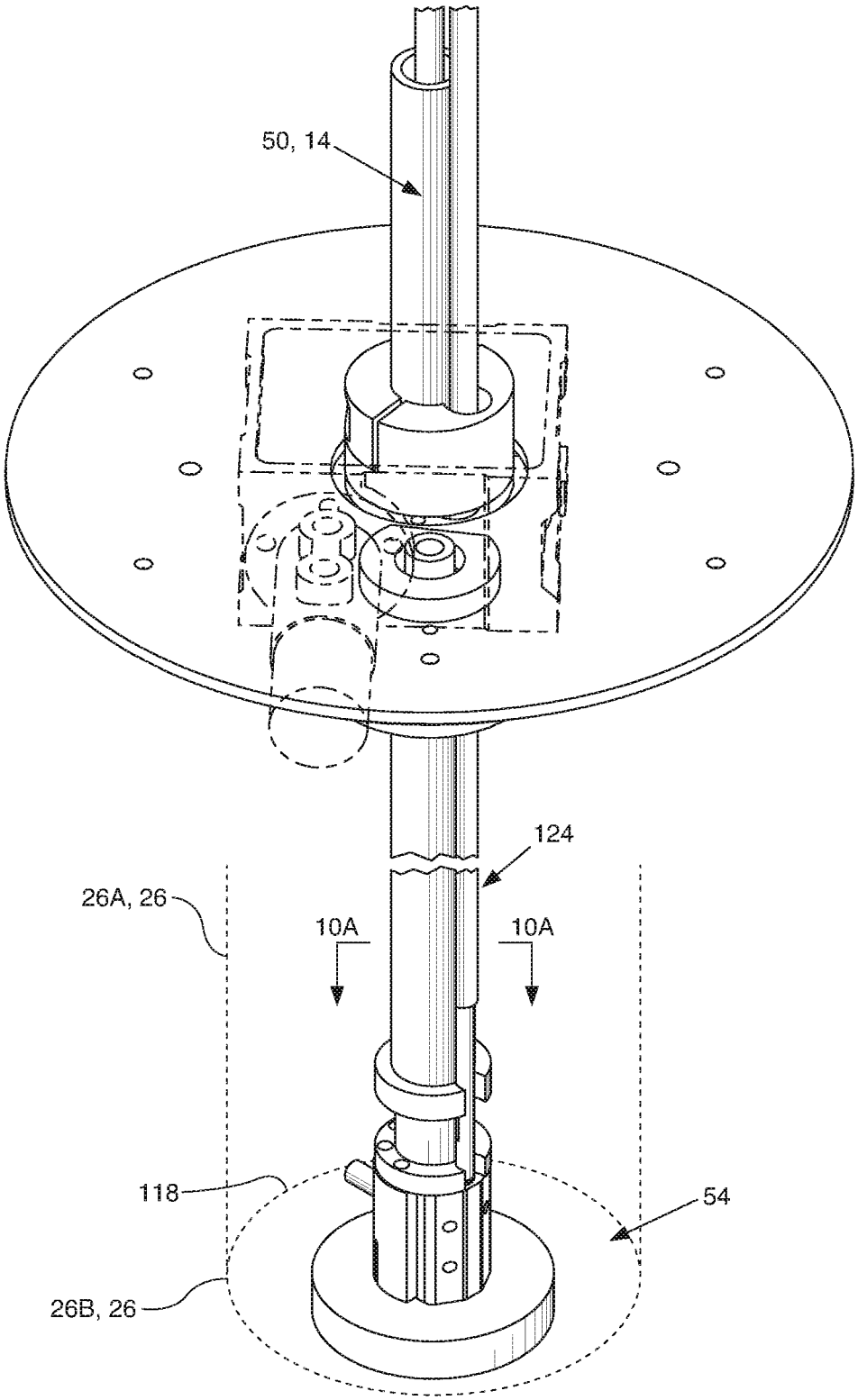
FIG. 7A is an operational perspective view of the first embodiment cutting device having been rotated 360° with the high pressure tube extending along the side of a support member.
Figure 10A:
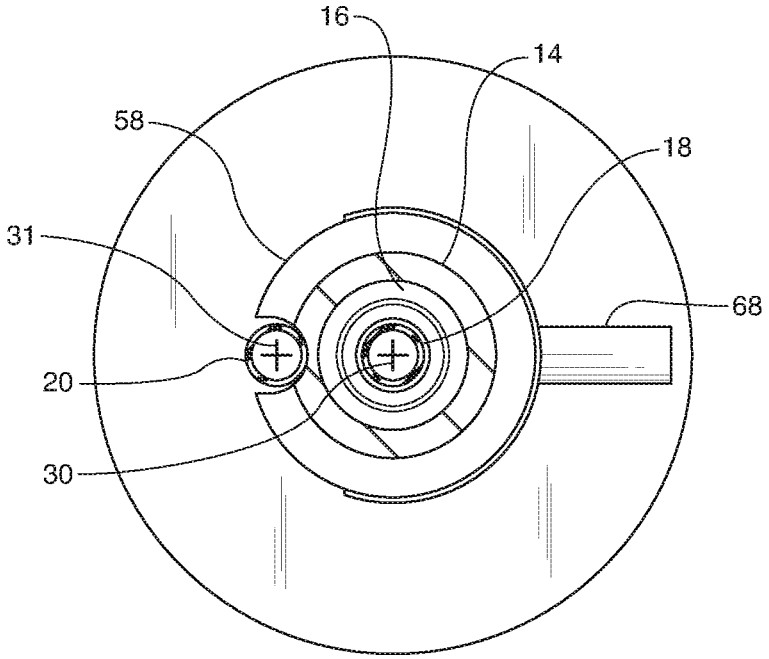
FIG. 10A is a cross-section taken along line 10A-10A in FIG. 7A.

As depicted in FIG. 7A and FIG. 10A, the motor 12 may continue to revolve the UHP hose 20 around longitudinal axis 30 by remaining in a fixed relative position to tubular support member 14 so as to complete a 360° revolution of the UHP hose 20 around axis 30 while tubular support member 14 is rotating. This effectuates a full 360° cut of cut line 118 of pipe 26. When the full revolution 124 of hose 20 has occurred around the longitudinal axis 30 carried by tubular support member 14, still no portion of the UHP hose 20 intersects the longitudinal axis 30 of device 10A.

Figure 7B:
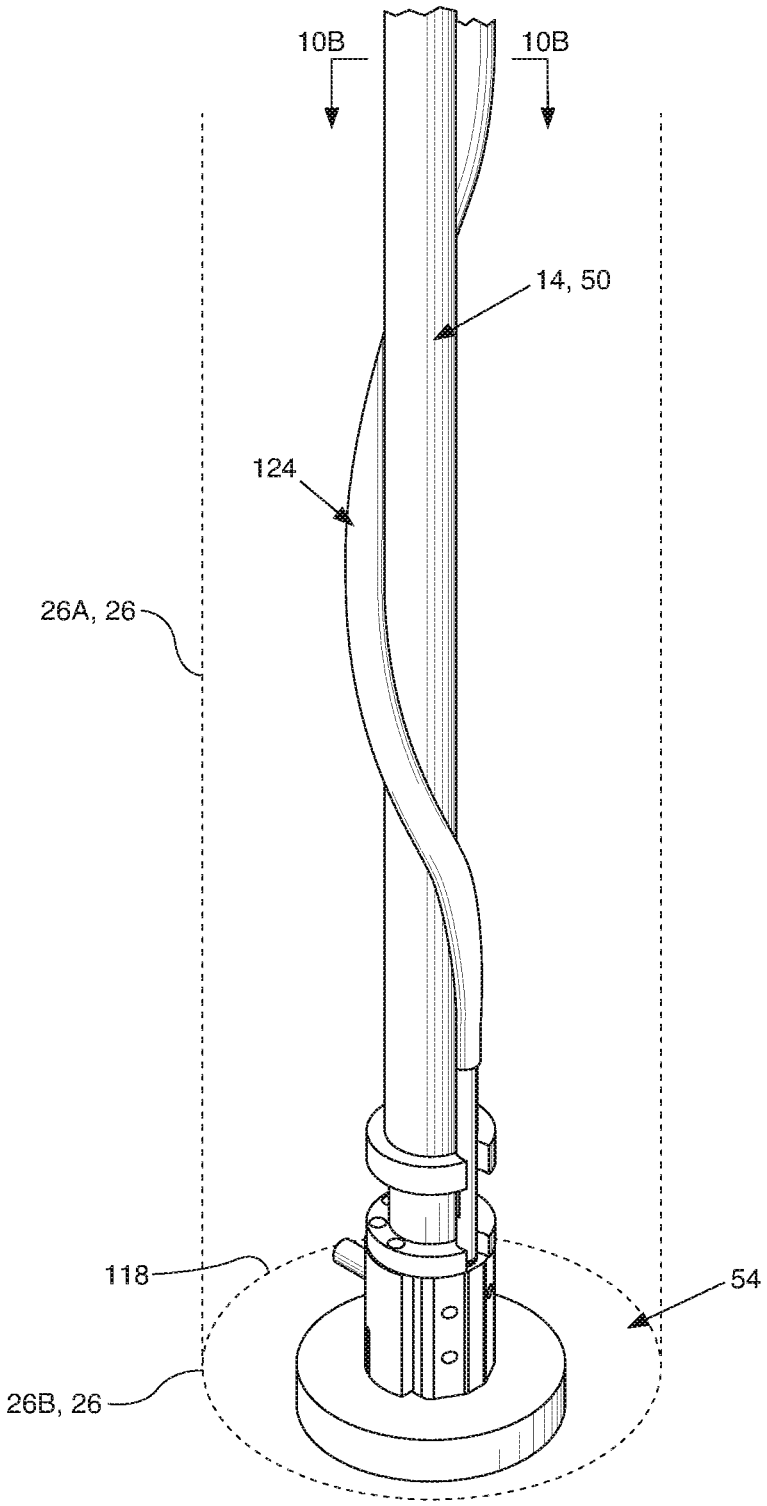
FIG. 7B is an operational perspective view of the first embodiment cutting device having been rotated 360° with the high pressure tube wrapped around the support member.
Figure 10B:
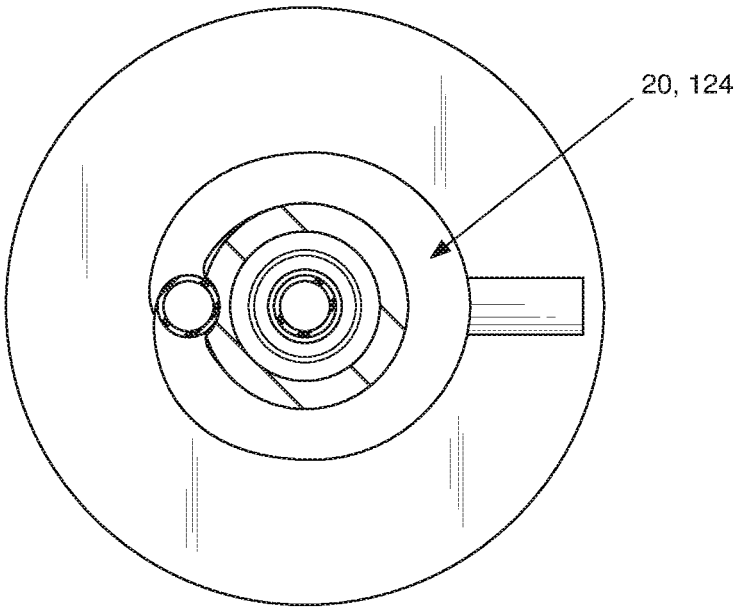
FIG. 10B is a cross-section taken along line 10B-10B in FIG. 7B.

As depicted in FIG. 7B and FIG. 10B (which correspond to the alternative version of FIG. 6B and FIG. 96), the motor 12 may continue to revolve the UHP hose 20 around the outer surface 50 of tubular support member 14 so as to complete a 360° revolution of the UHP hose 20 around tubular support member 14. This effectuates a full 360° cut of cut line 118 of pipe 26. The 360° wrap or the full revolution wrap of hose 20 is indicated generally at 124. When the full revolution 124 of hose 20 has wrapped around the outer surface 50 of tubular support member 14, still no portion of the UHP hose 20 intersects the longitudinal axis 30 of device 10A.

With continued reference to FIG. 5-FIG. 10, a method of use for the cutting device 10A may include a method of cutting a pipe, such as pipe 26, comprising the steps of inserting a distal and (the second end 24) of a pipe cutting device, such as device 10A, 10B, into a pipe 26 wherein the cutting head 54 is located near the distal end 24. Thereafter revolving the UHP tube or hose 20 around the longitudinal axis 30 while remaining exterior to outer surface 50 of a tubular support member 14 carrying the cutting head while the cutting head moves about a longitudinal axis 30 of the device 10A, 10B wherein the UHP hose 20 does not rotate about axis 30. The step of revolving the UHP hose 20 around the outer surface of the tubular support member 14 occurs simultaneous to the pressurized fluid flowing along the UHP hose 20 parallel to longitudinal axis 30. Stated otherwise, as the UHP hose 20 revolves around axis 30, no portion of the fluid flow moving therethrough is coaxial to longitudinal axis 30. The fluid exits UHP hose 20 near the second end 76 and enters nibble 62. Thereafter, the UHP fluid moves through the vertically aligned bore of nipple 62 in a manner that is parallel and offset to longitudinal axis 30. The UHP fluid then enters bore 110 which is vertically aligned and coaxial with that of nipple 62. The UHP fluid exits the bore 110 in cutting head 54 through a transversely aligned outlet 112 that is offset from longitudinal axis 30. The UHP fluid exits the outlet 112 and crosses the longitudinal axis in a perpendicular manner. Near longitudinal axis 30, the abrasive fluid flowing through feedline 18 is mixed within the bore 114 that is transversely aligned perpendicular to axis 30. Thereafter, the combined and mixed abrasive fluid and ultra-high pressure fluid exits bore 114 at outlet 116 and is directed towards the inner surface of pipe 26 which is intended to be cut along cut line 118. The ultra-high pressure fluid and abrasive fluid mixture is able to cut through the pipe regardless of the pipe material construction, which is typical concrete or metal.

With continued reference to the method of operation of device 10A (as well as device 10B), a method of operating the pipe cutting device 10A, 10B may include inserting a cutting head 54 (or cutting head 126 infra) carried by an elongated support member 14 into the pipe 26; revolving the UHP hose 20 around the elongated support member 14 while UHP fluid moves through the UHP hose 20; and cutting the pipe 26 with UHP fluid exiting the cutting head, such as the focus tube. This embodiment or another embodiment of the method may provide wherein revolving the UHP hose 20 around the elongated support member 14 further comprises positioning the UHP hose 20 exterior to the outer surface 50 of the elongated support member 14. This embodiment or another embodiment may provide wherein revolving the UHP hose 20 around the elongated support member 14 further comprises: positioning the UHP hose 20 in the channel 56 formed by the outer surface 50 of the elongated support member 14 when the cutting device is in a neutral or home position; and effecting the UHP hose 20 to exit the channel 56 as the UHP hose revolves around the outer surface 50 of the elongated support member 14. Alternatively, an embodiment may provide effecting the UHP hose 20 to remain in the channel 56 as the UHP hose 20 revolves around the longitudinal axis 30 exterior to outer surface 50 of the elongated support member 14. This embodiment or another embodiment may provide wherein revolving the UHP hose 20 around the elongated support member 14 further comprises completing at least a one-half revolution of the UHP hose 20 around the longitudinal axis 30 exterior to the elongated support member 14 in a first direction. This embodiment or another embodiment may provide wherein revolving the UHP hose exterior to the tubular support member further comprises completing at least one full revolution of the UHP hose 20 around the longitudinal axis 30 exterior to elongated support member 14 in the first direction, for example the clockwise direction. This embodiment or another embodiment may provide wherein subsequent to completing the one-half revolution of the UHP hose 20 around the elongated support member in the first direction, further includes completing a second one-half revolution of the UHP hose 20 around the axis 30 exterior to the elongated support member 14 in an opposite second direction, such as counter-clockwise. This embodiment or another embodiment may provide flowing UHP fluid offset parallel to a central longitudinal axis 30. This embodiment or another embodiment may provide preventing UHP fluid from ever flowing coaxial with the longitudinal axis 30. This embodiment or another embodiment may provide moving the UHP hose 20 eccentrically during revolution around the longitudinal axis 30.

The method may additionally provide revolving the UHP hose 20 from a home first position to a wrapped second position, wherein the UHP hose does not rotate about the longitudinal axis 30 during the revolution thereof around the longitudinal axis 30 from the first position to the second position. This embodiment or another embodiment may provide coupling an end of the UHP hose 20 with a first inlet of the cutting head offset from the longitudinal axis. This embodiment or another embodiment may provide feeding an abrasive substance centrally along the longitudinal axis in an abrasive feed line 18. This embodiment or another embodiment may provide wherein the elongated member 14 is tubular or cylindrically hollow in shape including an inner surface 52 defining the bore 16, and the abrasive feed line 18 is disposed within the bore having a narrower diameter than the bore. This embodiment or another embodiment may provide mixing the abrasive substance with UHP fluid near a focus tube on the cutting head to create a cutting mixture; directing the cutting mixture towards an inner surface of the pipe 26 at cut line 108. This embodiment or another embodiment may provide wherein the first inlet on the cutting device receiving UHP fluid therethrough is spaced from the longitudinal axis, and the second inlet receiving abrasive therethrough is co-axial with the longitudinal axis.

For the methods of use detailed in FIG. 6B and FIG. 9B (as well as FIG. 16B and FIG. 19B introduced below), this embodiment or another embodiment may provide wrapping the UHP hose at least 180° around the outer surface 50 of the elongated member 14. This embodiment or another embodiment may provide wrapping the UHP hose about 360° around the outer surface of the elongated member in the wrapped second position. With continued reference to this version utilizing the wrapping of hose 20, subsequent to the steps of cutting pipe 26, entire device 10A may be removed from pipe 26. After removing the device 10A, which is still in the fully wrapped position 124, the device 10A may be unwound so as to return the UHP hose 20 back to the home position. Alternatively, the unwinding of UHP hose 20 from the wrapped position 124 back to the home position may occur within the tube 26 prior to the removable of device 10A from tube 26. In this instance, after the cut has been made, the device 10A may be unwound so as to return to the home position and the device 10A removed from the pipe 26 in the home position.

For the version of the device depicted in FIG. 6A and FIG. 9A, subsequent to the steps of cutting pipe 26, entire device 10A may be removed from pipe 26. The hose 20 will remain inside channel 56 during the removal of the device from pipe 26. After the device 10A has been removed from the pipe 26, a machine may be positioned above the ground surface near the top end of the first section 26A of pipe 26 and can be rigidly connected thereto. Connection of the machine (not shown) to pipe 26A is used to extract the top section 26A from the ground. In one scenario, there is no need to dig into the ground near the surrounding areas of the top section 26A of pipe 26. However, it is contemplated that to assist the removal of top section 26A, an excavator or shovel may be used to dig away portions of the earth or the ground to ease the removal of top section 26A. The bottom section 26B which remains in the ground may be capped to completely seal off pipe 26 below the ground surface. Capping of lower section 26B of pipe 26 may be done with a plug or other cap device that effectuates a permanent seal therewith. Permanent seal of the cap to the lower section 26B may be welded or permanently adhered or connected in other known manners. Thereafter the space above the capped section of pipe 26B, which was previously occupied by the top section 26A, may be backfilled with earthen material. The ground may be leveled so as to leave no visible signs of the underground capped section of pipe 26B above the ground.

Figure 11:
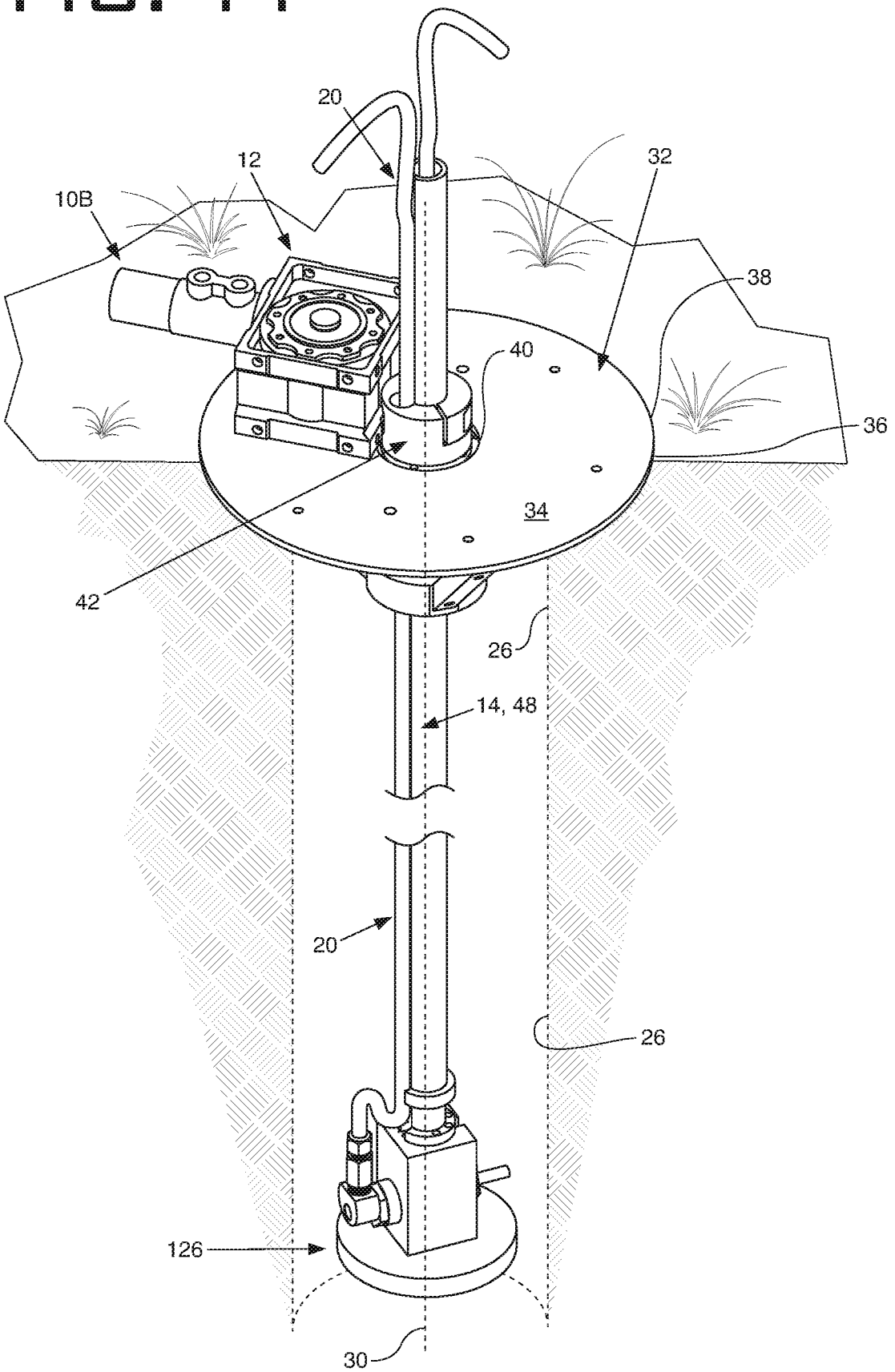
FIG. 11 is a diagrammatic perspective view of a pipe cutting device in accordance with a second embodiment of the present disclosure.

FIG. 11 depicts the second embodiment of cutting device 10B which includes some similar components to that of cutting device 10A wherein the similar components are identified by similar reference numerals and are not repeated herein for brevity. Cutting device 10B differs from cutting device 10A in that it includes a differing cutting head 126.

Figure 12:
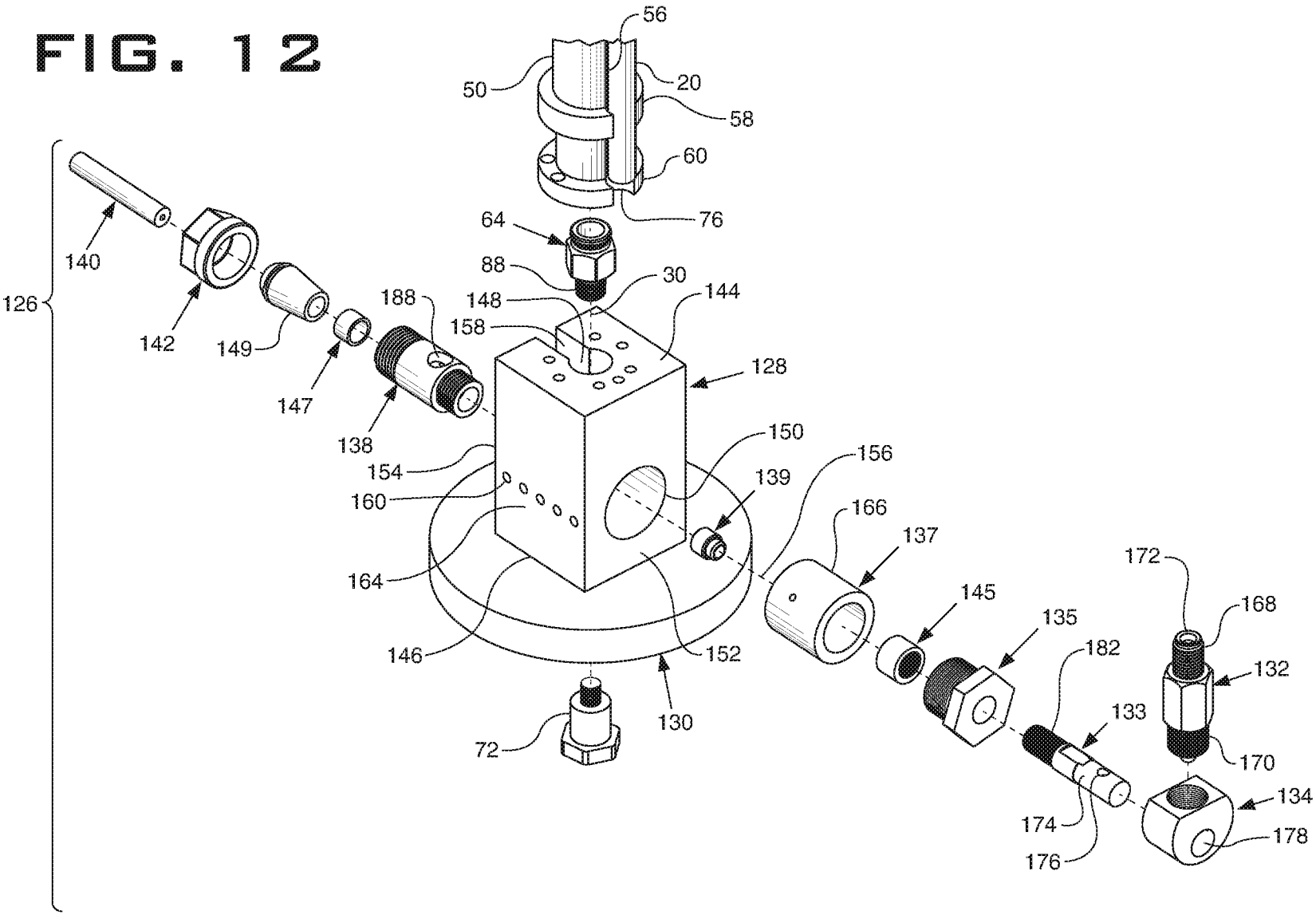
FIG. 12 is an exploded perspective view of a cutter head on the second embodiment cutting device.
Figure 13:
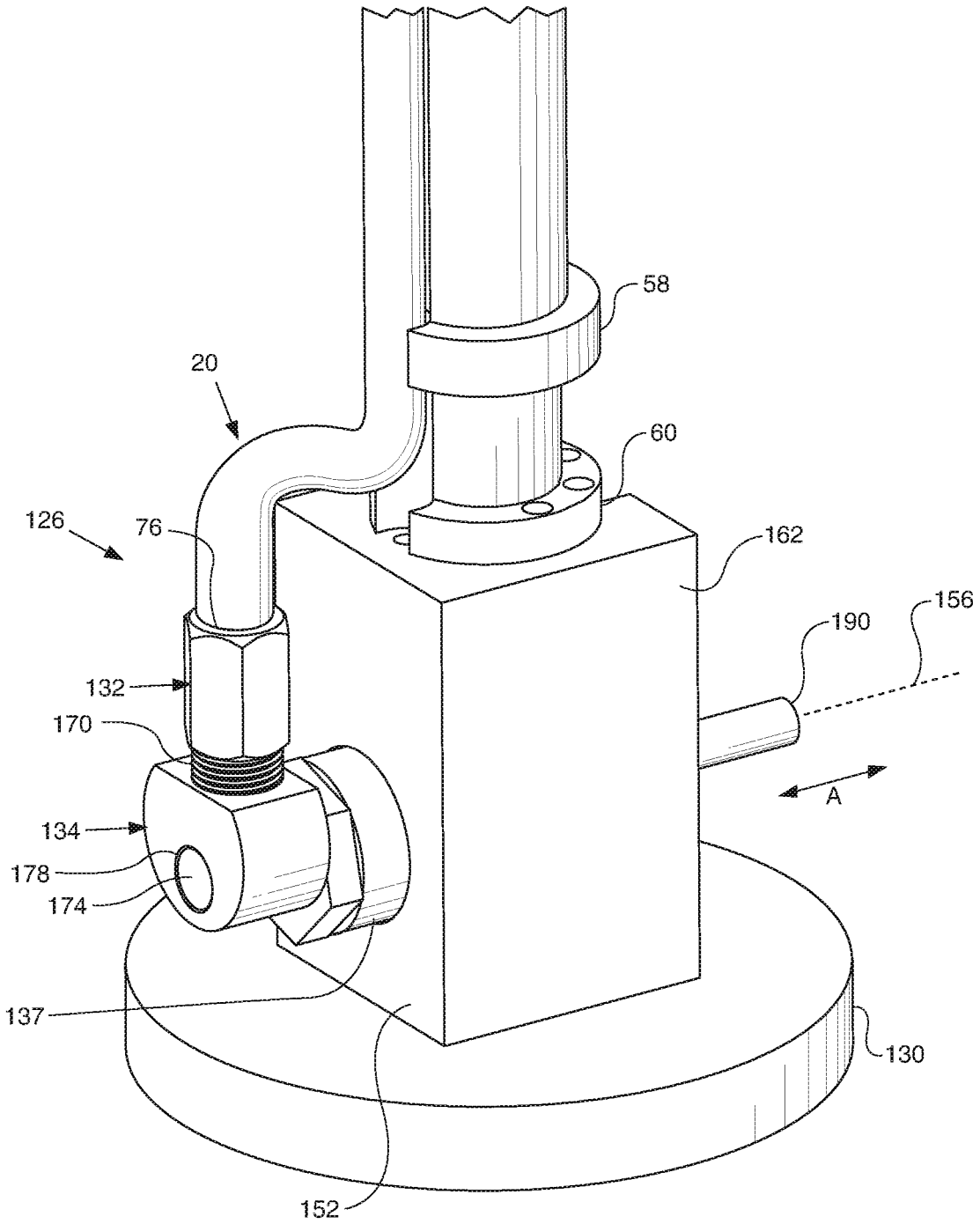
FIG. 13 is an assembled enlarged perspective view of the cutting head on the second embodiment cutting device.
Figure 14:
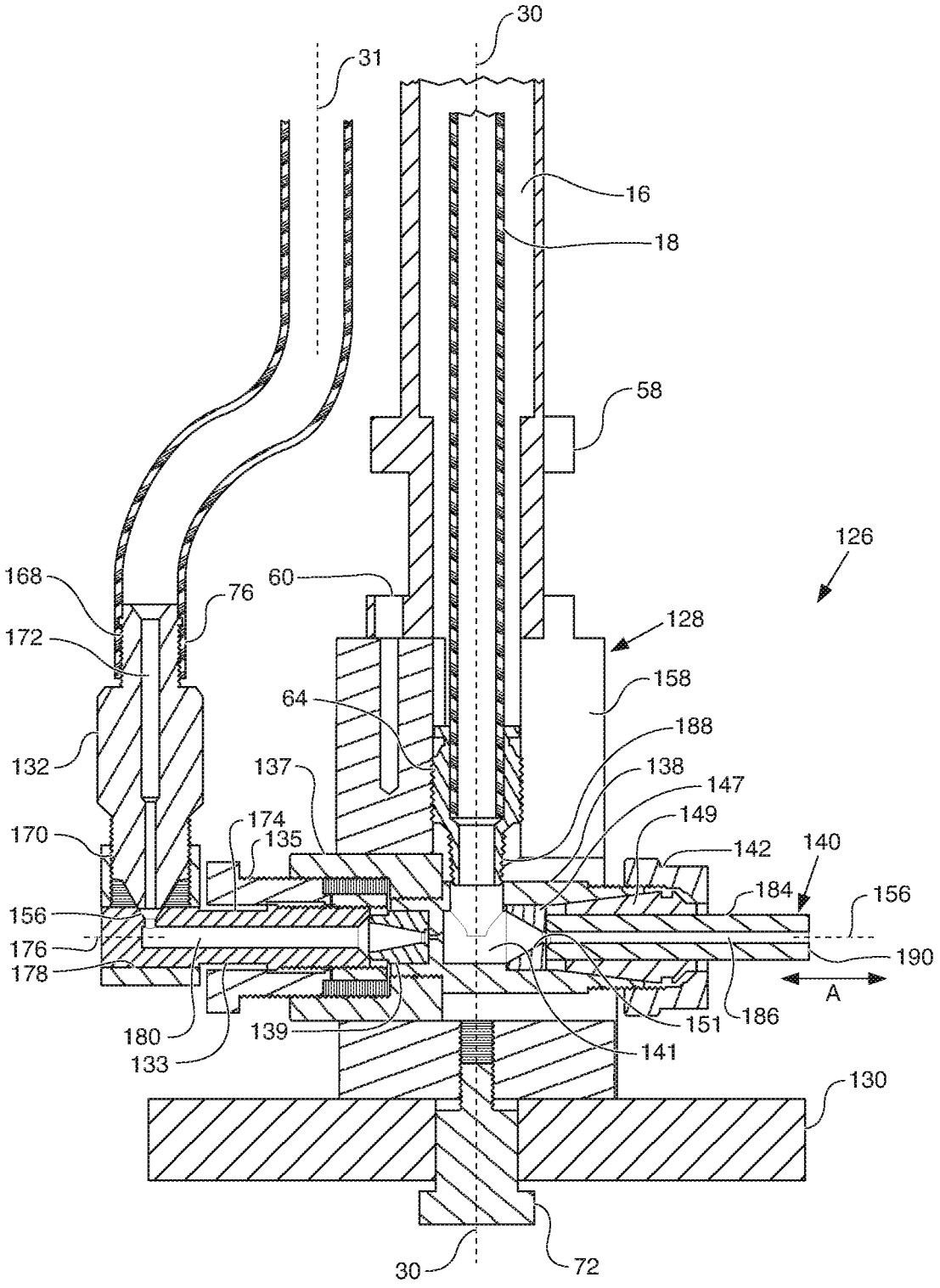
FIG. 14 is an elevational cross-section view of the cutting head on the second embodiment cutting device.

As depicted in FIG. 12, FIG. 13, and FIG. 14, cutting head 126 of cutting device 10B includes a generally rectangular rigid body 128, a lower annular plate 130, a threaded couple 132, an elbow 134, a focus tube 133, a second threaded couple 138, an extension member 140, and a fastener 142.

Rectangular rigid body 128 includes an upwardly facing top surface 144 opposite a downwardly facing bottom surface 146. Rectangular rigid body 128 includes four sidewalls extending from the first surface 144 to the second surface 146 at right angles thereto and at right angles relative to each other. Body 128 defines a first longitudinally extending bore 148 which is coaxial with longitudinal axis 30. In one particular embodiment, bore 148 is centered relative to the first surface 144 and the second surface 146 such that the sidewalls of rigid body 128 are all equal relative their longitudinal axis 30. The longitudinal bore 148 extends fully through rigid body 128 from the first surface 144 to the second surface 146. A transverse second bore 150 is defined by rigid body 128 and extends from a first sidewall 152 fully transverse through rigid body 128 to a second sidewall 154. Transverse second bore 150 has a diameter that is larger than the diameter of the longitudinally extending first bore 148. The transverse second bore 150 is centered along a transverse axis 156 perpendicularly intersects longitudinal axis 30 within rigid body 128. Rigid body 128 may further define a slot 158 in open communication with the longitudinal first bore 148 and the transverse second bore 150 such that the slot 158 interrupts the first sidewall 152 and interrupts the top surface 144 of rigid body 128.

Rigid body 128 may further define a plurality of laterally extending bores 160 which are formed as through holes that laterally extend through a third sidewall 162 rigid body 128, wherein the third sidewall 162 is parallel and offset from a fourth sidewall 164. The third sidewall 162 and the fourth sidewall 164 are perpendicularly intersect and form corner unions with the first sidewall 152 and the second sidewall 154. The lateral bores 160 are configured to receive a fastener, such as a screw, therethrough which engages in a frictional interference fit an outer surface of a collar 137 operatively connected with tube 133. When assembled, the collar 136 slideably received within a portion of transverse second bore 150. This enables the focus tube to be slideably adjusted along transverse axis 156 to provide a desired offset from the inner surface of pipe 26 to be cut by abrasive fluid and ultrahigh pressure fluid moving through focus tube and the extension member 140.

With continued reference to FIG. 12, FIG. 13, and FIG. 14, an upper threaded end 168 of first couple 132 is threadably connected with lower end 76 of UHP hose 20. Lower end 170 of couple 132 is threadably connected with elbow 134. First couple 132 defines a bore therethrough for fluid from UHP 20 to move therethrough when the couple 132 is threadably connected with lower end 76. The bore 172 of couple 132 extends from first end 168 to threaded second end 170.

Tube 133 is oriented transversely and includes a cylindrical body 174 defining an opening 176 aligned with the bore 172 of couple 132 within the elbow 134. Elbow 134 defines a transversely extending bore 178 that receives the cylindrical body 174 of tube 133 therethrough. When the cylindrical body 174 of tube 133 is disposed within the transverse bore 178 of elbow 134, the opening 176 is positioned vertically below the longitudinally extending bore 172 of couple 132. An open fluid communication is established through the bore 172 such that ultrahigh pressure liquid or fluid may flow from hose 20 through the couple 132 into the bore 180 defined by cylindrical tube 174 of focus tube 133. A threaded forward end 182 on cylindrical body 174 is configured to mate with a gland nut 135 and collar 137 and an additional coupler 145. An insert 139 has a transversely tapered opening that is in fluid communication with the end 184 of tube 133. Insert 139 enables high pressure fluid to flow into a venture mixing chamber 141.

Extension member 140 is oriented transversely and includes a cylindrical body 184 that extends through second couple 138 along the transverse second axis 156. The extension member 140 is aligned with cylindrical body 174 of tube 133 along second axis 156 and is retained in place by fastener 142 within the second bore 150 of rigid body 128. The cylindrical body 184 of extension member 140 defines a bore 186 and is in open fluid communication with bore 180 (FIG. 14) of focus tube 133 via the venture mixing chamber 141. The open fluid communication of bore 186 with bore 180 effectuates the transition of UHP fluid from focus tube 133 to the extension member 140 while drawing abrasive through line 18 which is also in fluid communication with mixing chamber 141. More particularly, fluid flows through bore 180 defined by cylindrical body 174 through mixing chamber 141 where it draws abrasive out from line 18 and the mixture flows through bore 186 defined by cylindrical body 184. Similar to the previous embodiment, within cutting device 10B, the ultrahigh pressure fluid is never flowing along longitudinal axis 30, rather when the ultrahigh pressure fluid is within UHP hose 20, it is offset parallel to axis 30. After passing through the elbow 134, the UHP fluid only intersects longitudinal axis 30 in a perpendicular manner and is never coaxial therewith. The abrasive fluid moving along abrasive line 18 extends centrally in a coaxial manner along longitudinal axis 30 and is mixed with UHP fluid inside rigid body 128 in chamber 141 by moving through a hole 188 formed in second couple 138. The lower end 88 of couple 64 connects with rigid body 128 to create an open fluid communication of the couple 64 with the hole 188 of second couple 138 through bore 148.

While not shown, it is entirely possible for a second annular or circular plate (in addition to plate 130) to be attached to the rigid body 128 above the focus tube 133. In one instance, the second plate connects with a bracket located near the bottom end of the tubular support member 14. Both annular plates (130, and the second annular plate) cooperate to center the device within the pipe to be cut, which is helpful in the event the tubular support member 14 ever is bent.

FIG. 14 depicts a mixing bowl 147 located within couple 138 and held in position by a tapered member 149 defining a transversely aligned bore that receives member 140 therethrough. The mixing bowl 147 is in direct fluid communication with venture chamber 141. Mixing bowl includes a tapered wall 151 that narrows to an opening for moving the mixture of UHP fluid and abrasive through member 140.

When the tube 133 and the extension member 140 are connected together, they may move transversely along the axis 156 and may be secured in place by fasteners extending laterally through bores 160 on rigid body 128. This effectuates and enables an operator or user to vary the offset distance of the end of the extension member 140 relative to the inner surface of the pipe 26 to be cut. Thus, if the pipe has a narrower diameter, the focus tube and extension member 140 would be adjusted to move the outer end 190 of extension member 140. Alternatively, if the pipe 26 to be cut has a larger diameter, the outer end 190 of extension member 140 would be moved in a direction opposite that as previously described. The directional sliding movement of the outer end 190 is represented by movement arrows A in FIG. 13. This indicates that the outer end 190 may slide along transverse second axis 156.

Figure 15:
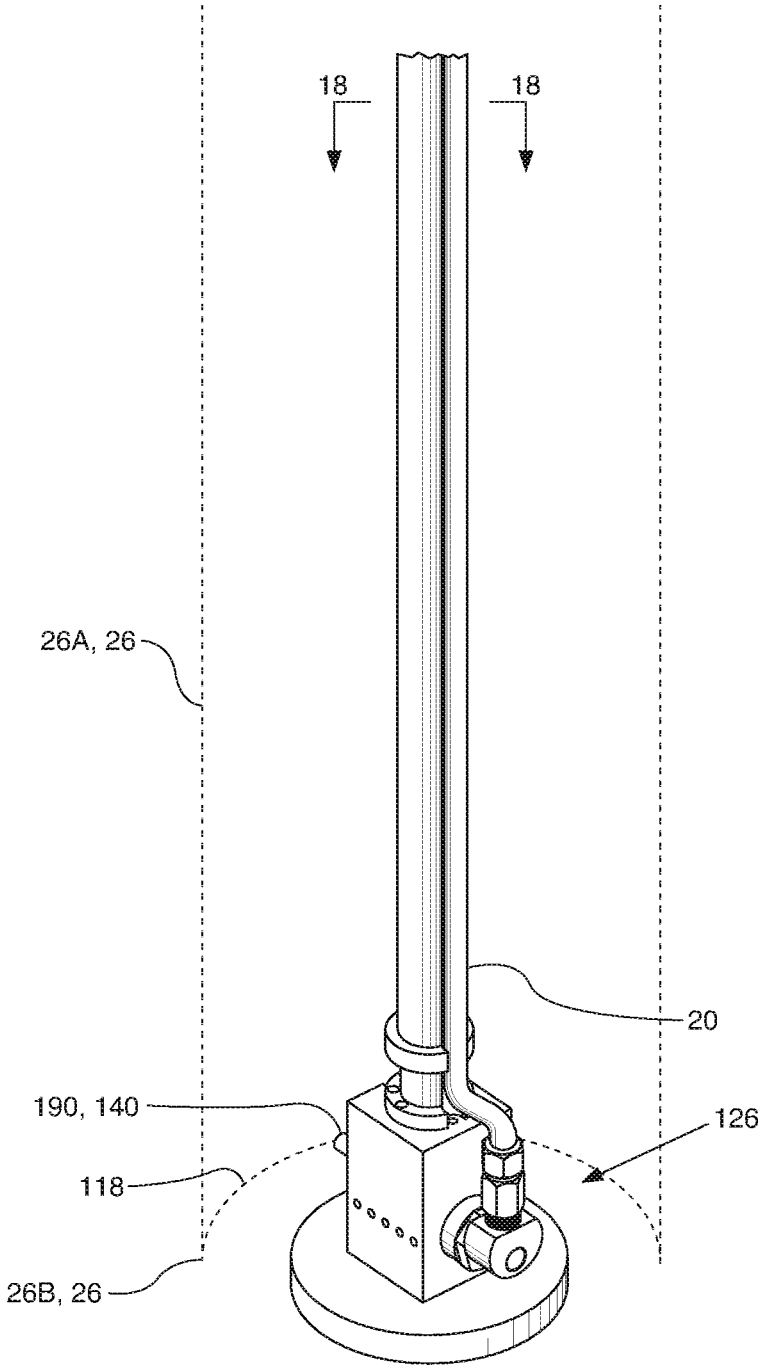
FIG. 15 is an operational perspective view of the second embodiment cutting device located within a pipe in a first position.
Figure 17A:
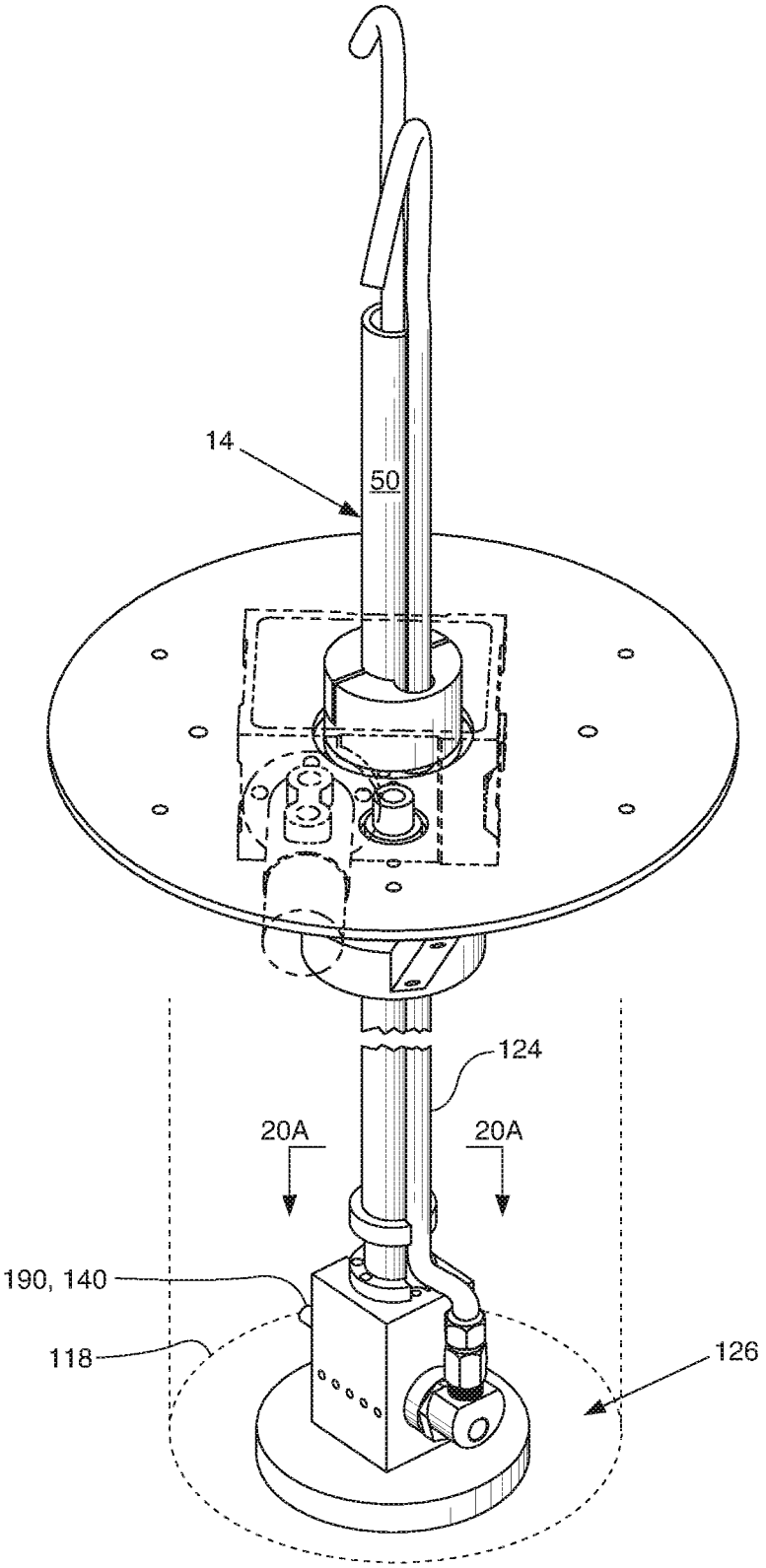
FIG. 17A is an operational perspective view of the second embodiment cutting device wherein completing 360° revolution.
Figure 17B:
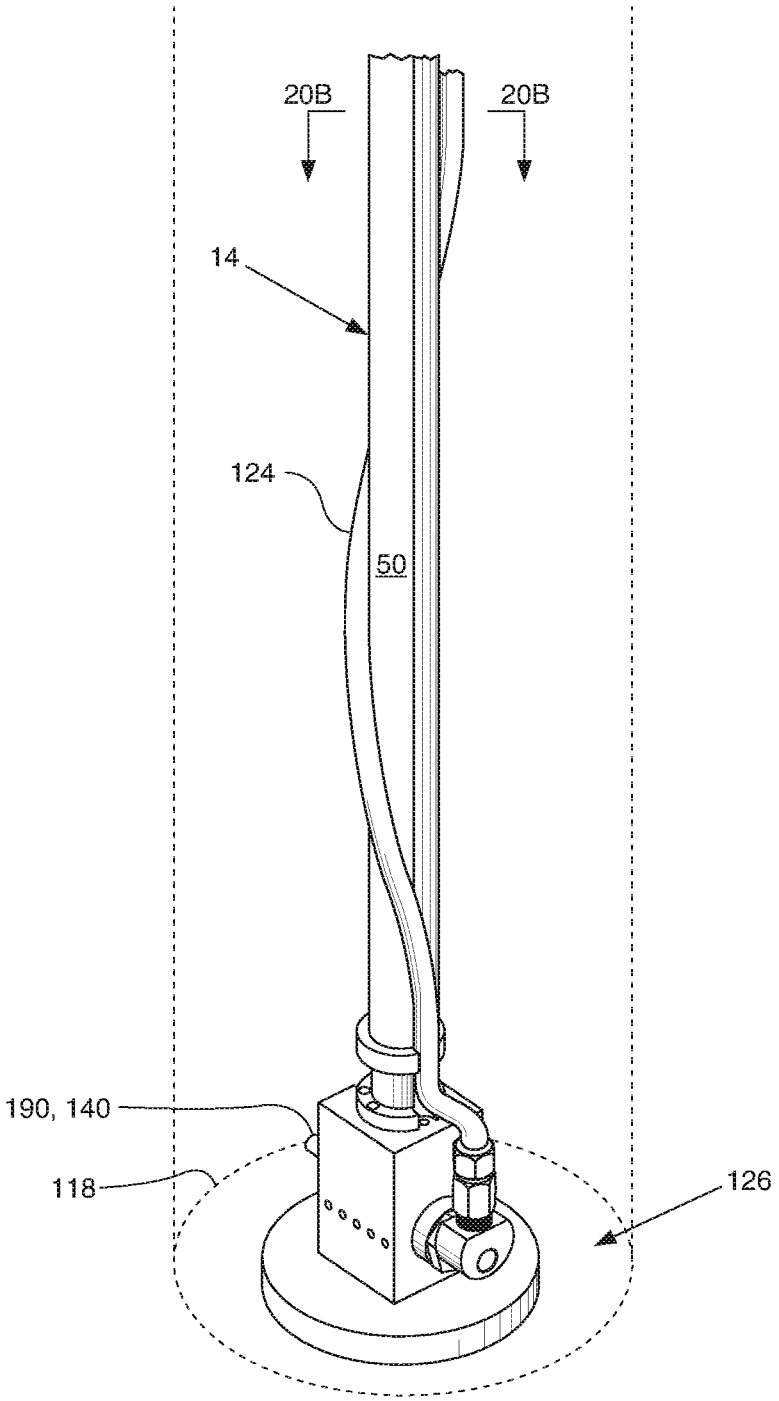
FIG. 17B is an operational perspective view of the second embodiment implementing the option from FIG. 16B wherein the high pressure hose or tube has been wrapped a full revolution while the cutting device completes a 360° revolution.
Figure 18:
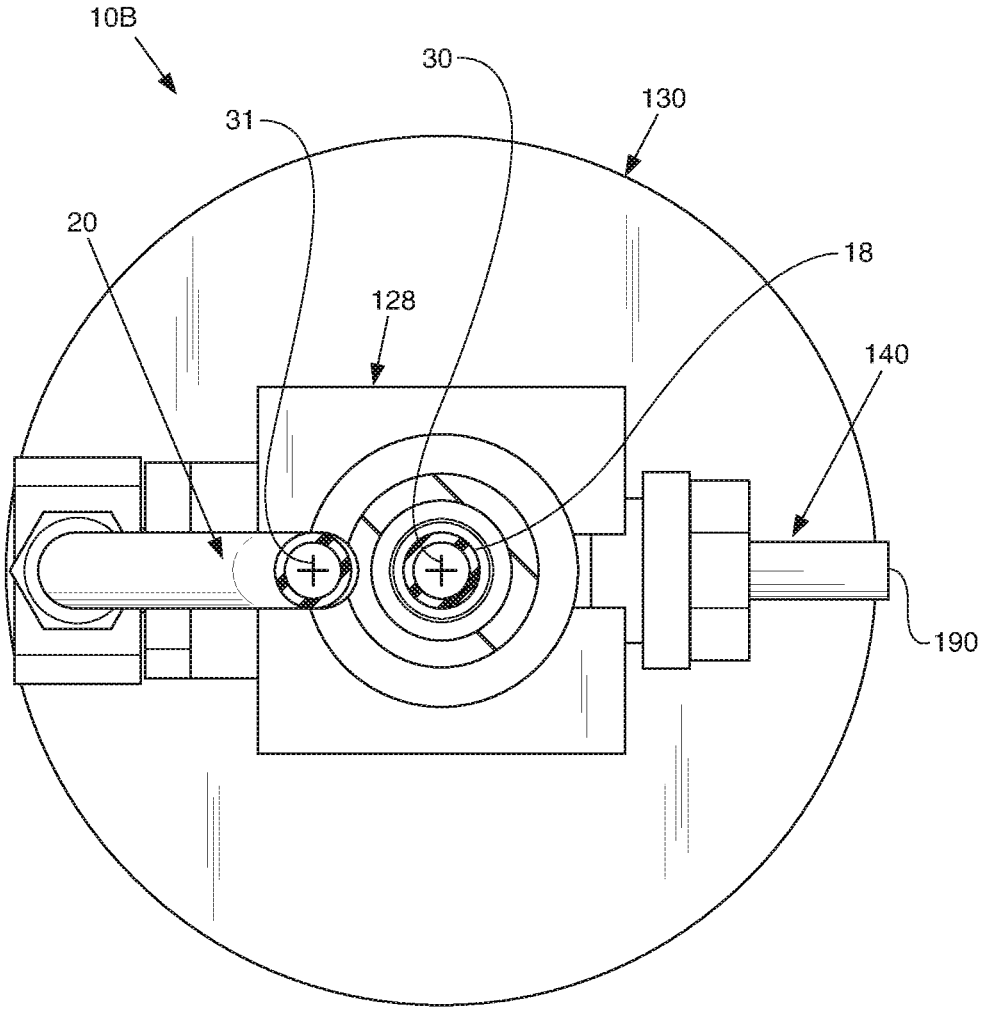
FIG. 18 is a cross-section view taken along line 18-18 in FIG. 15.

FIG. 15-FIG. 20 depict similar positions of the UHP hose 20 as it revolves around the longitudinal axis 30 while remaining outside of tubular support member 14 as indicated above with reference to FIG. 5-FIG. 10. FIG. 15 and FIG. 18 depict cutting device 10B in the first position, which also may be referred to as the neutral position or the home position. In this scenario, the cutting head 126 may be oriented in a manner such that the end 190 of extension member 140 is aligned with a cut line 118 of pipe 26. As the UHP fluid moving through hose 20 and the abrasive fluid moving through feed line 18 mix within rigid body 128 exits the outer end 190 of extension member 140, it is directed towards the cut line 118 and cuts the same into the first section of pipe 26A and the second section of pipe 26B to be capped and left in the ground.

Figure 16A:
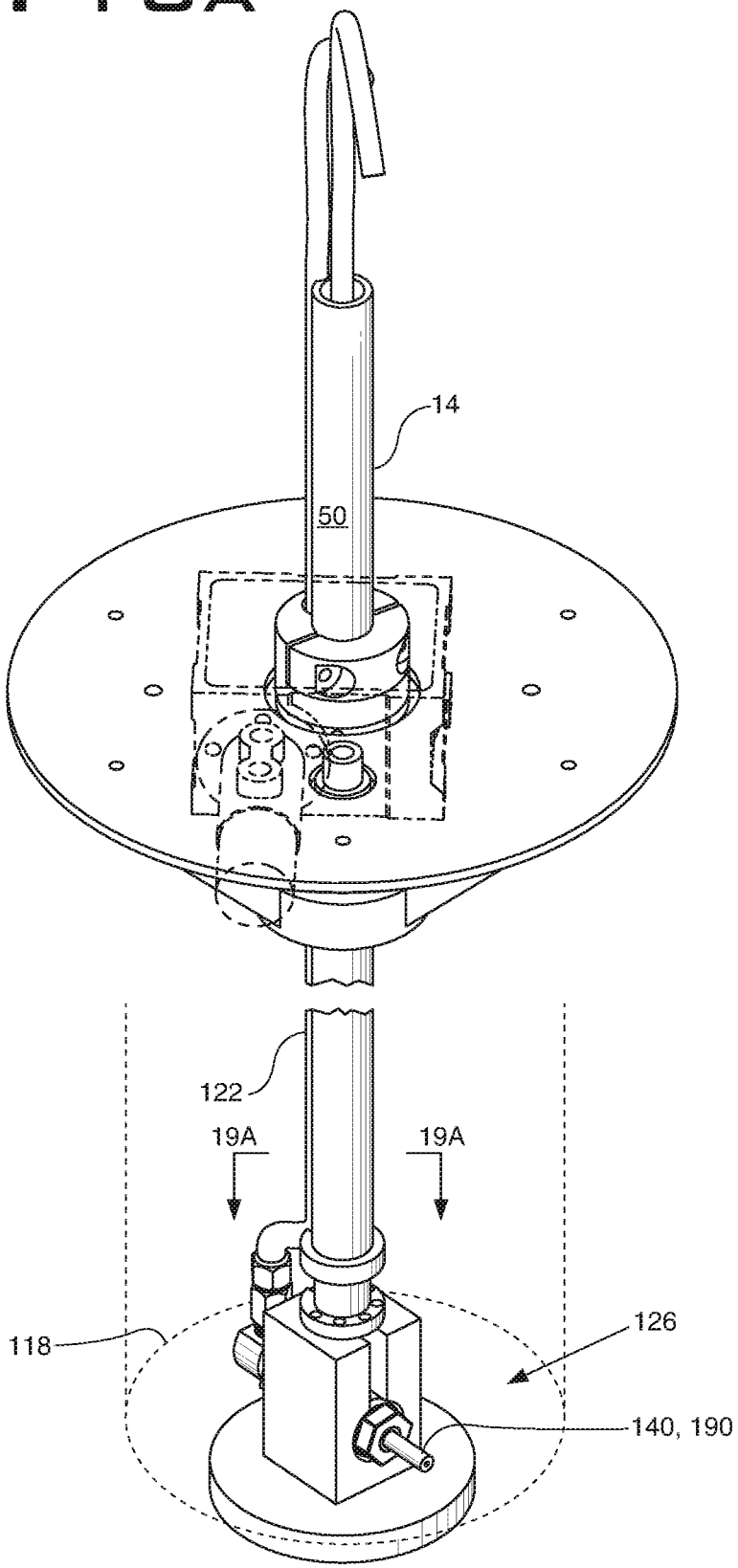
FIG. 16A is an operational perspective view of the second embodiment cutting device wherein the cutting head is rotated 180° from the first position and the high pressure hose or tube has been revolved around a longitudinal axis but remains outside an elongated tubular support member.
Figure 19A:
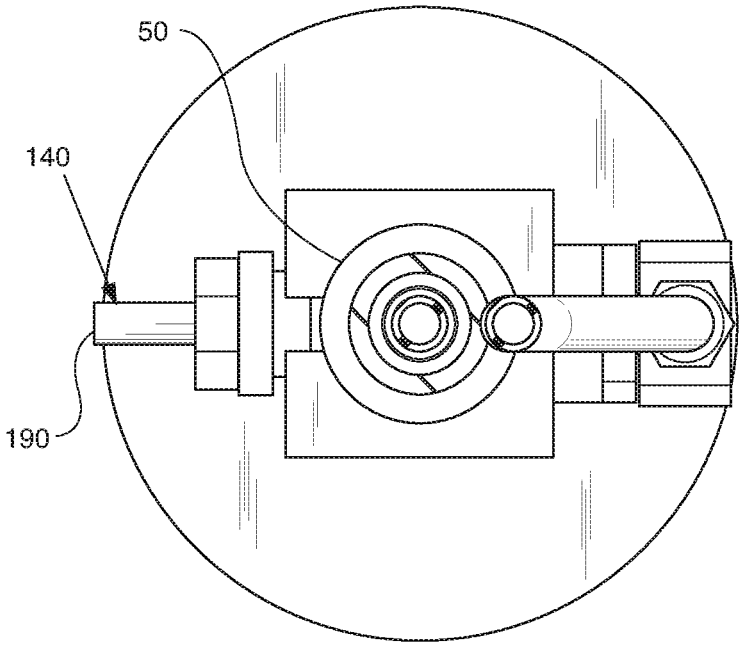
FIG. 19A is a cross-section view taken along line 19A-19A in FIG. 16A.

FIG. 16A and FIG. 19A depict the one have revolution position wherein the collar 42 effectuates the fixed relative relationship of the hose 20 and the tubular support member 14. As the tube member 14 rotates (as driven by motor 12), the hose 20 is carried by collar 42 so as to revolve around the axis 30. The motor is capable of driving the revolution from the home position to the one have revolution position. The motor may drive the revolution from the one half position to a full revolution position, or alternatively, the motor may reverse directions and drive the revolution from a one half revolution position to a reverse one have revolution position (i.e., from 180° to −180°).

Figure 16B:
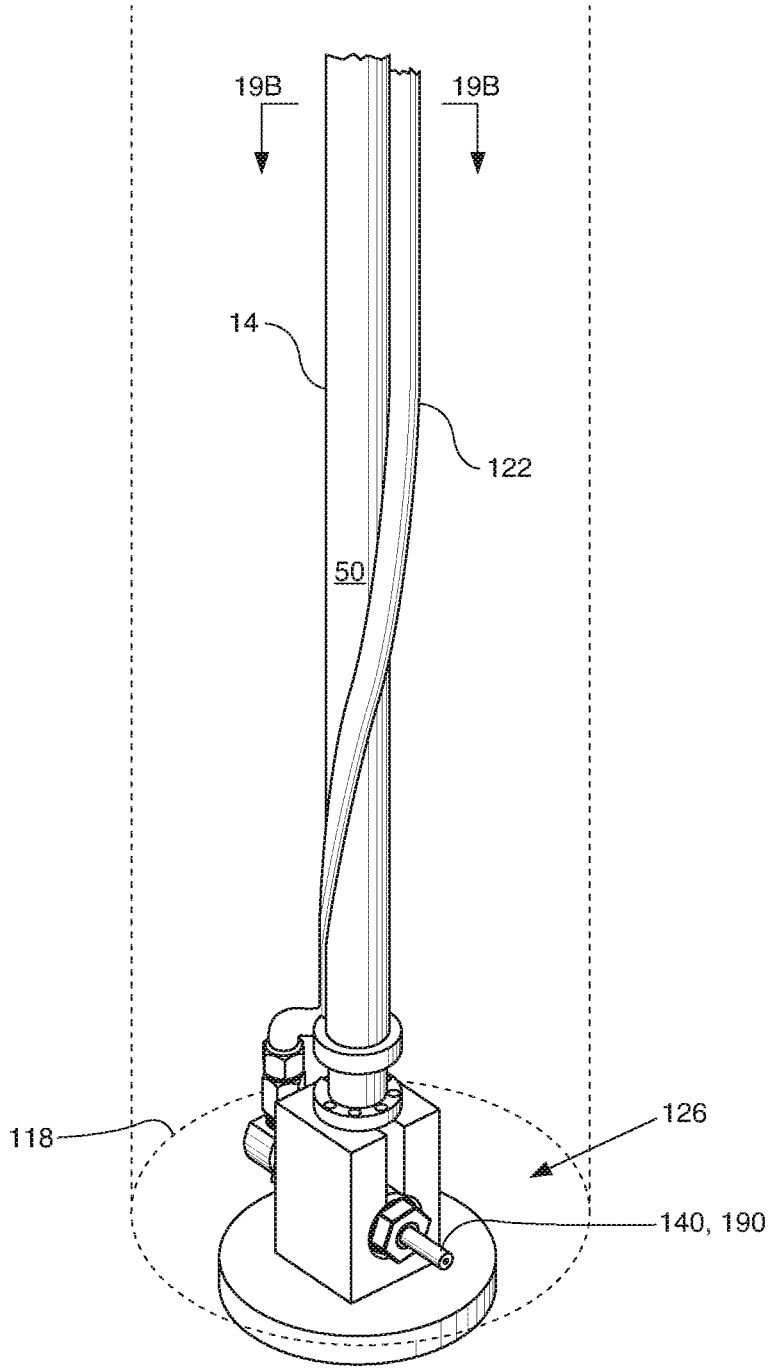
FIG. 16B is an operational perspective view of the second embodiment cutting device wherein the cutting head is rotated 180° from the first position and the high pressure hose or tube has optionally wrapped the elongated tubular support member via revolving the same around a longitudinal axis.
Figure 19B:
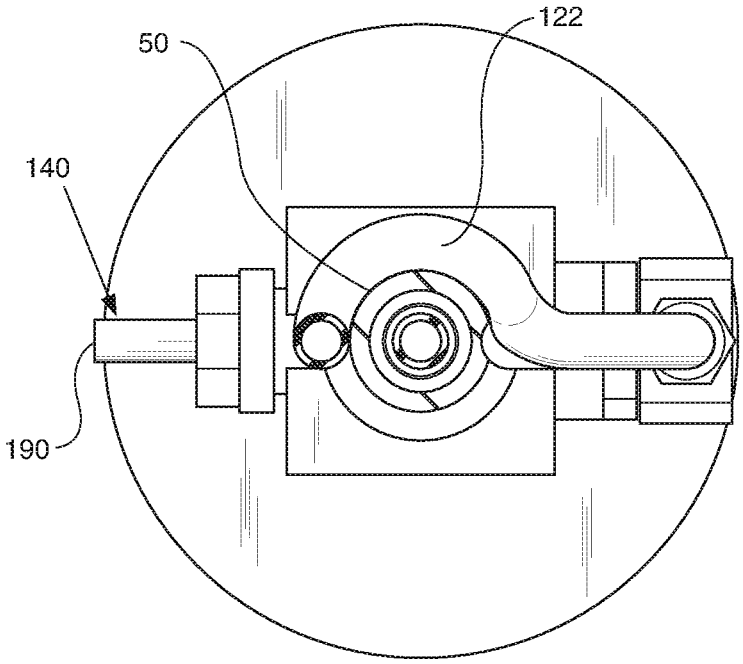
FIG. 19B is a cross-section view taken along line 19B-19B in FIG. 16B.
Figure 20A:
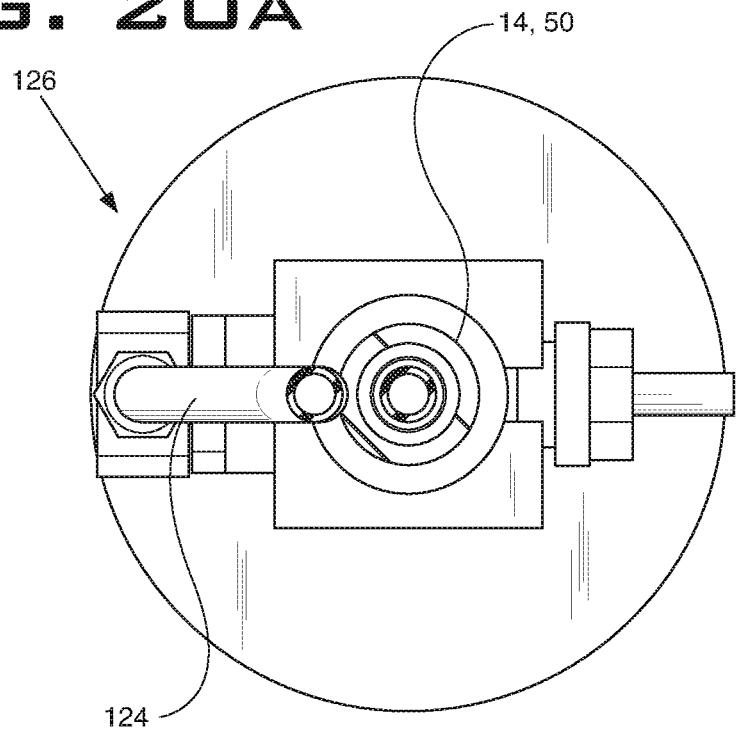
FIG. 20A is a cross-section view taken along line 20A-20A in FIG. 17A.
Figure 20B:
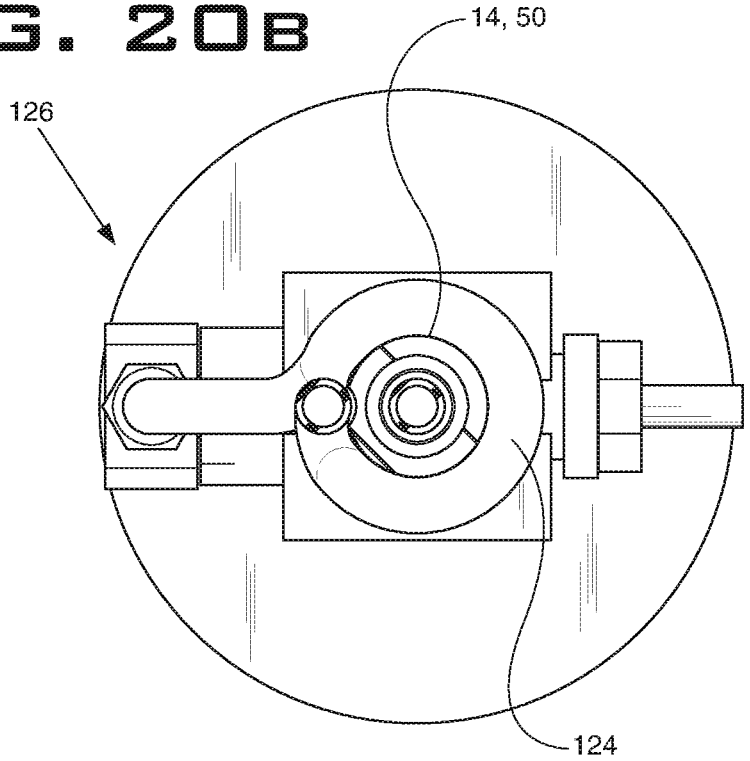
FIG. 20B is a cross-section view taken along line 20B-20B in FIG. 17B.

FIG. 16B and FIG. 19B depict the alternative version where the hose 20 is wrapped around the member 14 to accomplish to revolution of hose 20 around axis 30. More particularly, the half wrap 122 of the hose 20 makes a 180° revolution about the outer surface 50 of tubular support member 14. Motor 12 may continue to drive cutting head 126 to move it along the cut line 118 fully therearound such that, as shown in FIG. 17B and FIG. 20B, the full wrap or full revolution 124 of UHP tube is effectuated around the outer surface 50 of tubular support member 14. Thus, device 10A and 10B operate in a similar manner, but may be accomplished with different styles of cutting heads located at the lower end 46 of tubular support member 14.

Figure 21:
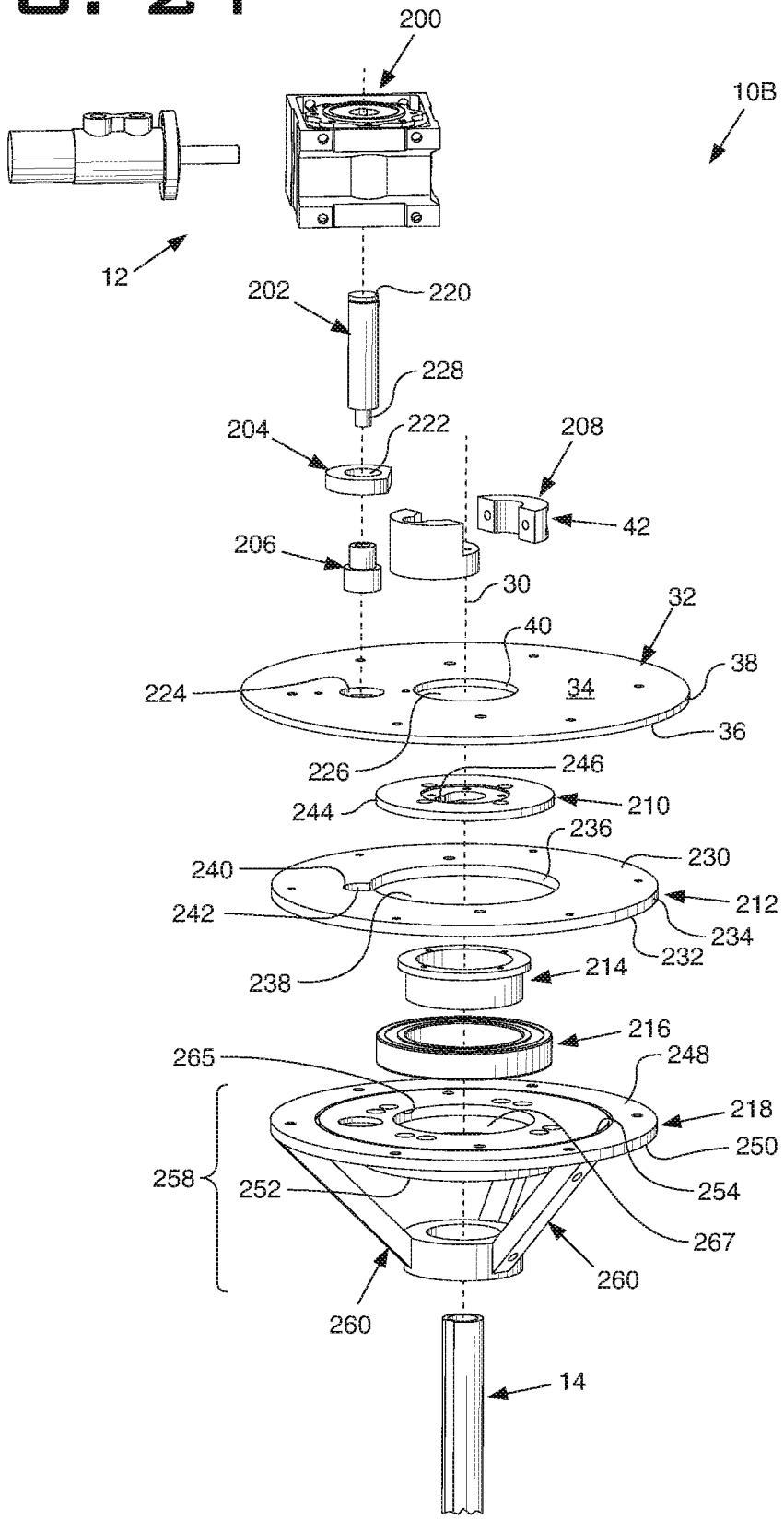
FIG. 21 is an exploded perspective view of a drive assembly and centering device on the second embodiment cutting device.
Figure 22:
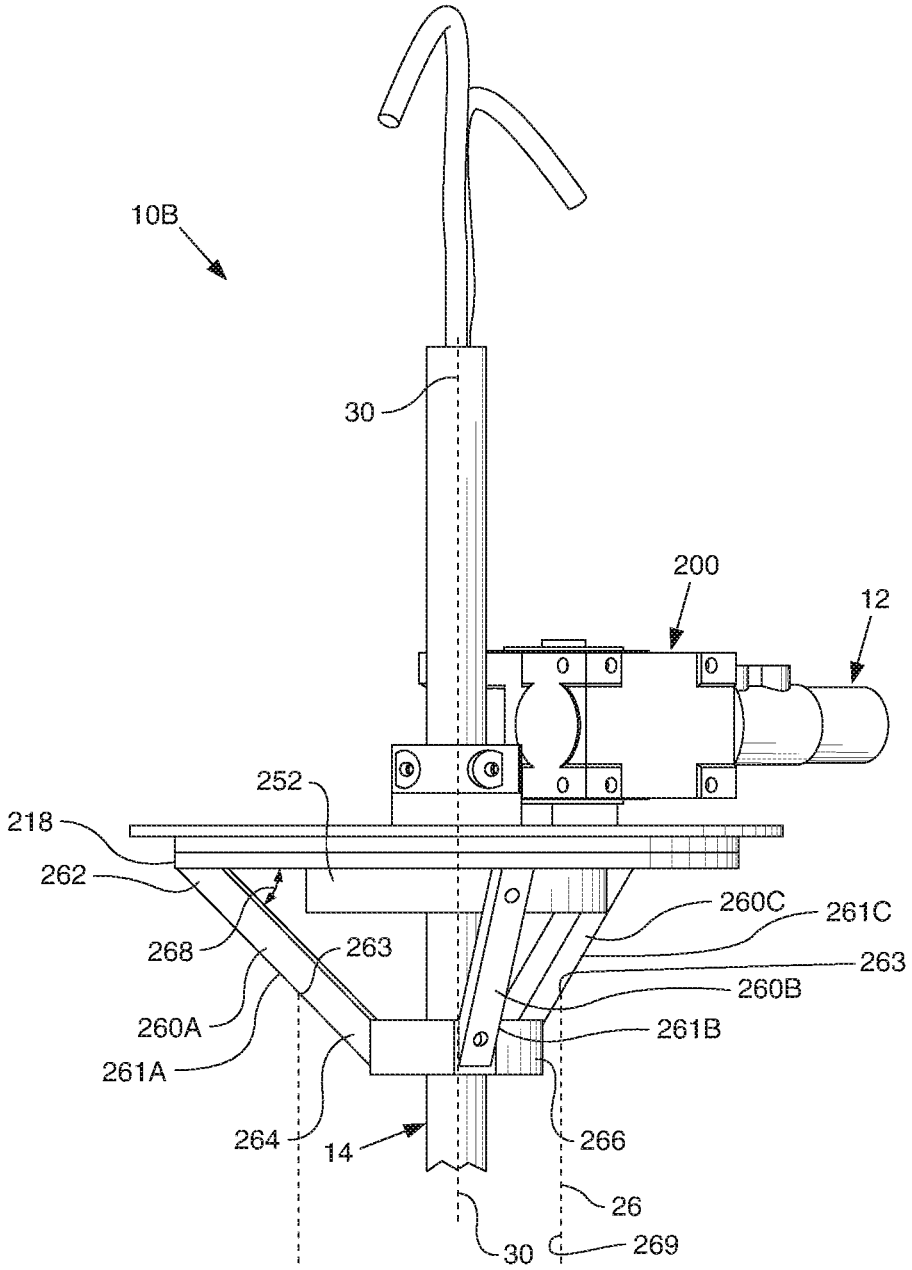
FIG. 22 is a side elevation view of the drive assembly and centering device on the second embodiment cutting device.
Figure 23:
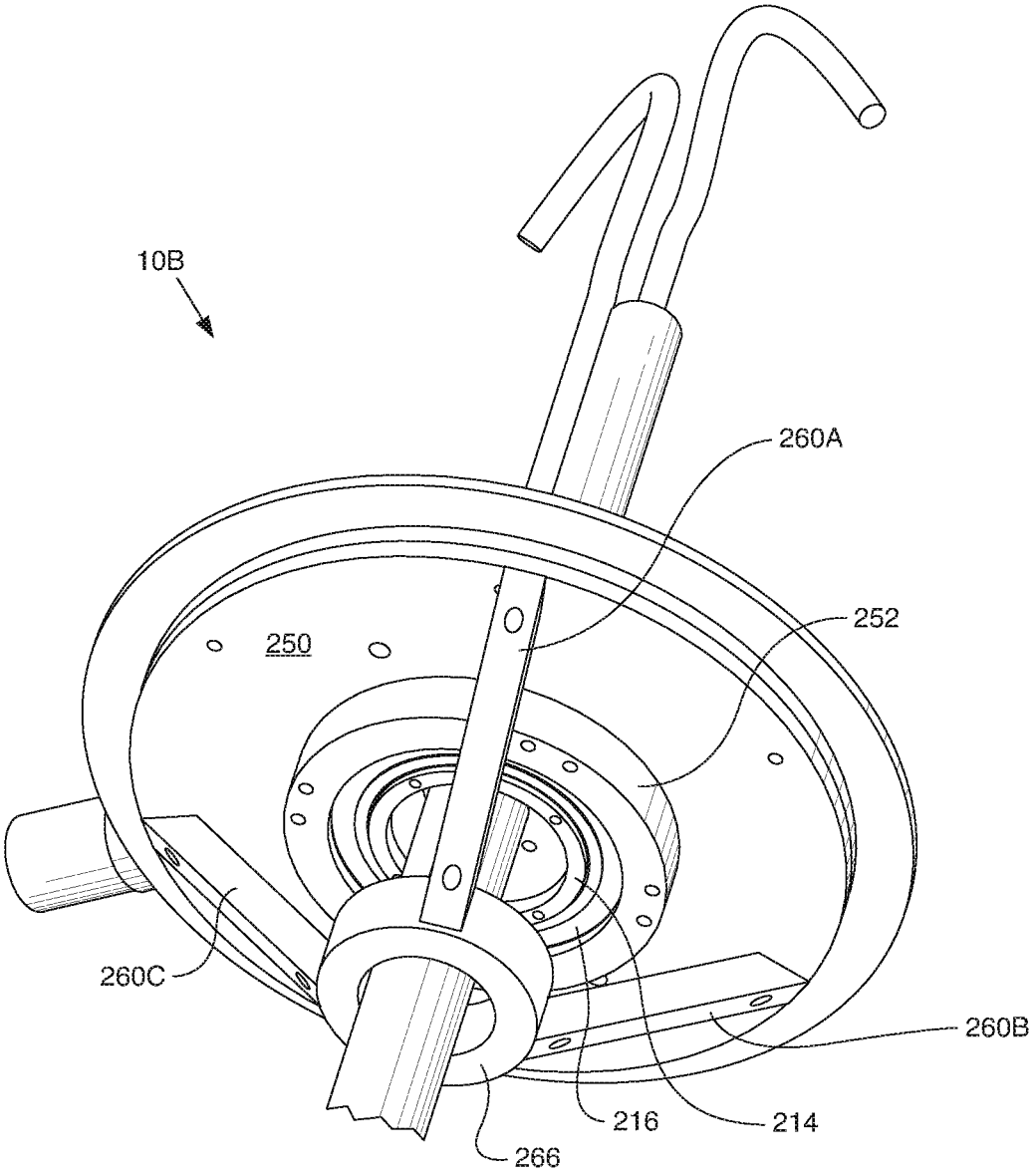
FIG. 23 is a bottom perspective view of the centering device on the second embodiment cutting device.

FIG. 21-FIG. 23 depict a drive assembly utilized to effectuate the revolution of UHP hose 20 in cutting device 10B. The drive assembly includes hydraulic motor 12, a 90° worm gear reducer 200, a reducer shaft 202, a gear reducer mount 204, a pinon gear 206, a split clamp 208 of the collar 42, the top plate 32, a spur gear 210, a middle plate 212, a hub 214, a bearing 216, and a bottom plate 218.

Shaft 202 includes an upper end 220 in operative communication with the hydraulic motor being positioned within the 90° worm gear reducer 200. Hydraulic motor 12 drives shaft 202 via worm gear reducer 200. Longitudinal axis of shaft 220 is offset parallel to longitudinal central axis 30 of device 10B. Shaft 202 extends through an aperture 222 formed in gear reducer mount 204. The gear reducer mount 204 is located above the upwardly facing top surface 34 of top plate 32 above an aperture 224 formed extending through the top surface 34 of top plate 32. Aperture 224 is offset from the inner edge 40 such that the aperture 224 is eccentric to central aperture 226 defined by inner edge 40.

Pinion gear 206 extends through aperture 224 is in direct communication with a lower end 228 of shaft 202. Pinion gear 206 rotatably mates with gear 210.

Middle plate 212 is generally annular in shape and includes an upwardly facing top surface 230 and a downwardly facing bottom surface 232. Middle plate 212 further includes an outer perimeter edge 234 and an inner edge 236 defining a central aperture 238. Inner edge 236 is interrupted by an arcuate cutout 240 defining a smaller second aperture 242. Aperture 242 is sized to receive the lower end of pinion gear 206 therein. When assembled, the middle plate 212 is closely adjacent the top plate 32 such that the lower surface 236 of the top plate engages the upwardly facing top surface 230 of the middle plate 212. The central aperture 226 of top plate 32 has a smaller diameter than the central aperture 238 of middle plate 212. The spur gear 210 is positioned within the central aperture 238 of the middle plate 212.

An outer perimeter 244 of spur gear 210 is closely adjacent the lower end of pinion gear 206 residing in the cutout aperture 242. Spur gear 210 is rigidly connected to collar 42. Accordingly, when hydraulic motor 12 drives shaft 202 which rotates the pinion gear 206, the spur gear 244 is rotated about longitudinal axis 30 to effectuate the revolutional movement of the UHP hose 20 which is held in place by an eccentric edge 246 of spur gear 210 (and the collar 42). Spur gear 210 is positioned above the hub and bearing 214, 216 within the central aperture 238 of the middle plate. The hub and bearing 214, 216 effectuate movement of the spur gear 210 in response to driven movement of pinion gear 206. The hub and bearing 214, 216 are located centrally about longitudinal axis 230 and are retained within the bearing retainer 252. Lower plate 218 includes an upwardly facing top surface 248 which mateably engages the downwardly facing lower surface 232 of middle plate 212. Lower plate 218 further includes a downwardly facing bottom surface 250. The bearing retainer 252 may extend downwardly from the bottom surface 250 of lower plate 218. Bearing retainer 252 retains bearing 216 therein. Additionally, a channel 254 may be formed in upwardly facing top surface 248 configured to receive an O-ring or gasket seal.

Lower support plate 218 may also qualify as a centering device 258 in accordance with one aspect of the present disclosure. A centering device utilizing lower support plate 218 may be used with various aspects of either this disclosure or other disclosures which require a tool to be centered within a pipe 26 or within another cylindrical body. Thus, while the centering device 258 encompassed by the lower plate 218 is shown herein with respect to cutting device 10B, it is to be understood that any utility tool on the down hole end of a tubular support member could be centered within the pipe 26 utilizing the centering device 258.

Thus, centering device 258 may include plate 218 and a plurality of angled support arms 260 extending from the bottom surface 250 of plate 218. In one embodiment, the centering device 258 may utilize three support arms 260A, 260B, 260C oriented 120° apart from each other and viewed from above along the longitudinal axis. When viewed from the side, as depicted in FIG. 22, the three tapered support members 260A, 260B, 260C each includes an upper end 262 and a lower end 264. The upper end 262 is rigidly connected with the bottom surface 250 of plate 218. The lower end of 264 of support member 260 may be connected with a collar 266 which is concentric about longitudinal axis 30. In one embodiment, an angle 268 is defined between the tapered support 260 and the bottom surface 250 of bottom plate 218. The angle 268 may be in a range from about 10° to about 80°. In one particular embodiment, the angle 260 is in a range from about 45° to about 60°. In another particular embodiment, the angle 260 is 60°. The upper end 262 is positioned radially outward a further distance from longitudinal axis 30 relative to lowered end 264. Accordingly, the combination of the tapered supports 260A, 260B, 260C allow the device 10A, 10B or another utility down hole tool device to be centered within pipe 260. The tapered supports act as a centering cone to effectuate the centering of device 10A, 10B or another device relative to longitudinal axis 30.

With continued reference to FIG. 21, FIG. 22, and FIG. 23, centering device 258 is not limited to use strictly with the cutting heads 54, 126. It may be used to center any type of utility tool in the pipe 26 or tube when the utility tool at least partially is inserted therein. The centering device 258 may further provide that the first member 260A include a first edge 261A angled relative to the longitudinal axis 30 of the pipe 26 or tube. The second member 260B may include a second edge 261B angled relative to the longitudinal axis 30. The third member 260C may include a third edge 261C angled relative to the longitudinal axis 30. The first and second members 260A, 260B are radially spaced from each other relative to the longitudinal axis 30. Additionally, the first and second edges 261A, 261B are angularly contact the pipe 26 or tube in a slanted alignment. In one example, the first support member 260A is spaced about 120° from the second support 260B member relative to the longitudinal axis 30.

The bottom plate 218 is rigidly connected with respective upper ends of the first, second, and third edges 261A, 261B, and 261C. The first, second, and third edges 261A, 261B, and 261C are sized to contact a portion of an upper circumferential edge 263 of the pipe 26 or tube. The lower ends 264 of support members 260A, 260B, and 260C are positioned radially outward of the inner edge 265 (FIG. 21) defining a central aperture 267 (FIG. 21) relative to the longitudinal axis 30. This enables and positions the an upper ends 262 on the first edge 261A or the first support 260A remain exterior to the pipe 26 or tube in response to revolution of a portion of the utility tool inside the pipe or tube.

With continued reference to FIG. 22 and FIG. 23, the cutting device 10B or 10A may also be referred to as a device for effecting the pipe 26 or tube when the device 10A, 10B is at least partially inserted therein. The device 10A, 10B includes the elongated support member 14 including first and second ends, wherein the support member 14 is oriented similar to the longitudinal 30 axis of the pipe or tube. A utility tool, such as cutting head 54 or 126, is coupled near the second end of the elongated support member 14 adapted to be inserted into the pipe 26 or tube, and the utility tool performs a function that effects the pipe or tool (in this case cut the pipe, however other functions are entirely possible, such as clean the pipe or paint the pipe or weld the pipe). The centering device 258 is near the first end of the elongated support member 14 for centering the device relative to the pipe 26 or tube. The centering device 258 includes the first edge 261A that is angled between 10° and 80° relative to the longitudinal axis 30 and the first edge 261A is adapted to contact at least a portion of an inner circumferential edge 263 of the pipe 26 or tube. The first edge 261A on the centering device includes a first end (near 262) and a second end (near 264), wherein when the centering device 258 centers the device within the pipe 26 or tube, the first end of the first edge 261A is exterior to the pipe 26 or tube and the second end of the first edge 261A is interior to the pipe 26 or tube. The second edge 261B on the centering device is spaced radially from the first edge 261A relative to the longitudinal axis 30, wherein the second edge 261B is angled between 10° and 80° relative to the longitudinal axis and the second edge is adapted to contact at least a portion of the inner circumferential edge 263 of the pipe 26 or tube, wherein the second support includes a first end and a second end, wherein when the centering device centers the device within the pipe or tube, the first end of the second edge 261B is exterior to the pipe or tube and the second end of the second edge 261B is interior to the pipe or tube. The third support 260C includes a first end and a second end, wherein when the centering device centers the device within the pipe or tube, the first end of the third edge 261C is exterior to the pipe or tube and the second end of the third edge is interior to the pipe or tube. In one particular example, the first and second supports 260A, 260B on the centering device 258 are at an angle in a range from 30° to 60° relative to the longitudinal axis 30.

The first ends 262 of the first support 260A and the second support 260B are both positioned along an imaginary circumferential curve associated with circumferential edge 263 defined by $X^2+Y^2=R^2$, wherein a R is a first radius of inner surface 269 of the pipe 26 or tube relative to the longitudinal axis 30 and a second radius of the first ends 262 of the first and second supports 260A, 260B relative to the longitudinal axis 30 is greater than the first radius so as to position the first ends 262 exterior from the inner surface 269 of the pipe 26 or tube.

In one example the motor 12 revolves UHP hose 20 or tubing around the elongated support member 14 including an outer end that is positioned radially outward from the first ends of the first support and the second supports on the centering device. However, other embodiments of the present disclosure may provide a motor that effect revolutionary movement of a portion of the utility tool while an outer end of support member 14 that is positioned radially outward from the first ends 262 of the first support 260A and the second support 260B on the centering device.

As depicted in FIG. 21, FIG. 22, and FIG. 23, the centering device 258 is generally conical in shape. More particularly, the centering device 258 is shaped in an inverted frustoconical configuration.

Figure 24:
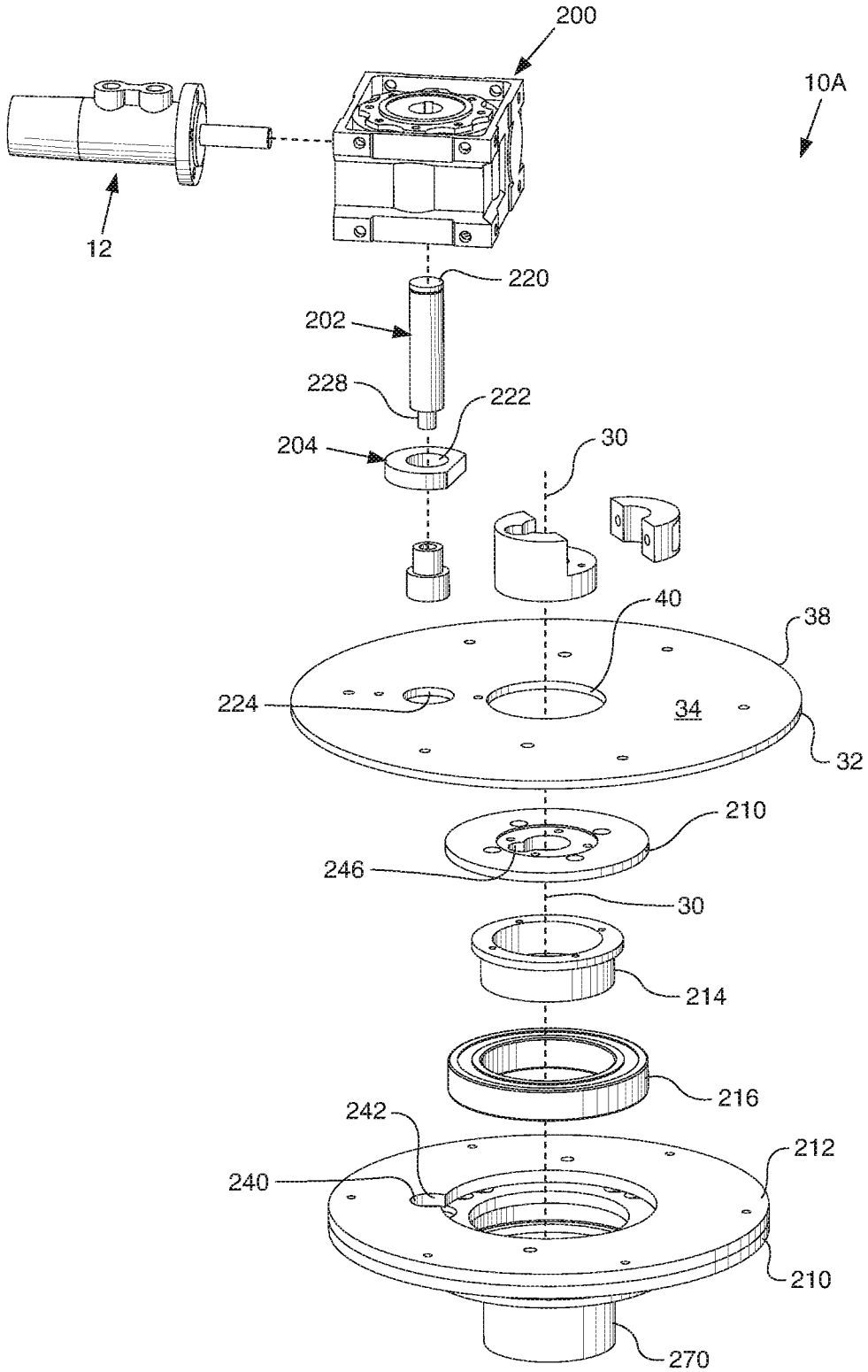
FIG. 24 is an exploded perspective view of the drive assembly on the first embodiment cutting device.
Figure 25:
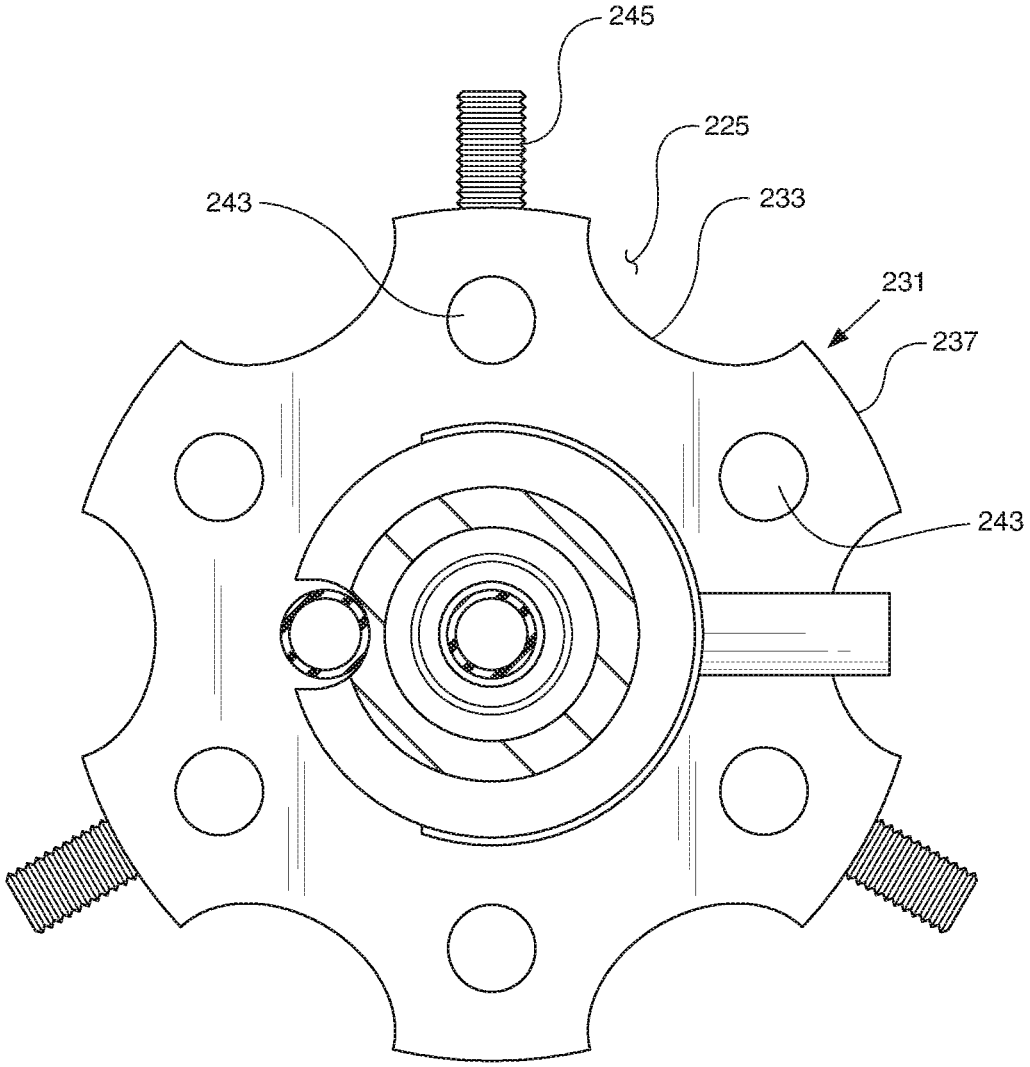
FIG. 25 is a top view of an alternative version of an annular lower plate connected to the bottom of a cutting head to center the cutting head in a pipe to be cut.

FIG. 24 represents a drive system in accordance with another aspect of the present disclosure utilized on cutting device 10A. A majority of the features of the drive system depicted in FIG. 25 are similar to those depicted in FIGS. 21-23, except that it does not have a centering device utilizing the tapered supports identified above. Rather, the centering device utilized with cutting device 10A has an annular collar or cylindrical member 270 which would have an outer diameter that is slightly less than the pipe 26 to be cut. Accordingly, the collar nests within the pipe so as to effectuate a centering of the drive device and the cutting device 10A about longitudinal axis 30. It is envisioned that the embodiment of the drive system utilizing the centering collar 270 shown in FIG. 24 is best utilized with smaller diameter pipes in a range from about four to six inches. The centering device 258 shown with respect to FIG. 21, FIG. 22, and FIG. 23 is envisioned to be best utilized on pipes having a diameter larger than about six inches.

FIG. 25 depicts and alternative annular plate 231 which is connected to the cutting head so as to center the same when the cutting head is located within a pipe 26 to be cut. Plate 231 include one or more edges 233 that define cutout regions 235 that interrupt the perimeter 237 of plate 231. Plate 231 may further define longitudinally extending holes 243 extending fully through plate 231. Together, the cutout regions 235 and holes 243 form passageways for fluid and debris to pass through when the cutting device 10A or 10B is in its operational mode. The passage of debris through the passageways enables the high pressure fluid that cuts pipe 26 to flow way from the cutting head to prevent clogging. Plate 231 may further include adjusting screws 245 spaced in intervals around the plate 231, specifically around the perimeter 237. The screws 245 may be manually adjusted to contact the inner surface of pipe 26 so as to center the plate 231 relative to the pipe.

Figure 26:
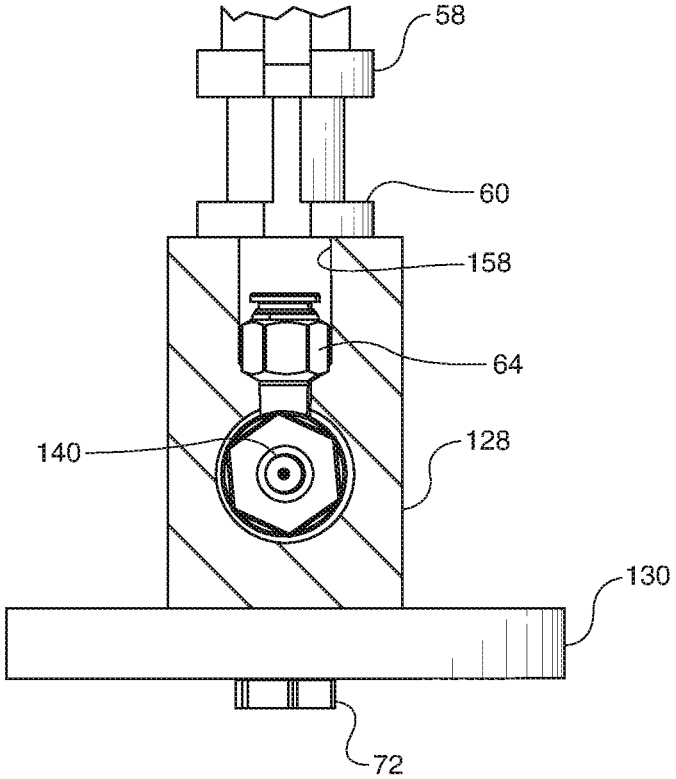
FIG. 26 is a side elevation of a cutting head assembly depicting a portion of a central abrasive feed line coupler slidably received within a slot.
Figure 27:
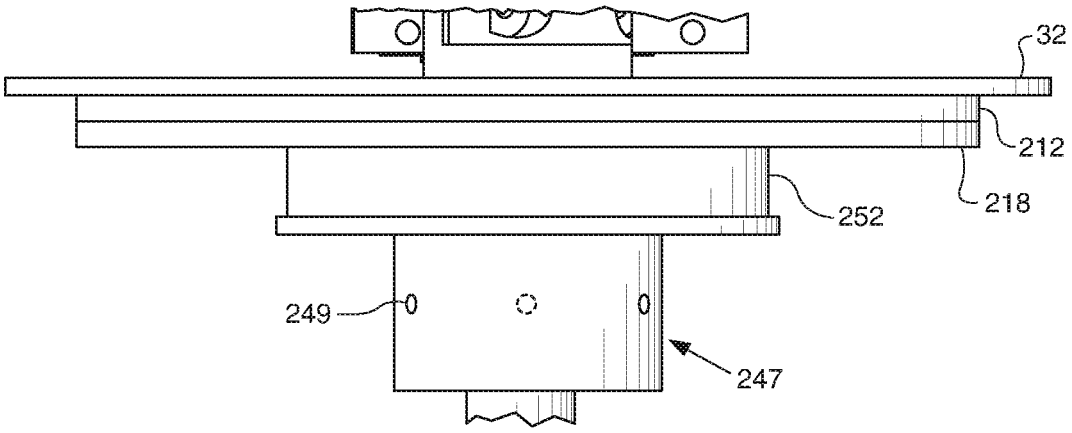
FIG. 27 is an enlarged side elevation view of a centering device in the shape of a collar configured to center the device in smaller diameter pipes to be cut.

FIG. 26 is a side elevation view of cutting head 126 depicting that coupler 64 has a smaller diameter than slot 158 so as to enable the coupler 64 to slide into and out of the slot 158. FIG. 27 depicts a centering collar 247 extending downwardly from bearing retainer 252. Centering collar 247 may substitute the centering device 258 form FIG. 21 when smaller diameter pipes need to be cut. For example, when a 4" pipe needs to be cut, the centering collar 247 may be inserted into the pipe to center the cutting assembly therein. Accordingly, centering collar 247 may have an outer diameter that is slightly less than or equal to about four inches to enable the same to slide within a four inch inner diameter pipe. The centering collar 247 defines radially extending holes 249. The radial holes 249 are design to receive centering screws therethrough (similar to set screws 245). When the device needs to cut a pipe with a smaller diameter, such as an outer diameter of two inches, the centering collar 247 may be slipped over the outside of the tube to be cut. Then, centering screws may be threaded through holes 249 to center the cutting assembly inside the pipe to be cut by screws contacting the outer surface of the pipe when the centering collar 247 is positioned radially exterior therefrom.

Additionally, other embodiments of the cutting heads 54, 126 are to be fabricated in a manner that includes at least two focus tubes for directing the mixture of UHP fluid and abrasive towards the inner surface of the pipe to be cut. For example, the cutting heads 54, 126 could each have two focus tubes rotatable at least 180° in opposite directions at the same or near the same time. This could effectively reduce the cutting time for the machine in half (as opposed to a single focus tube performing a complete 360° turn).

Figure 28:
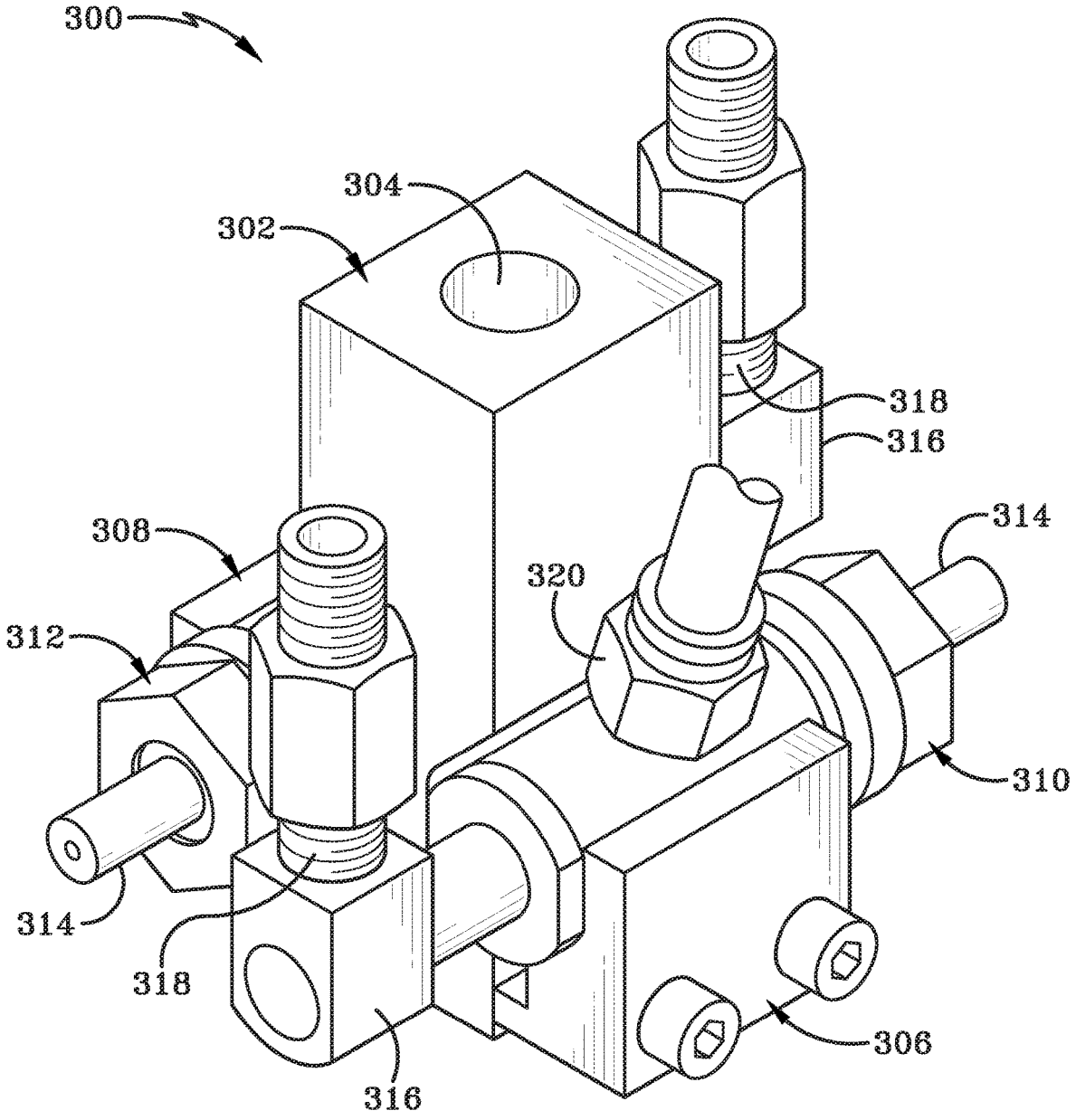
FIG. 28 is an enlarged perspective view of a first embodiment of dual head cutting heads or nozzles that direct fluid in different directions to effectuate a full cut through a pipe by rotating or revolving the cutting head assembly less than 360 degrees in accordance with another aspect of the present disclosure.

FIG. 28 depicts a portion of a cutting head assembly in accordance with an alternative embodiment of the present disclosure generally at 300. Cutting head assembly 300 includes a body 302 defining a vertically aligned central bore 304 configured to connect with or couple with, at least indirectly, support member 14. Body 302 is a substantially rigid member extending from a top down to a bottom having sidewalls extending therebetween. The body 302 may include a first arm 306 and a second arm 308 extending outwardly from the body 302 in opposite directions. Each arm 306, 308 may carry and couple with a nozzle assembly 310. More particularly, a first nozzle assembly 310 is coupled with the first arm 306 and a second nozzle assembly 312 is coupled with the second arm 308. Each nozzle assembly 310, 312 includes a nozzle 314 opposite a feed end 316. The nozzle end 314 on the first nozzle assembly 310 faces an approximate opposite direction as the nozzle end 314 on the second nozzle assembly 312. Accordingly, when UHP fluid is fed through conduit 318 into the feed end 316 of each respective nozzle assembly 310, 312, the UHP fluid is discharged out the respective nozzle end 314 in opposite directions. Thus, as the cutting head assembly 300 is rotated and carried by the support member 14 and the UHP hose is coupled with the conduits at the feed end 316 that revolve around the support member 14, the cutting head assembly 300 only needs to rotate approximately 180° in order to effectuate a fully 360° cut of the tube 26. Similar to other embodiments, each nozzle assembly 310, 312 may include an abrasive feed line input 320 to mix the UHP fluid moving the through the conduit 318 with the UHP fluid prior to its exit of the nozzle end 314.

Figure 29:
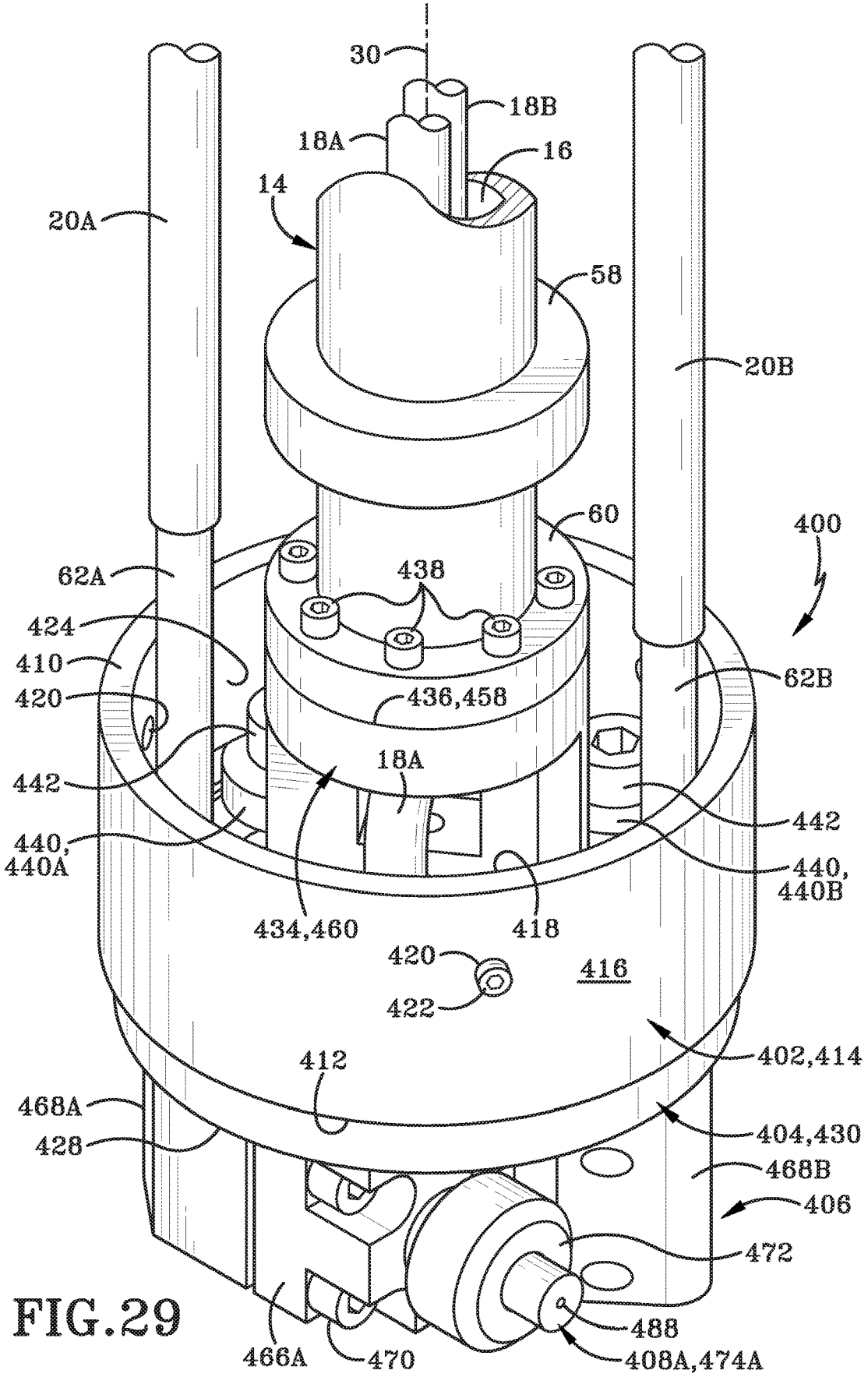
FIG. 29 is a top perspective view of a cutting head assembly having a second embodiment of dual cutting heads or nozzles that direct fluid in different directions to effectuate a full cut through a pipe by rotating or revolving the cutting head assembly less than 360 degrees in accordance with another aspect of the present disclosure.
Figure 31:
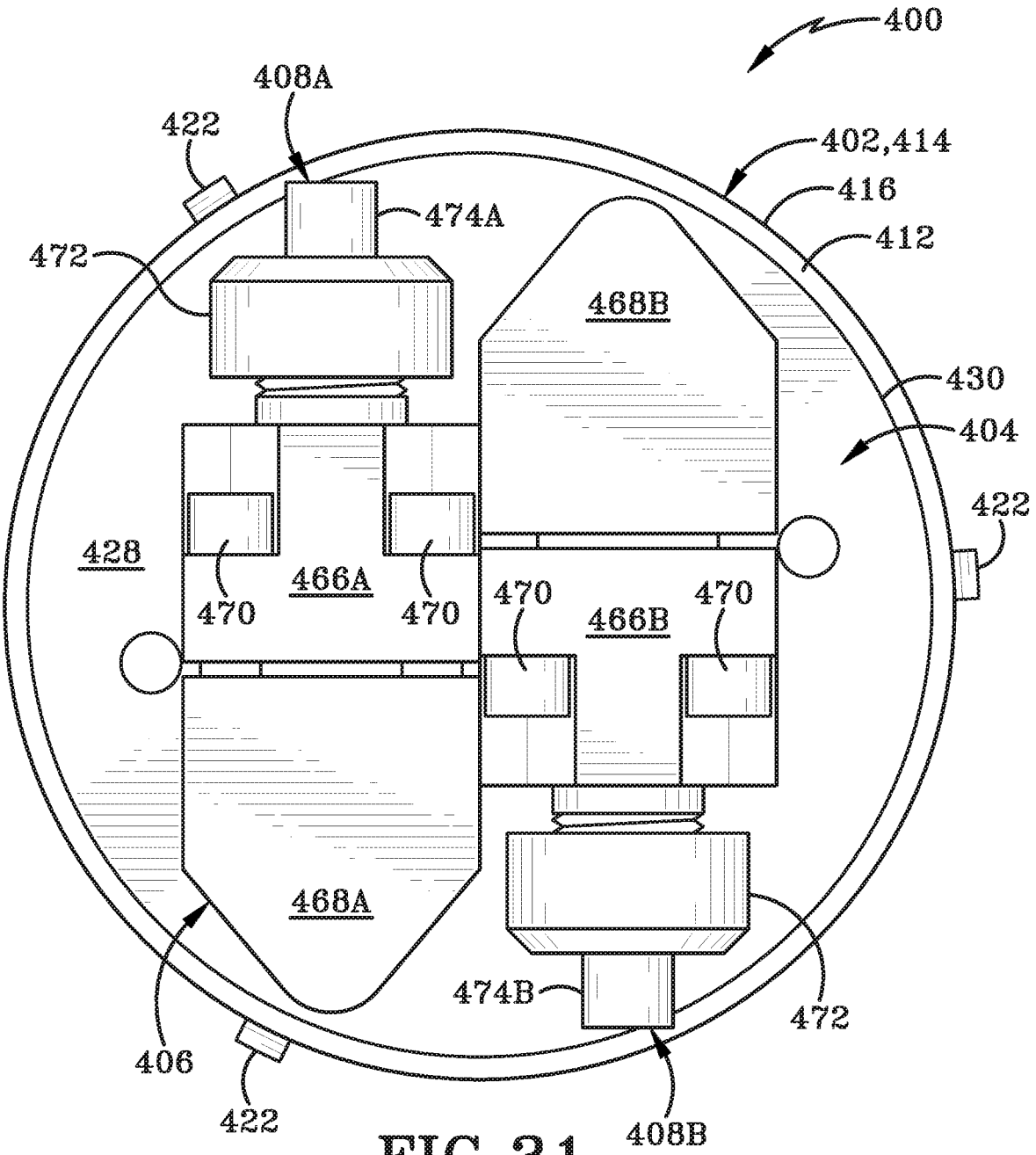
FIG. 31 is a bottom plan view of the cutting head assembly of FIG. 29.

FIG. 29 depicts another alternative embodiment of a cutting head assembly in accordance with the present disclosure generally at 400. Cutting head assembly 400 includes an annular frame 402, a lower plate 404, a dual nozzle assembly 406 having a first nozzle 408A and a second nozzle 408B (FIG. 31). As will be described in greater detail below, the first nozzle 408A and the second nozzle 408B eject fluid in different directions at a single time from the cutting head assembly 400. The use of the dual nozzle assembly 406 having the first nozzle 408A and the second nozzle 408B enables the cutting head assembly 400 to effectuate a full 360° cut through the tube or pipe 26 while making less than a 360° rotation or revolution within the central bore of the pipe 26. Assembly 400 includes a first axis of the cutting head (i.e., central vertical axis 30) disposed within an interior bore of the downhole pipe, wherein the first nozzle 408A and the second nozzle 408B each rotate or revolve around the first axis less than 360° operative to impart a fully 360° cut to the down hole pipe 26.

In one particular embodiment, frame 402 is a rigid annular member having an upper end 410 opposite a bottom end 412 and a cylindrical sidewall 414 extending therebetween. Cylindrical sidewall 414 has a convexly curved outer surface 416 opposite a concavely curved inner surface 418. A radially aligned thickness of the cylindrical wall 414 is measured relative to the central vertical axis 30 and is defined by the distance between the outer surface 416 and the inner surface 418. Inner surface 418 is disposed radially closer to the central vertical axis 30 than the outer surface 416. Cylindrical wall 414 defines a plurality of radially aligned apertures 420 receiving set screws 422 therein. In one particular embodiment, the apertures 420 are offset closer to the upper end 410 of cylindrical wall 414. However, it is entirely possible that the apertures 420 are centered in the cylindrical wall 414 between the upper end 410 and the lower end 412. Alternatively, the aperture 420 may be offset closer to the lower end 412. Inner surface 418 defines a lumen or central bore 424 configured to be a sufficient volume/area to allow other components of assembly 400 to fit therein.

Figure 33:
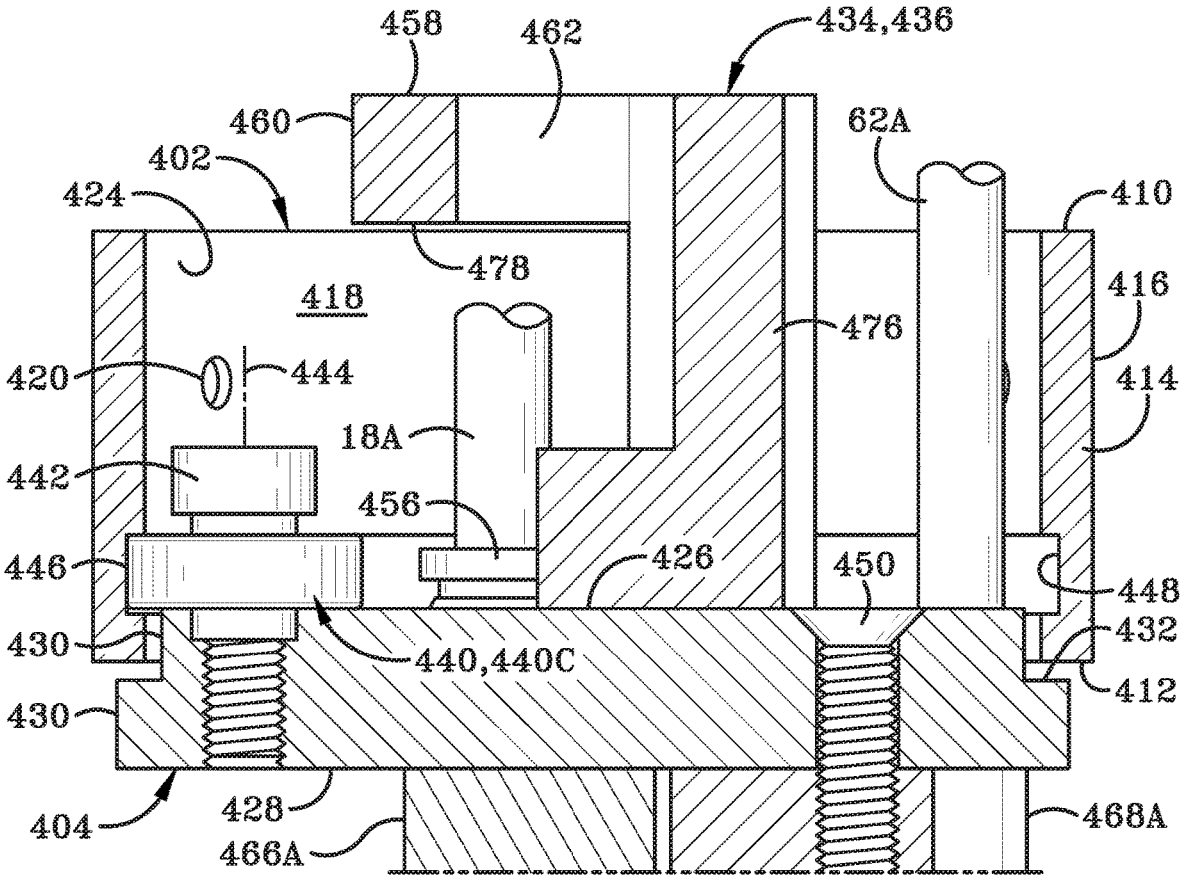
FIG. 33 is a cross section view of the cutting head assembly having dual cutting heads or nozzles taken along line 33-33 in FIG. 30.

Bottom plate 404 is a substantially rigid disc or plinth-shaped member that substantially covers a portion of the bore 424 defined by the inner surface 418 of the cylindrical wall 414. Bottom plate 404 includes an upwardly facing top surface 426 (FIG. 33) opposite a downwardly facing bottom surface 428 (FIG. 33). A sidewall 430 (FIG. 33) extends from the top surface 426 to the bottom surface 428. Sidewall 430 is stepped such that the top surface 426 has a smaller diameter than the bottom surface 428. In one particular embodiment, there is a single step between the top surface 426 and the bottom surface 428, however it is possible to have multiple steps formed in the sidewall 430. The step in the sidewall 430 defines a ledge 432 that extends radially inward from the outer surface of the sidewall 430 adjacent the bottom 428. The smaller diameter associated with the top surface 426 of the bottom plate 404 enables a portion of the bottom plate 404 to be inserted into bore 424 adjacent the lower end 412 of the frame 402. The first nozzle 408A and the second nozzle 408B mount to the bottom surface 428 of the bottom plate 404. When assembled, the first and second nozzles 408A, 408B are disposed below the bottom surface 428 of bottom plate 404.

Figure 30:
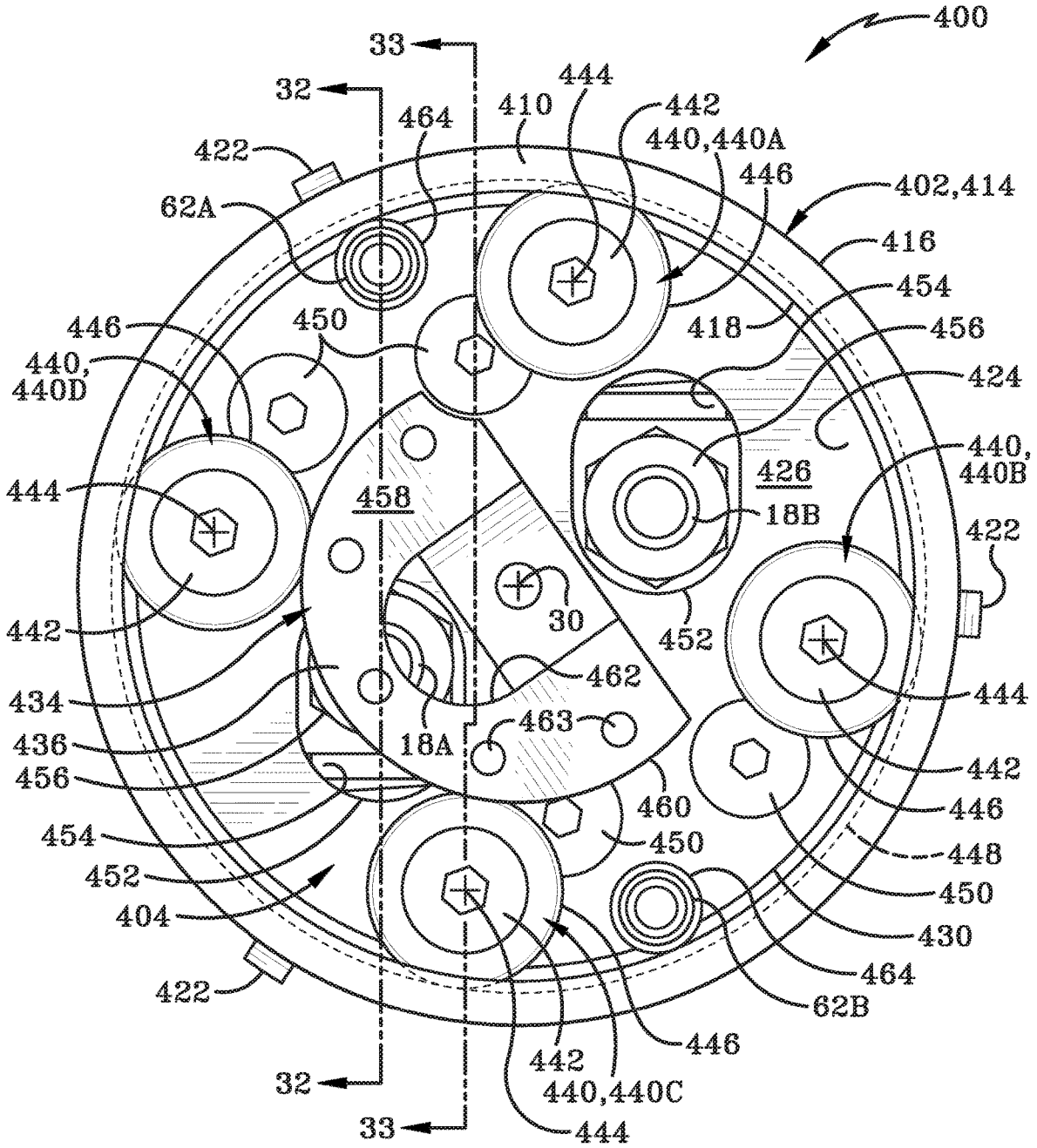
FIG. 30 is a top plan view of the cutting head assembly of FIG. 29.

With continued reference to FIG. 29, a central support 434 extends upwardly from a rigid connection with a top surface 426 of bottom plate 404 and is disposed within the bore 424 of the annular frame 402. Central support 434 includes an upper end 436 that is rigidly secured to lower flange 60 on the support member 14. In one particular embodiment, the upper end 436 of central support 434 is mechanically connected via connectors 438 through threaded bores 463 (FIG. 30). In one particular embodiment, connectors 438 are bolts that threadably secure the central support 434 to flange 60. However, other manners in connecting the central support 434 to the lower flange 60 are entirely possible. For example, a chemical connection can be utilized or other mechanical connections may be utilized, such as welding. Further, it is entirely possible to use other non-mechanical and non-chemical connections to effectuate the rigid attachment of the central support 434 to the lower flange 60. As will be described in greater detail below, central support 434 is shaped in a manner so as to effectuate the passage of a first abrasive feedline 18A and a second abrasive feedline 18B to the first nozzle 408A and the second nozzle 408B, respectively.

With continued reference to FIG. 29, the cutting head assembly 400 may be utilized with a pipe cutting device that has two UHP tubes 20A, 20B. Namely, a first UHP tube 20A is in fluid communication with the first nozzle 408A and a second UHP tube 20B is in fluid communication with the second nozzle 408B. Similar to other embodiments, a first nipple 62A may be intermediate the lower end of the UHP tube 20A and the first nozzle 408A. Similarly, a second nipple 62B may be intermediate the lower end of the second UHP tube 20B and the second nozzle assembly 408B. Additionally, in this particular embodiment, the UHP tubes 20A, 20B are disposed radially outward of the central support member 14 such that the first and second UHP tubes 20A, 20B revolve around the central support 434 as the cutting head assembly 400 is rotated about the central vertical axis 30. The dual or first and second UHP tubes 20A, 20B enable the first and second nozzles 408A, 408B to effectuate a 360° cut while rotating less than 360° about the central vertical axis 30. However, it is entirely possible for a device having dual nozzles to use only a single UHP tube. For example, piping or other plumbing may be used to establish fluid communication between a single UHP tube, such as the first UHP tube 20A or another UHP tube 20 that is fed to a first nozzle 408A and a second nozzle 408B that would enable the UHP tube 20 to revolve around the outer surface of the central support 434 while still enabling the first and second nozzles 408A, 408B to complete a 360° cut through the pipe 26 which the cutting head assembly 400 only rotates approximately 180°.

FIG. 30 depicts a plurality of bearings 440 rotatively or rotatably mounted above the upper surface 426 of the bottom plate 404. In one particular embodiment, there may be four bearings in the plurality of bearings 440, namely, a first bearing 440, a second bearing 440B, a third bearing 440C, and a fourth bearing 440D. Each bearing from the plurality of bearings 440 may be mounted to the bottom plate 404 via a connector, such as a screw 442, that defines a vertical rotational axis 444 about which each respective bearing can rotate. The bearing axes 444 may be offset from each other at 90° intervals relative to the central vertical axis 30. However, it is entirely possible that the plurality of bearings 440 to be positioned at other locations relative to the bottom plate 404.

Figure 32:
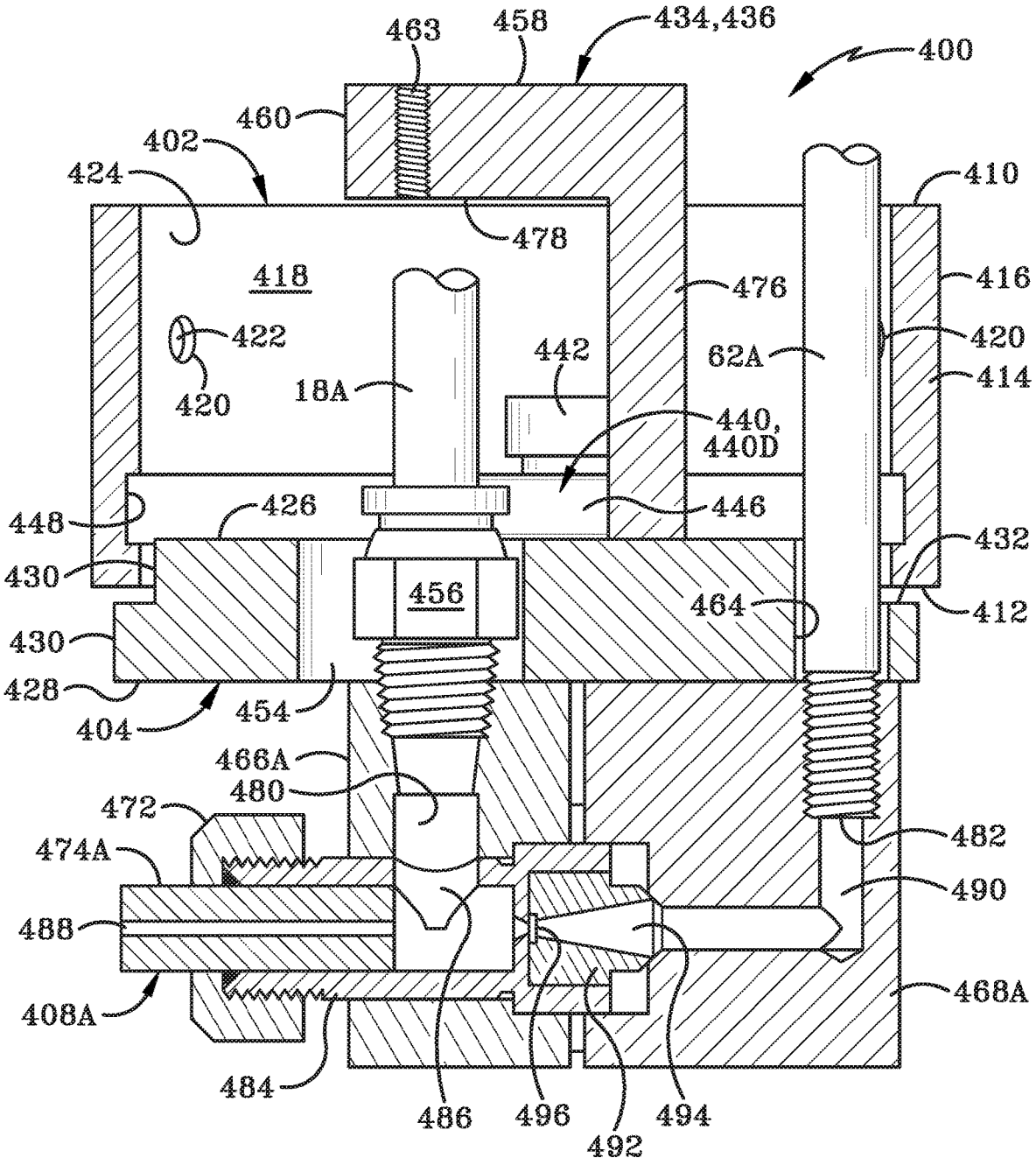
FIG. 32 is a cross section view of the cutting head assembly having dual cutting heads or nozzles taken along line 32-32 in FIG. 30.

Each bearing from the plurality of bearings 440 includes a convex outer surface 446 defining a radius relative to its own respective bear axis 444. The bearing axis 444 is oriented relative to the sidewall 430 of the bottom plate 404 such that the outer surface 446 of each respective bearing overhangs the top surface 426 above the ledge 432. Stated otherwise, the distance from an outermost point on the first bearing 440A to an outermost point on the third bearing 440C, measured through the central axis 30, is greater than the diameter of the top surface 426 of the bottom plate 404. The outer surface 446 contacts and rides within a channel 448 defined in the inner surface 418 of the cylindrical sidewall 414. In one particular embodiment, the channel 414 is a substantially C-shaped channel when viewed in cross-section, as depicted in FIG. 32. However, the C-shaped channel is not necessary. It is entirely possible for the channel 414 to simply be defined by a bottom ledge that enables a bottom portion of each respective bearing to rest thereon as the convex outer surface 446 of each bearing rides along the inner surface 418 of the cylindrical sidewall 414. The plurality of bearings 440 cooperate to enable the bottom plate 404 carrying the first nozzle 408A and the second nozzle 408B to rotate within the frame 402 as the cylindrical sidewall 414 of frame 402 remains relatively stationery and releasably secured to the inner surface of the pipe 26 via the set screws 422.

With continued reference to FIG. 30, connectors, such as screws 450, extend through the bottom plate 404 from the top surface 426 to the bottom surface 428 and rigidly and releasably secure each respective nozzle 408A and 408B to the bottom surface 428 of the bottom plate 404. The bottom plate 404 may further include an inner completely bound edge 452 that defines a through aperture 454 extending fully from the upper surface 426 to the bottom surface 428 of the plate 404. More particularly, there may be two edges 452 and two apertures 454 that are spaced apart from each other approximately 180° relative to the central vertical axis 30. Each respective aperture 454 is configured to receive a respective abrasive feedline 18A, 18B. Alternatively, conduits or other fittings 456 may extend through or closely adjacent the aperture 454 that are configured to fluidly couple the abrasive feedlines 18A, 18B to each respective nozzle 408A, 408B.

In one particular embodiment, an upper surface 458 of the central support 434 is substantially C-shaped having a convexly curved outer edge 460 and a concave inner edge 462. Apertures 463 extend through the upper surface 458 in the central support 434 between the convex outer edge 460 and the concave inner edge 462. While the upper surface 458 is shown as substantially C-shaped, it is entirely possible that the upper surface 458 of the central support 434 could be fabricated to be other alternative shapes. However, in one non-limiting embodiment, the arcuate cutout region defined by the concave inner edge 462 enables a portion of the abrasive feedline from either the first feedline 18A or the second feedline 18B to pass therebetween and below the upper surface 458 of the central support 454 to connect with one of the nozzles or its respective fittings 456.

Bottom plate 404 may further define aperture 464 by a circular edge. Apertures 464 are configured to receive each respective nipple 62A, 62B therein to connect with a feed end of each respective nozzle 408A, 408B. In this particular embodiment, the apertures 464 are positioned radially outward at a greater distance relative to central axis 30 than the fittings 456 in or adjacent aperture 464. Further, the center of apertures 464 are positioned radially outward at a farther distance relative to the vertical central axis 30 than the bearing axes 444. By positioning the apertures 464 at a radially outward portion of the bottom plate 404, the assembly 400 is able to insure that the UHP tubes 20A, 20B revolve around the central support member 14 during operation of the cutting head assembly 400. More particularly, the use of two nipples 62A, 62B coupled to two nozzles 408A, 408B enables the cutting head assembly 400 to complete a full cut of the pipe 26 while only needing to rotate the bottom plate 404 and revolve the UHP tubes 20A, 20B approximately 180° relative to the central vertical axis 30.

FIG. 31 depicts a bottom plane view of the first nozzle 408A and the second nozzle 408B. Each respective nozzle 408A, 408B includes a rigid support member securing it to the bottom surface 428A of bottom plate 404. More particularly, the first nozzle 408A may be coupled with a first rigid support member 466A and in fluid communication with a second rigid support member 468A. The second nozzle 408B may be secured to support member 466B which is rigidly connected with support member 468B. Support members 466A and 468A are oriented in a manner such as to be aligned generally parallel, but opposite that of support member 466B and support member 468B. Accordingly, in one embodiment, nozzle 408A and nozzle 408B face approximately opposite directions. While the directions of the nozzles 408A and 408B are approximately 180° apart, other orientations are entirely possible provided that the directions of the nozzles are different. For example, the different directions that the nozzles face may be less than 180° relative to each other. Even if the nozzles are less than 180° different from each other, the cutting head assembly 400 is still able to complete a 360° cut in the pipe 26 without completing a full 360° revolution of the UHP tubes 20A, 20B around the central support member 14. While bolts 470 are used to respectively connect 466A, 468A and 468B, 466B, it is entirely possible that other connection mechanisms could be used to rigidly secure members 466A, 466B to members 468A, 468B, respectively. Each nozzle may be coupled to its respective member 466A or 466B via a threaded cap or nut 472 having a diameter greater than a nozzle exit tube 474A on the first nozzle 408A and a nozzle exit tube 474B on the second nozzle 408B.

FIG. 32 depicts the central support member 434 is substantially an inverted L-shape in cross-section such that a vertical leg 476 extends downwardly from the C-shaped upper surface 458. Below the upper surface 458 is a C-shaped bottom surface 478 that rigidly connects with the vertical leg 476. The vertical leg 476 is offset from the central vertical axis such that it is disposed intermediate the central vertical axis 30 and the nipple 62A. The positioning of the vertical leg 476 on the central support 432 enables the abrasive feedline 18A to be connected with a fitting 456 disposed within aperture 454 through bottom plate 404. Fitting 456 connects with a threaded bore within support member 466A. An inner bore 480 allows abrasive to enter into fluid communication with UHP fluid moving through support member 466A. In one particular embodiment, the flow of abrasive through feedline 18 and fitting 456 and bore 480 is substantially orthogonal to UHP fluid which moves in a substantially horizontal direction below the lower terminal end 482 of nipple 62A. Support member 466A may further receive a horizontally oriented fitting 484 defining a tapered aperture 486 configured to feed abrasive therein. Fitting 484 is coupled with the nozzle exit tube 474A defining an exit port 488 for mixed abrasive and UHP fluid to exit the first nozzle 408A.

Support member 468A includes an L-shaped bore 490 that alters the direction of UHP fluid moving therethrough. The bore 490 includes a substantially vertical leg and a substantially horizontal leg to alter the direction of UHP fluid movement approximately 90° towards a fitting 492 inserted into a portion of the support member 468A having a tapered bore 494 configured to increase the velocity of the UHP fluid as the UHP fluid moves through a gem 496.

FIG. 33 depicts the disposition of one of the bearings 440 within the annular C-shaped channel 448. Each one of the bearings 440 is able to freely rotate about its vertical axis 444 such that the convexly curved outer surface 446 rides within the channel 448. The outermost point of the outer surface 446 is relatively disposed radially outward of the top surface 426 and relatively disposed radially inward of the bottom surface 428.

Figure 34A:
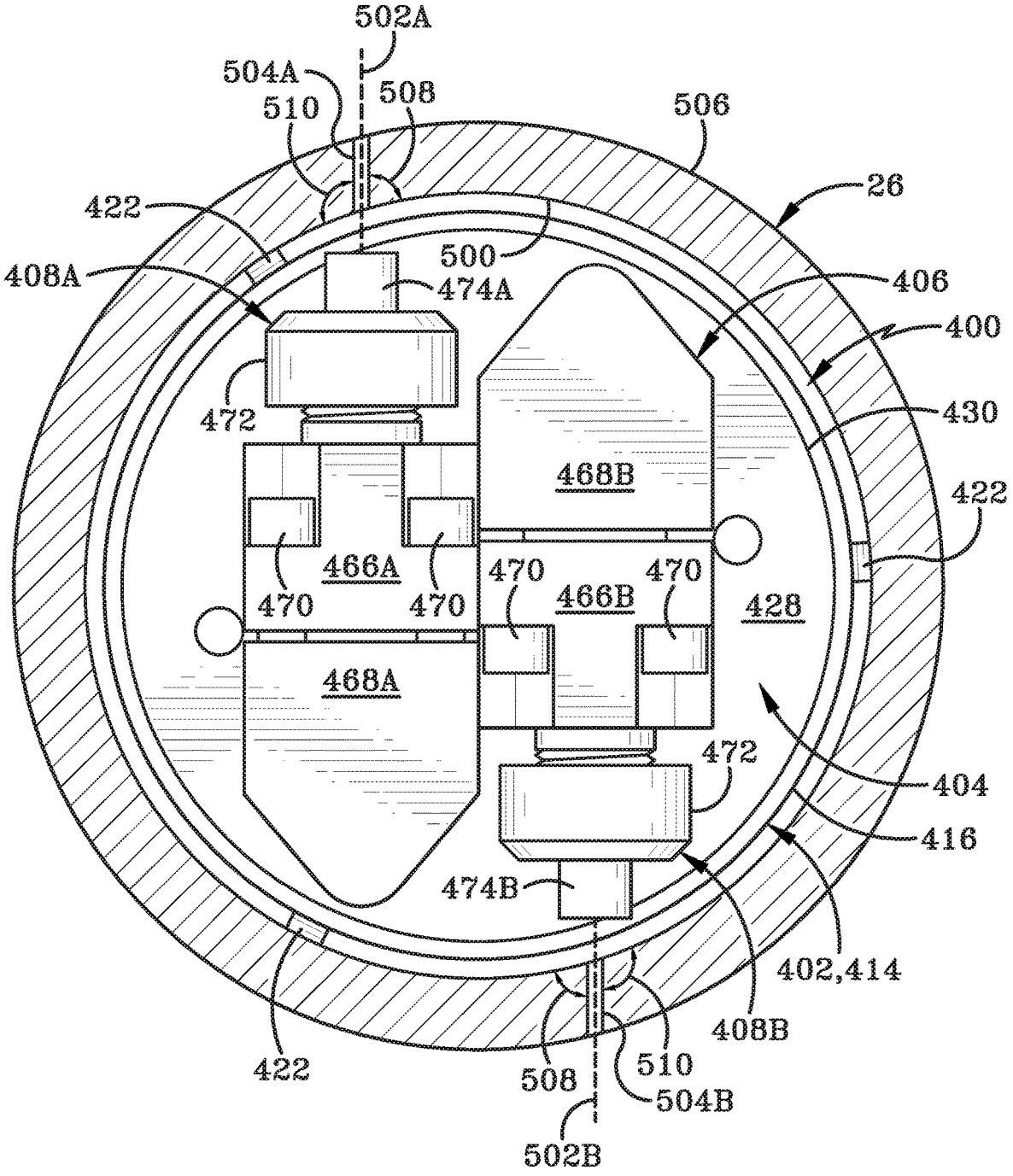
FIG. 34A is a first operational bottom view of the cutting head assembly having dual cutting heads or nozzles within a pipe in which fluid exits the nozzles to bore pilot holes that start the cut through the pipe.

FIG. 34A depicts a bottom view of the cutting head assembly 400 installed within a pipe 26 that is to be cut. Namely, the operation of cutting head assembly 400 occurs after the lower end 24 of the device is inserted into pipe 26. With the cutting head assembly 400 inserted into pipe 26, the outer surface 416 of the frame 402 is disposed radially inward from the inner surface 500 of the pipe 26 that is to be cut. An operator aligns the cutting head assembly 400 and preferably centers it within the pipe 26 that is to be cut by setting the set screws 422 to contact the inner surface 500 of pipe 26 such that the first nozzle 408A and the second nozzle 408B are pointed at the inner surface 500. However, other techniques to center the assembly 400 within the pipe 26 are possible.

In one particularly embodiment, the first nozzle 408A includes a first nozzle axis 502A that is oriented towards the inner surface of the pipe 500. The second nozzle 408B includes a second nozzle axis 502B that is oriented towards or aimed towards the inner surface 500 of the pipe 26 in a different direction than that of axis 502A. In one particular embodiment, axis 502A is offset parallel to axis 502B. However, other orientations are entirely possible that effectuate different cutting directions associated with the plurality of nozzles carried by the cutting head assembly 400.

With continued reference to FIG. 34A, UHP fluid is pumped through each respective UHP tube 20A, 20B to its respective fluid nozzle 408A, 408B. Within the nozzle assembly 406, UHP fluid from the UHP tube 20A mixes with abrasive carried by the abrasive feedline 18A inside the first member 466A. The UHP fluid and abrasive mixture are expressed, shot, or otherwise directed outward at a high velocity and a high pressure from the nozzle exit tube 474 along first axis 502A. The UHP fluid existing the nozzle exit tube 474 along axis 502A creates a pilot bore or cut through the tube 26. The pilot bore or cut 504 extends entirely through pipe 26 from its inner surface 502 to an outer surface 506.

A similar UHP fluid and abrasive mixture mixes within the second nozzle 408B and is directed or ejected outwardly from the nozzle exit tube 474 on the second nozzle 408B along the second axis 502B. The UHP fluid and abrasive mixture traveling along axis 502B creates a second pilot cut 504B through the sidewall of pipe 26 from its inner surface 500 to its outer surface 506. The pilot cut 504A and the pilot cut 504B are approximately 180° apart from each other. In one particular embodiment and as shown in FIG. 34A, the pilot cuts 504A, 504B are not exactly radially aligned relative to the vertical center axis 30. Rather, the pilot cuts 504A, 504B are parallel to each other centered about the vertical center axis 30 such that an acute angle 508 and a complimentary obtuse angle 510 are formed on either side of the pilot cut 504A, 504B relative to the inner surface 500.

With continued reference to FIG. 34A, the fluid streams respectively exiting from the first nozzle 408A and the second nozzle 408B along their respective nozzle axes 502A, 504B move UHP fluid carrying abrasive in different directions. In one particular embodiment, a first stream of UHP fluid moves along the first axis 504A in a first direction. The second stream of UHP fluid moves through the second nozzle 408B in a second direction along the second axis 504B wherein the second direction is different than the first direction. As indicated previously, typically the first direction is oriented approximately 180° from the second direction. However, it is entirely possible for these ranges to differ. For example, the first direction associated with the moving first stream of UHP fluid along the first axis 502A may be offset from the second direction associated with the second axis 502B in a range from about 90° to about 270°. Stated otherwise, the first nozzle 408A may be oriented only 90° from the second nozzle 408B. In this instance, rather than the axes being parallel to each other, the axes 502A, 502B would be orthogonal to each other such that the nozzle heads are offset orthogonal to each other. The orthogonal alignment of the axes 502A, 502B, while not shown in FIG. 34A, it is to be understood that the cutting head assembly 400 would still be able to complete a full 360° cut through the pipe 26 without completing a full rotation or revolution of the cutting head assembly 400 relative to the central vertical axis 30. Thus, even if the axes 502A, 502B are not parallel to each other, the cutting head assembly is still able to rotate or revolve the two orthogonal nozzles about the central vertical axis 30 less than 360° while still being able to complete the full 360° cut through the pipe 26.

Figure 34B:
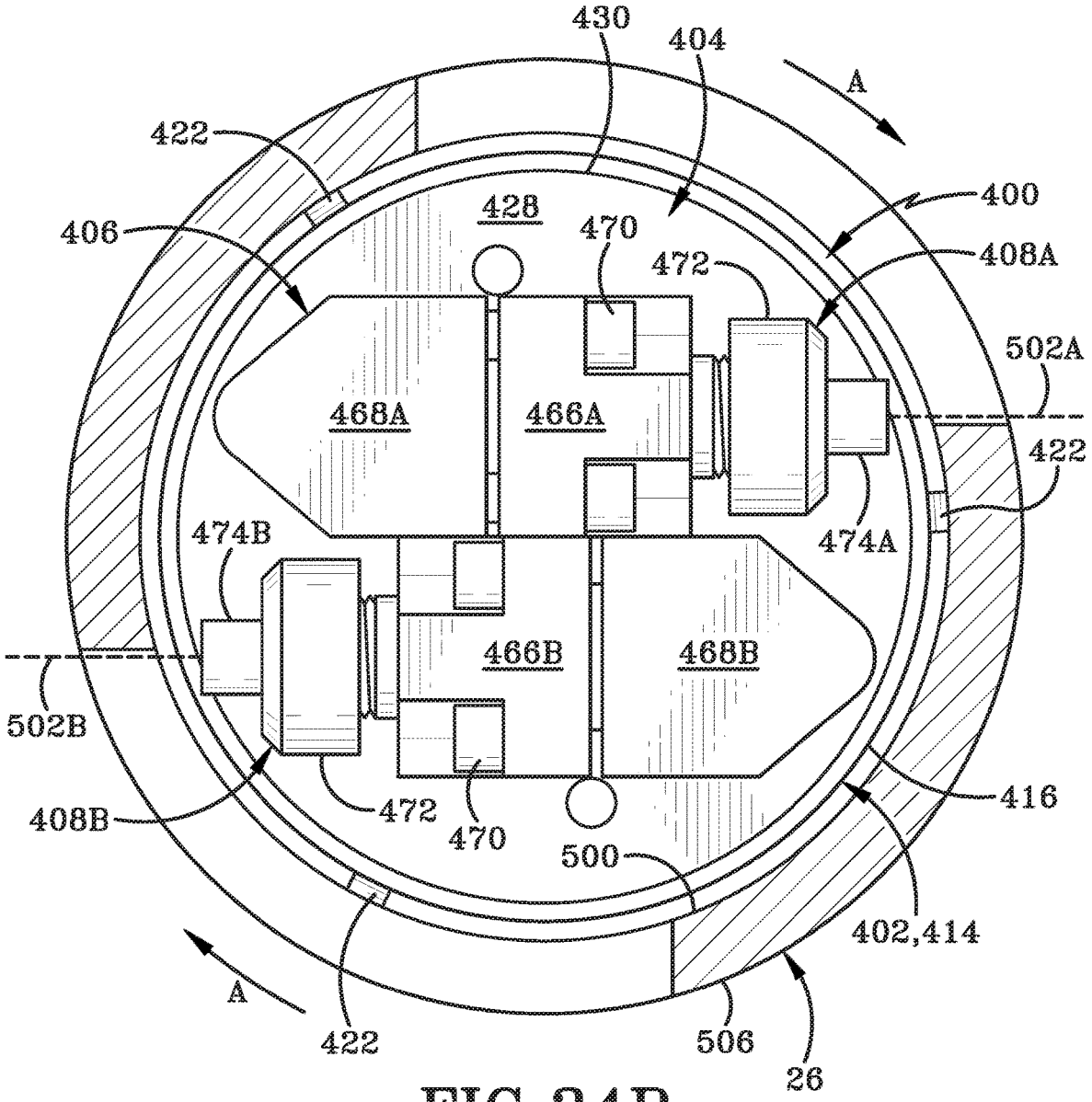
FIG. 34B is a second operational bottom view of the cutting head assembly having dual cutting heads or nozzles rotating 90 degrees within the pipe and cutting two ninety degree regions that sum to 180 degrees of cutting coverage such that the cutting coverage doubles the rotation or revolution of the cutting head assembly.

FIG. 34B depicts a partially cut tube 26 in which the cutting head assembly 406 has rotated the first nozzle 408A and the second 408B in the clockwise direction, when viewed from the bottom, as indicated by arrow A. During the rotation of the bottom plate 404 (effected by rotation of support member 14 driven by motor 12), which effectuates the rotation of the first nozzle 408A and the second nozzle 408B, the UHP fluid exists the nozzles respectively along the nozzle axes 502A, 502B. During the rotation of the first nozzle 408A and the second nozzle 408B about the central vertical axis 30, the respective bearings from the plurality of bearings 440 are rotating about each bearing axis 444, which is offset parallel to the central vertical axis 30. In each instance, the axis 444 and the central vertical axis 30 are within or radially inward from the inner surface 418 of the cylindrical wall 414 which is shaped as a collar. The convex outer surface 446 of each bearing 440 contacts the channel 448 defined by the inner surface 418 of the cylindrical wall 414 of frame 402 that remains generally stationary relative to pipe 26. The convex outer surface 446 contacts channel 414 as the bearing 440 rotates about each bearing axis 444 while simultaneously the bearing revolves around the central vertical axis 30.

Figure 34C:
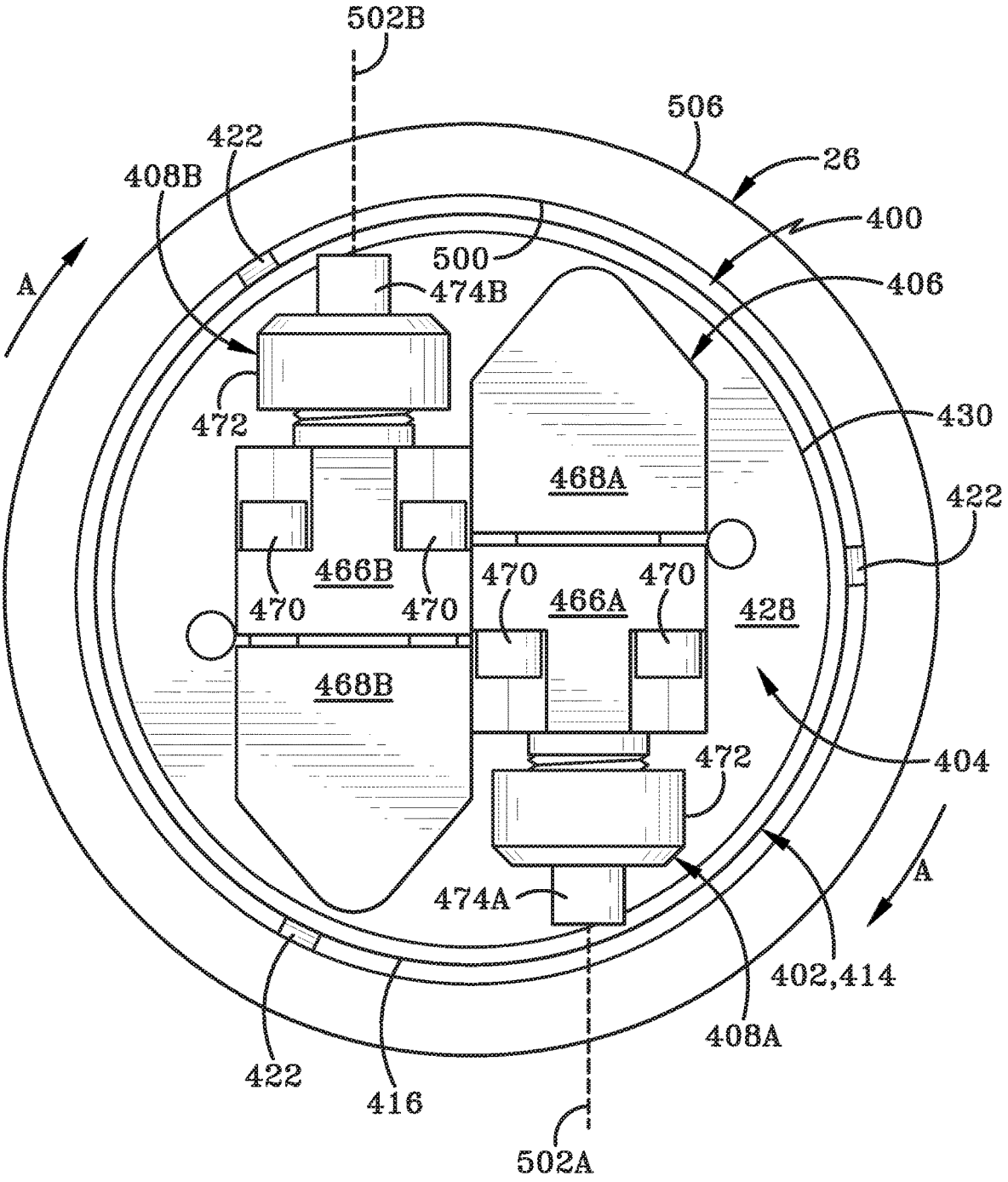
FIG. 34C is a third operational bottom view of the cutting head assembly having dual cutting heads or nozzles rotating 180 degrees within the pipe and cutting two 180 degree regions that sum to a 360 degree full cut through the pipe.

FIG. 34C depicts a complete 360° cut through the pipe 26 after completing only approximately a 180° rotation of the first nozzle 408A and the second nozzle 408B in the counterclockwise direction indicated by arrow A. During the cut from the position of FIG. 34B to the position of FIG. 34A, UHP fluid mix with abrasive is continuously exiting each respective nozzle 408A, 408B along its respective nozzle axis 502A, 502B. The UHP fluid continues cutting through the sidewall of the pipe 26 from its inner surface 500 to its outer surface 506. After the pipe 26 has been entirely cut but completing less than an entire revolution or rotation of the cutting head assembly 400, the upper portion of the pipe that was cut that is closer to the ground surface may be extracted. After extracting the pipe from the ground, the cutting head assembly 400 may be lifted vertically upward out of the downhole disposition so as to leave a lower portion of the pipe in the ground. The lower portion of the pipe left in the ground may then be capped with a known capping mechanism that effectively seals the lower portion of the pipe in the ground and the hole may be backfilled and covered.

Figure 35:
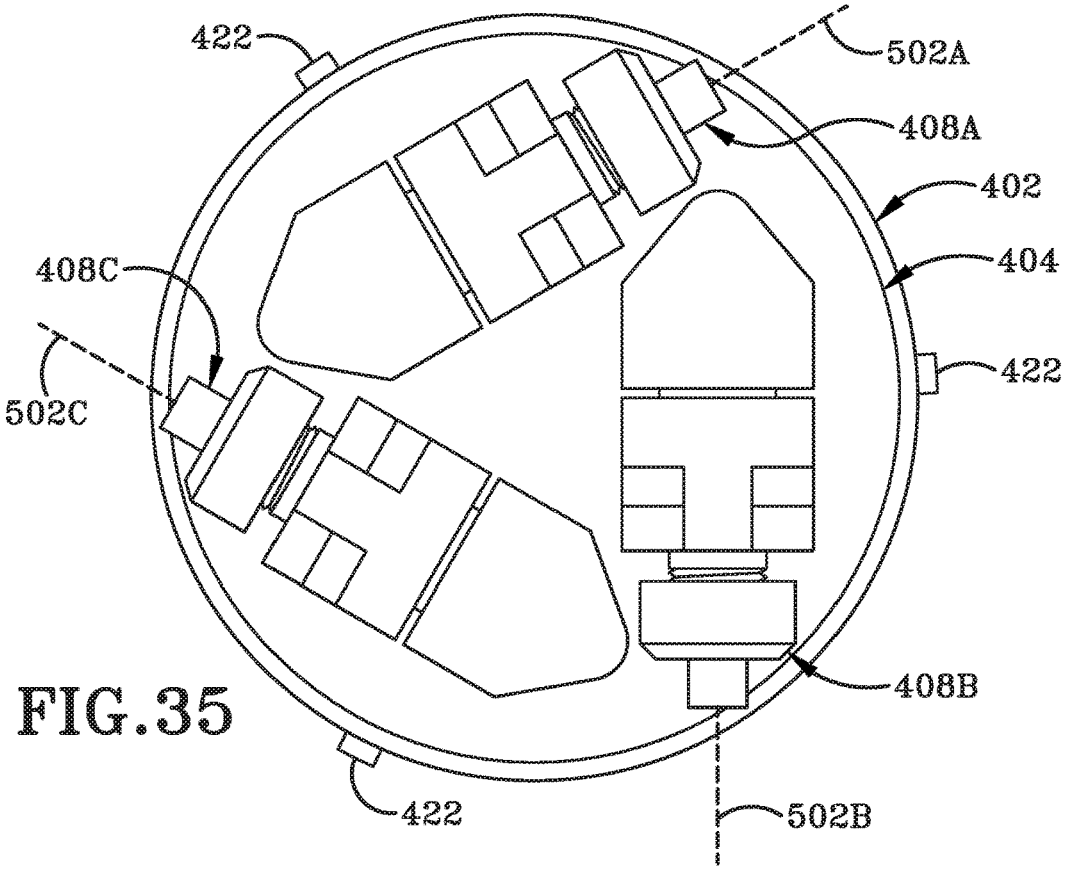
FIG. 35 is a bottom view of an alternative embodiment of a cutting head assembly having three cutting heads or nozzles in accordance with one aspect of the present disclosure.

FIG. 35 depicts an alternative embodiment of the present disclosure in which the nozzle assembly 406 includes three nozzles rather than two. More particularly, a first nozzle 408A is offset approximately 120° from a second nozzle 408B which is offset approximately 120° from a third nozzle 408C. Each nozzle 408A, 408B, 408C has a nozzle axis 502A, 502B, 502C, respectively. Axis 502A is approximately 120° from axis 502B. Axis 502B is approximately 120° from axis 502C and axis 502C is approximately 120° from axis 502A. With three nozzles 408A, 408B, 408C, the cutting assembly is able to complete a full 360° degree cut through the pipe 26 using UHP fluid mixed with abrasive by only rotating the nozzles approximately 120°. More particularly, in this instance, the nozzles are rotated less than 180° to complete the full 360° cut through the pipe 26. When implementing the cutting head assembly 400 with three nozzles, the three nozzles are generally oriented in an equilateral triangle configuration with each nozzle directing UHP fluid mixed with abrasive outwardly from a different leg of the triangular configuration.

Figure 36:
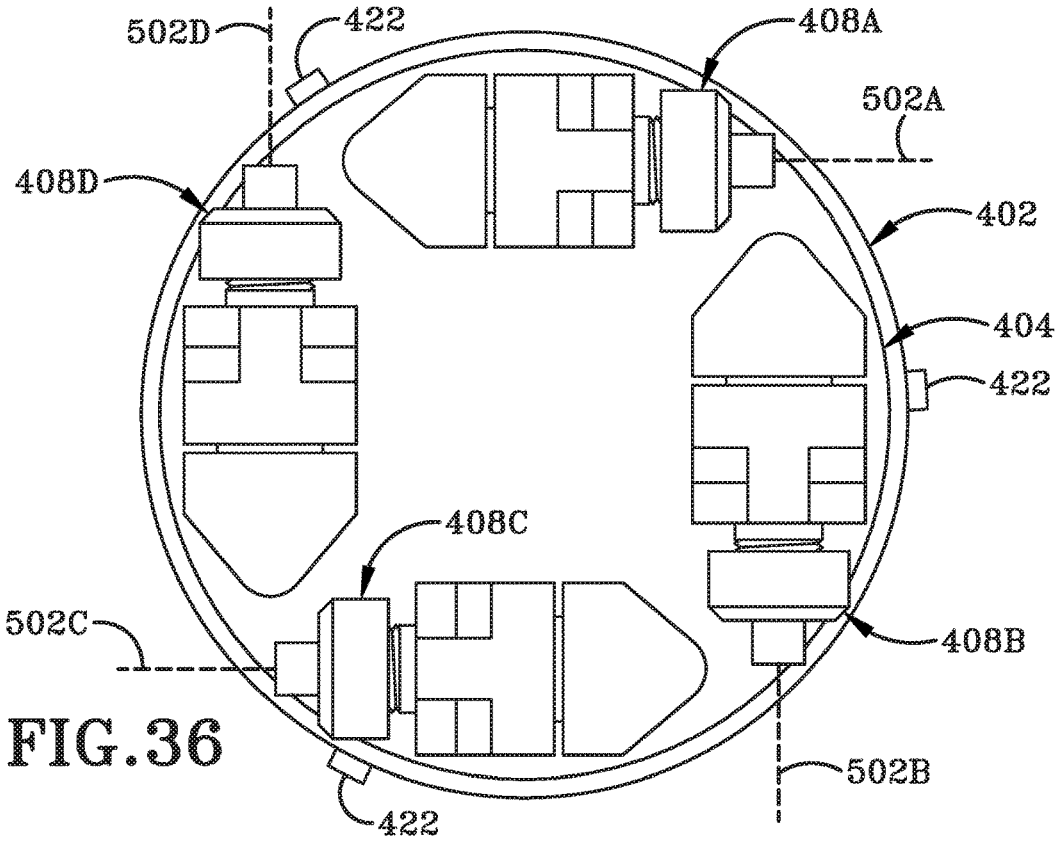
FIG. 36 is a bottom view of another alternative embodiment of a cutting head assembly having four cutting heads or nozzles in accordance with another aspect of the present disclosure.

FIG. 36 depicts an alternative orientation or configuration of the cutting head assembly 400 that has four nozzles, namely, a first nozzle 408A, a second nozzle 408B, a third nozzle 408C, and a fourth nozzle 408D. Each respective nozzle has a nozzle axis. More particularly, a first nozzle axis 502A is approximately 90° and orthogonal to a second nozzle axis 502B which is approximately 90° and orthogonal to a third nozzle axis 502C which is approximately 90° and orthogonal to a fourth nozzle axis 502D which is approximately orthogonal to the first nozzle axis 502A. The nozzles in this orientation are all directing UHP fluid in four different directions approximately 90° from each other. In this configuration, the cutting head assembly 400 is able to complete a 360° full cut through the pipe 26 by only completing a proximate quarter turn or 90° rotation or revolution relative to vertical center axis 30.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented with software to assist in driving the motor 12 and various other power controls, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral" and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A cutting head for a down hole pipe to be cut, the cutting head comprising:

a first nozzle to direct pressurized fluid towards an inner surface of the down hole pipe;

a second nozzle to direct pressurized fluid towards a different portion of the inner surface of the down hole pipe;

wherein the pressurized fluid has a pressure when exiting the first nozzle and second nozzle sufficient to cut the down hole pipe;

a first axis of the cutting head disposed within an interior bore of the downhole pipe, wherein the first nozzle and the second nozzle each rotate or revolve around the first axis less than 360° operative to impart a fully 360° cut to the down hole pipe;

a first distance defined between the first nozzle and the second nozzle;

an annular frame having an outer surface and an inner surface defining a central bore centered along the first axis and an inner diameter measured through the first axis and an outer diameter measured through the first axis;

wherein the inner diameter of the annular frame is greater than the first distance;

a top edge and a bottom edge on the annular frame defining a length of annular frame aligned parallel to the first axis;

wherein when the cutting head is disposed within the down hole pipe, the first nozzle and the second nozzle are below the bottom edge of the annular frame;

a first fluid inlet on the first nozzle positioned radially inward of the inner surface of the annular frame relative to the first axis;

a second fluid inlet on the second nozzle positioned radially inward of the inner surface of the annular frame relative to the first axis;

a first abrasive inlet on the first nozzle adjacent the first fluid inlet, wherein the first abrasive inlet is positioned radially inward of the inner surface of the annular frame relative to the first axis; and a second abrasive inlet on the second nozzle adjacent the second fluid inlet, wherein the second abrasive inlet is positioned radially inward of the inner surface of the annular frame relative to the first axis.

2. The cutting head of claim 1, further comprising:

a first nozzle axis associated with the first nozzle; and a second nozzle axis associated with the second nozzle;

wherein the first nozzle axis is offset and orthogonal to the first axis and the second nozzle axis is offset and orthogonal to the first axis opposite the first nozzle axis.

3. The cutting head of claim 1, further comprising:

a first outlet on the first nozzle; and a second outlet on the second nozzle;

wherein the first outlet faces the inner surface of the down hole pipe and the second outlet faces a different portion of the inner surface of the down hole pipe at an angle in a range from 90 degrees to 270 degrees relative to the first axis.

4. The cutting head of claim 1, further comprising:

at least one bearing rotatable about a second axis offset parallel to the first axis and an outer surface of the at least one bearing in direct contact with an inner surface of the annular frame.

5. The cutting head of claim 1, further comprising:

wherein the first abrasive inlet and the second abrasive inlet are oriented parallel to the first axis;

wherein the first fluid inlet and the second fluid inlet are orthogonal to the first abrasive inlet and the second abrasive inlet, respectively, and wherein the first and second fluid inlets couple with at least one hose that revolves around the first axis.

6. The cutting head of claim 1, further comprising:

a fluid outlet on the first nozzle positioned 180° from a fluid outlet on the second nozzle.

7. The cutting head of claim 1, further comprising:

a third nozzle to direct pressurized fluid towards a different portion of the inner surface of the down hole pipe than the first nozzle and the second nozzle; and outlets on the first nozzle, the second nozzle, and the third nozzle, respectively, wherein the outlets are positioned 120° from each other.

8. The cutting head of claim 1, further comprising:

a third nozzle to direct pressurized fluid towards a different portion of the inner surface of the down hole pipe than the first nozzle and the second nozzle;

a fourth nozzle to direct pressurized fluid towards a different portion of the inner surface of the down hole pipe than the first nozzle, the second nozzle, and the third nozzle; and outlets on the first nozzle, the second nozzle, the third nozzle, and the fourth nozzle, respectively, wherein the outlets are positioned 90° from each other.

* * * * *